US006357598B1

(12) United States Patent
Kimura et al.

(10) Patent No.: US 6,357,598 B1
(45) Date of Patent: Mar. 19, 2002

(54) PAPER SHEET MANIPULATING APPARATUS AND PAPER SHEET TRANSACTION APPARATUS

(75) Inventors: Atsunori Kimura; Yoichi Ono; Hayato Minamishin; Yuji Tanaka; Seiichi Ohno; Hidekazu Hata, all of Kawasaki; Hiroyuki Ueda; Isamu Esaki, both of Inagi; Atsushi Uchida, Yokohama, all of (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/384,207

(22) Filed: Aug. 27, 1999

Related U.S. Application Data

(62) Division of application No. 08/513,879, filed as application No. PCT/JP95/00799 on Apr. 24, 1995, now Pat. No. 6,015,147.

(30) Foreign Application Priority Data

May 20, 1994 (JP) ..... 6-107303
Feb. 16, 1995 (JP) ..... 7-028228

(51) Int. Cl.[7] ..... B07C 5/00
(52) U.S. Cl. ..... 209/534; 209/900; 271/163
(58) Field of Search ..... 209/534, 552, 209/556, 900, 922; 171/3.01, 162, 163

(56) References Cited

U.S. PATENT DOCUMENTS 4,787,518 A 11/1988 Akio et al. ..... 209/534
5,000,322 A * 3/1991 Goi ..... 209/534
5,152,512 A 10/1992 Yoshida et al. ..... 271/162 X
5,173,590 A 12/1992 Takemasa et al. ..... 209/534 X
5,468,941 A * 11/1995 Sasaki ..... 209/534 X
5,555,983 A * 9/1996 Yamagishi ..... 209/534

FOREIGN PATENT DOCUMENTS

EP 317 537 * 5/1989 ..... 209/534
EP 0 473 106 A3 3/1992
EP 0 473 106 A 3/1992
GB 2 217 086 A 10/1989
GB 2 217 086 10/1989
GB 2 225 662 A 6/1990

(List continued on next page.)

*Primary Examiner*—Tuan N. Nguyen
(74) *Attorney, Agent, or Firm*—Armstrong, Westerman, Hattori, McLeland & Naughton, LLP

(57) ABSTRACT

A paper sheet manipulating apparatus and a paper sheet transaction apparatus for manipulating paper sheets such as bills has an inlet/outlet port allowing input and output of paper sheets and rotating between the paper sheets inlet position and the paper sheet feeding position; a separating device projected to the outlet port and drawn back to the draw-back position, distinguished, when projected, the paper sheets inputted to the inlet port and the paper sheets to be returned and accommodate the paper sheets into the outlet port; an accommodation section for accommodating the paper sheets; a temporary storing section for temporarily storing the paper sheets which should not be accommodated in the accommodation section or should not be exhausted and a plurality of cassettes for feeding and collecting the paper sheets in the accommodation section and for feeding and collecting the paper sheets in the outlet port, whereby few faults are generated and manipulations can be continued at a high speed for a long period of time without any pause even if a fault is generated.

25 Claims, 50 Drawing Sheets

FOREIGN PATENT DOCUMENTS

| | | | |
|---|---|---|---|
| GB | 2 225 662 | 6/1990 | |
| JP | 59-149587 | 8/1984 | |
| JP | 59-205693 | 11/1984 | |
| JP | 59-43317 | 12/1984 | |
| JP | 62-157994 | 7/1987 | |
| JP | 1-118986 | 5/1989 | |
| JP | 2-12594 | 1/1990 | |
| JP | 2-21391 | 1/1990 | |
| JP | 2-8343 | 2/1990 | |
| JP | 3-6794 | 1/1991 | |
| JP | 3-70096 | 3/1991 | |
| JP | 3-29710 | 4/1991 | |
| JP | 4-058391 | 2/1992 | |
| JP | 4-123287 | 4/1992 | |
| JP | 4-275696 | * 10/1992 | ..... 209/534 |
| JP | 5-83960 | 11/1993 | |
| JP | 4-18060 | 4/1994 | |

* cited by examiner

MANIPULATING FLOW OF BILL RECYCLE UNIT IN THE RECEIVING TRANSACTION

PAPER SHEET MANIPULATING APPARATUS AND PAPER SHEET TRANSACTION APPARATUS

This application is a division of prior application Ser. No. 08/513,879 filed Sep. 19, 1995, U.S. Pat. No. 6,015,147, which is a national stage application under §371 of international application PCT/JP95/00799 filed Apr. 24, 1995.

FIELD OF THE INVENTION

The present invention relates to a paper sheet manipulating apparatus which is operated by an operator such as a customer to dispense and deposit paper sheets depending on operations.

BACKGROUND OF THE INVENTION

In these years, a transaction apparatus such as an automatic transaction apparatus is widely spreading. This automatic transation apparatus is installed in the premises of financial institutions such as a bank for automatic deposits and dispensation of cash depending on the operations controlled by customers.

A paper sheet manipulating apparatus of the related arts realizes a transaction by executing deposits and dispensation of paper sheets under the operations controlled by an operator such as a customer.

This paper sheet manipulating apparatus realizes various transactions in the financial institutions such as receiving a transaction, expensing a transaction and a payment/transfer transaction, etc. by depositing and dispensing paper moneys (bills).

In the case of an expensing transaction, the bills accommodated an the apparatus are transferred, depending on the operator's instruction, to in inlet/outlet port using a roller and a belt for dispensation to a customer.

In the case of an receiving transaction, bills placed in the inlet/outlet port are taken into the apparatus for accommodating bills depending on the instruction which an operator has inputted.

Such an automatic transaction apparatus (bill manipulating apparatus or cash dispensing apparatus) is described in the official gazette of the Japanese patent laid-open No. 62-216098, which was filed for application on Mar. 18, 1986 by the applicant of the present invention and thereafter laid open on Sep. 22, 1987.

Such a bill manipulating apparatus comprises an inlet/outlet port for inputting and outputting bills, a discriminating section for discriminating between a true bill and a false bill and also discriminating denominations, a front and rear surface ordering section for ordering the front and rear surfaces of bills, an accommodating cabinet for accommodating bills, a temporary pooling section for temporarily storing bills, a teller's safe for collecting bills in the accommodation cabinet and charging bills thereto and a reject section for collecting at least the bills among those charged from the teller's safe and are not recognized as the true bills by the discriminating section.

Dispensation of bills is carried out as explained below. First, the bills are fed sheet by sheet by a feeding mechanism from the accommodation cabinet in which necessary denominations are accommodated. These bills are then transferred to the discrimination section for confirming denominations through a route provided with a transfer roller or a transfer belt not illustrated and thereafter are accommodated in the temporary pooling section. This operation is repeated until the bills of the amount designated by a customer are fed from the accommodation cabinet and are then accommodated in the temporary pooling section. When the bills of the predetermined amount designated to be outputted are accommodated in the temporary pooling section, such bills are transferred to the inlet/outlet port one at a time.

Thereafter, a shutter closing the inlet/output port is opened, resulting in the condition that a customer can get the bills. When a customer gets the bills outputted to the inlet/outlet port after the shutter opens, the dispensation transaction is completed.

At the time of a deposit transaction, a customer selects the deposit transaction with the operations not illustrated. Thereafter, when justification of a card inserted by a customer is verified, a deposit of bills is permitted.

In this case, it is also possible that a customer is urged to input a code-number for verifying justification of the customer.

In the case of a deposit transaction, the shutter is first opened resulting in the condition that a customer is capable of inputting bills into the inlet/output port. When the customer inputs the bills to the inlet/outlet port and depresses a button (not illustrated) for indicating that bills are inputted, the shutter closes. Thereafter, the bills placed in the inlet/outlet port are fed sheet by sheet with a feeding roller (not illustrated) and are then transferred to the discriminating section through the route having the transfer roller or transfer belt (not illustrated). The discriminating section discriminates true or false bills, denominations and conditions of bills such as front side or rear side thereof. On the basis of the result of discrimination, the front and rear surface ordering section orders the bills transferred so that the bills transferred are set only in one surface. The bills ordered in one surface are then further transferred and are stored in the temporary pooling section.

This temporary pooling section is provided because the bills inputted and discriminated are sometimes returned to a customer as will be explained later.

Therefore, if the discriminated bills are accommodated in the accommodation cabinet, these bills are mixed with the other bills in the accommodation cabinet. Therefore the discriminated bills must be set in such a condition as may be returned, when required, to the inlet/outlet port before these bills are accommodated in the accommodation cabinet.

However, when the discriminated bills are returned in direct to the inlet/outlet port, if the bills which are not yet fed and discriminated exist, the discriminated bills are mixed with undiscriminated bills, disabling normal manipulation.

Considering such conditions, the temporary pooling section is provided to sequentially store the discriminated bills and to feed the bills to the inlet/outlet port therefrom at the time of returning operation.

Moreover, the temporary pooling section has two bill storing areas to store separately the false bills from the true bills from the time that the false bills are discriminated from the true bills.

When all bills in the inlet/outlet port are completely discriminated, the bills not discriminated as the true bills are transferred to the inlet/outlet port, the shutter is opened and a guidance for instructing getting of bills in the inlet/outlet port is displayed on a display (not illustrated). When the bills are taken over from the inlet/outlet port depending on the guidance and are not inputted again within the predetermined period, the shutter is closed and transaction may be continued only with the bills discriminated as the true bills remaining in the temporary pooling section.

Moreover, when the bills in the inlet/outlet port are once taken over and these are inputted again within the predetermined period, these bills are discriminated again. It is because when bills are not discriminated as the true bills since the bills are not compared with the reference pattern used for discrimination in the discriminating section due to the operating condition of apparatus or conditions of bills, for example, bills are transferred obliquely or since bills are not in such a level as may be discriminated as the true bills due to breaks thereof, the bills may sometimes be discriminated as the true bills by discriminating these bills again. As a result of re-discrimination, if bills are not discriminated as the true bills, these bills are transferred again to the inlet/outlet port and the guidance for instructing a customer to take out the bills in the inlet/outlet port is displayed again. If the bills are not taken over even after this operation is repeated for the predetermined number of times, the transaction itself is interrupted, all bills inputted are transferred to the inlet/outlet port for completing the transaction.

When bills are discriminated as the true bills as a result of rediscrimination, these are accommodated together with the bills which are discriminated previously as the true bills and accommodated in the temporary pooling section.

When bills are completely accommodated in the temporary pooling section, the amount of bills inputted is displayed on the display (not illustrated), urging the customer to recognize the amount of bills displayed. When the customer verifies the amount of bills, the customer notifies it by depressing a button (not illustrated).

Moreover, when a button (not illustrated) is depressed to notify the intermission of the transaction because the displayed amount is different from the actually inputted amount of bills or the actually inputted bills do not reach the amount of bills to be deposited, the bills in the temporary pooling section are transferred to the inlet/outlet port, the shutter is opened urging a customer to take over the bills, thereby completing the transaction.

When it is notified that the customer has recognized the amount of bills, the bills in the temporary pooling section are at once transferred to the inlet/outlet port and the bills are fed sheet by sheet from the inlet/outlet port and are then transferred again to the discriminating section. The discriminating section discriminates the denominations. On the basis of the discrimination result by the discrimination section, the bills of the denominations corresponding to each accommodation cabinet are stored, completing the operations.

This apparatus has a removable teller's safe which is used for charging or collecting bills.

That is, when dispensation such as expensing transaction is executed continuously and amount of bills in the accommodation cabinet is reduced exceeding the predetermined amount, the bills are fed from the teller's safe in which bills are accommodated previously and then transferred to the discriminating section through the transfer route having the transfer roller or transfer belt (not illustrated). The discriminating section discriminates denominations. On the basis of the result of discrimination by the discriminating section, bills can be charged by accommodating the bills in each accommodation cabinet. This charging operation is carried out until the amount of bills in each accommodation cabinet has reached the predetermined amount and when the amount of bills reaches the predetermined amount, the charging operation is suspended. A bill which is a true bill but is damaged in such a degree as cannot be used actually is found in the discriminating section during the charging operation and a bill which cannot be discriminated as true bill due to two sheets of bill are transferred are accommodated in the reject section of the teller's safe.

In addition, when a deposit is continued until the accommodation cabinet is filled with bills, the bills in the accommodation cabinet are fed by the feeding mechanism and are then transferred into the teller's safe through the discriminating section. This collecting operation is executed until the bills in each accommodation cabinet reach the predetermined amount.

Moreover, the bills must be accommodated in the accommodation cabinet in order to start the operations of the apparatus. In this case, a person in charge of a bank issues an instruction for initialization of the apparatus from an operating panel (not illustrated) and also loads the teller's safe in which bills are accommodated. Thereby, the bills are fed from the teller's safe and are then accommodated in each teller's safe through the transfer route and the discriminating section. Therefore, when the predeterminaed amount of bills are accommodated in each accommodation cabinet, the initializing operation is terminated, making ready the apparatus for transaction.

When operation of the apparatus stops and the bills in each accommodation cabinet must be collected, a person in charge issues an instruction for collection of bills from the operation panel (not illustrated). Thereby, the bills accommodated in each accommodation cabinet are collected into the teller's safe through the feeding mechanism, transfer route and discriminating section. In this case, as the teller's safe, a vacant safe is preferably loaded. When the bills in each accommodation cabinet are collected, the collecting operation is terminated. Upon termination of collecting operation, a person in charge removes the teller's safe and carries it back to the premises of bank. The bills in the apparatus can be inspected by counting the amount of bills within the teller's safe.

In such apparatus of the related art, the temporary pooling section is provided as the preceding stage of the inlet/outlet port. When bills are deposited, the bills fed from the inlet/outlet port are discriminated and then accommodated in the temporary pooling section. After the bills are transferred again to the inlet/outlet port, the bills are accommodated in each accommodation cabinet.

Moreover, at the time of expensing transaction, the bills are fed from each accommodation cabinet and are then accommodated in the temporary pooling section. Thereafter, the bills are transferred to the inlet/outlet port and then dispensed to a customer.

The temporary pooling section is provided, as explained above, to solve the problems at the time of inputting the bills, but this section also stores temporarily the bills fed from the accommodataion cabinet at the time of outputting the bills. It is because the transfer route for transferring the bills in the accommodation cabinet to the inlet/outlet port at the time of outputting the bills and the transfer route for returning the bills inputted to the inlet/outlet port are used in common in view of preventing complication and enlargement of the transfer route.

Therefore, at the time of both deposit and dispensation of bills, the bills are once stored in the temporary pooling section and are then tansferred to the inlet/outlet port. Thereby, the number of times of bill feeding is increased, often resulting in a jam or damage of bills.

At the time of transaction which requires input of bills such as the deposit transaction, the bills which are once discriminated are stored in the temporary pooling section and the bills are fed sheet by sheet, when a customer has recognized the transaction, after the bills are transferred again to the inlet/outlet port and are accommodated in each accommodation cabinet, consuming a longer transaction time.

If a fault occurs in the accommodation cabinet accommodating bills or in a feeding mechanism for feeding the bills from the accommodation cabinet, the deposit and dispensation transactions are disabled when a fault occurs and maintenance must be done by suspending the operations of apparatus.

When it is requested to provide two teller's safes to increase the amount of bills in the apparatus in view of preventing as much as possible the stoppage of operation because all bills accommodated in the apparatus are dispensed, if the apparatus is maintained imperfectly, it becomes a cause of fault since a locking of the forward teller's safe can be confirmed easily but the backward (or rear) teller's safe cannot be confirmed visually.

Moreover, it is also considered to provide the temporary pooling section in the accommodation cabinet for accommodating the bills in order to realize high speed processing for the deposit transaction, but it is impossible to manipulate the bills of the denominations other than that corresponding to the accommodation cabinet only by providing the temporary pooling section.

In case the teller's safe accommodating the bills is loaded, the bills accommodated within the teller's safe is unclear and therefore the bills in the teller's safe must be confirmed.

In this case, it is also possible that the bills in the teller's safe are disciminated using the discriminating section in the apparatus and the bills in the teller's safe are confirmed on the basis of the discrimination result. However, if a bill which cannot be discriminated as the true bill as the result of discrimination is found, this bill is accommodated in the reject section in the teller's safe.

Since the apparatus is not provided with the accommodating section for accommodating the bills not discriminated, the bills not discriminated among those fed from the accommodation cabinet are also accommodated inevitably in the reject section within the teller's safe.

That is, both bills in the apparatus and teller's safe are accommodated in the reject section of the teller's safe and these bills cannot be distinguished clearly. Therefore, the bills loaded in the teller's safe cannot be confirmed.

Moreover, if a bill which is not discriminated as the true bill is rejected as the bill not used again, inspite a bill not discriminated as the true bill may probably be discriminated as the true bill through rediscrimination by discriminating the bills fed from the teller's safe or accommodation cabinet in the discriminating section, the application efficiency of bills is bad.

It is therefore an object of the present invention to solve the various problems explained above and to provide an apparatus which generates fewer faults and realizes a long-term operation without any pause, if a fault is generated, and also a high speed operation.

DISCLOSURE OF THE INVENTION

The present invention will then be explained with reference to FIG. 1. In FIG. 1, the reference numeral 1 denotes an accommodation section; 2, an inlet/outlet port from which paper sheets are inputted or outputted; 3, a sending means for sending paper sheets inputted to the inlet/outlet port; 4, a discriminating section for discriminating paper sheets; 5, a transfer route for transferring paper sheets between respective sections; 6, a separating means separating the inlet/outlet port at least into two sections; 7, a moving means for shifting the inlet/outlet port to the positions where the paper sheets can be inputted or the paper sheets can be taken out from the inlet/outlet port 2; 8, a temporary storing section for storing temporarily the paper sheets depending on the result of discrimination; 9, a collecting section for temporarily accommodating paper sheets to be accommodated into the accommodation section 1; 10, a feeding means for feeding paper sheets from the accommodation section 1; 11, a returning transfer route for transferring paper sheets to the inlet/outlet port 2; 12, a front cassette; 13, a rear cassette which may be loaded or unloaded freely to accommodate the paper sheets; 14, a running reject section for accommdating paper sheets which should not be accommodated into the accommodation section or the cassette; 15, a cassette reject section for accommodating the paper sheets among those fed from the cassette which should not be accommodated in the accommodation section or to the cassette; 16, a takeup means for taking up paper sheets into the accommodation section; 17, a control section for controlling respective sections.

Operations of the apparatus disclosed in the present invention having the structure explained above will then be explained sequentially hereunder.

The present invention comprises an accommodation section for accommodating paper sheets, an inlet/outlet port to which paper sheets are inputted, a sending means for sending paper sheets inputted to the inlet/outlet port, a transfer route for transferring paper sheets to the accommodation section and a separating means for separating the inside of the inlet/outlet port at least into two spaces to accommodate the paper sheets which should be be accommodated in the accommodation section to the accommodation section and the paper sheets which should not be accommodated in the accommodation section to the space where there is no paper sheets inputted among the spaces of the inlet/outlet port separated by the separating means.

That is, even in case the paper sheets are still left untransmitted in the inlet/outlet port, since the paper sheets are transferred to the space where there is not paper sheets untransmitted among the spaces of the inlet/outlet port separated by the separating means, the paper sheets transferred to the inlet/outlet port will never be mixed with the paper sheets being left untransmitted.

Therefore, since the paper sheets may be transferred to the inlet/outlet port only with the single transfer operation without temporarily pooling the paper sheets which should not be accommodated in the accommodation section among those inputted to the inlet/outlet port, only the single transfer operation is required without resulting in a fault such as mistransfer, break of paper sheets and jamming of transfer route and the manipulating time can be reduced as much as reduction of the feeding operations.

Moreover, the present invention has provided the separating means which may be shifted to the projected and unprojected positions within the inlet/outlet port.

Therehby, when paper sheets are inputted to the inlet/outlet port, the separating means is located at the unprotected positon. At the time of sending the paper sheets inputted to the inlet/outlet port with the sending means, the separating means is located at the position being projected in the inlet/outlet port. Therefore, the paper sheets which should be accommodated into the accommodation section can be accommodated into the accommodation section, while the paper sheets which should not be accommodated in the accommodation section can be transferred to the space where there is no paper sheets inputted among the spaces of the inlet/outlet port separated by the separating means.

Accordingly, since the paper sheets which should not be accommodated in the accommodation section among those inputted to the inlet/outlet port can be transferred to the inlet/outlet port only with the single transfer operation, only the single sending operation is required without any fault such as missending, break of paper sheets and jamming of the transfer route and the manipulating time can be reduced as much as reduction of the feeding operations.

Moreover, when the paper sheets are inputted to the inlet/outlet port, since the separating means is located at the position unprojected in the inlet/outlet portc, it will never interfere the input of paper sheets into the inlet/outlet port. In addition, when the paper sheets in the inlet/outlet port are transferred by the sending means, since the separating means is located at the projected position in the inlet/outlet port, the paper sheets transferred by the sending means are transferred again to the inlet/outlet port without mixture with the paper sheets left untranferred in the inlet/outlet port.

Furthermore, the present invention comprises an accommodation section for accommodating the paper sheets, an inlet/outlet port to which the paper sheets are inputted, a sending means for sending the paper sheets inputted to the inlet/outlet port, a transfer route for transferring the paper sheets to the accommodation section, a separating means which separates the inside of the inlet/outlet port at least into two spaces and can be shifted to the projected and unprojected positions within the inlet/outlet port and a separating means moving means for shifting the separating means in such a direction as pushing the paper sheets toward the sending means when the paper sheets are sent by the sending means.

Namely, when the paper sheets are inputted to the inlet/outlet port, the separating means is located at the unprojected position. When the paper sheets inputted to the inlet/outlet port is to be sent by the sending means, the separating means is located in the projected position in the inlet/outlet port. In addition, when the paper sheets inputted to the inlet/outlet port is sent, the separating means is shifted by the separating means moving means in such a direction as pushing the sending means. Thereby, the paper sheets inputted to the inlet/outlet port are pushed toward the sending means by the separating means and are then sent by the sending means. Thereby, the paper sheets which should be accommodated in the accommodation section can be accommodated in the accommodation section, while the paper sheets which should not be accommodated in the accommodation section can be transferred to the space where there is no paper sheets inputted to the inlet/outlet port.

Thereby, since the paper sheets which should not be accommodated in the accommodation section among those inputted to the inlet/outlet port can be transferred to the input/outlet port only with the single transfer operation, only the single sending operation is required without resulting in a fault such as mistransfer, break of paper sheets and jamming of the transfer route and the manipulating time can be reduced as much as reduction of the feeding operations.

Furthermore, when the paper sheets are inputted to the inlet/outlet port, since the separating means is located at the position unprojected in the inlet/outlet portc, it will never interfere the input of paper sheets into the inlet/outlet port. In addition, when the paper sheets in the inlet/outlet port are transferred by the sending means, since the separating means is located at the projected position in the inlet/outlet port, the paper sheets transferred by the sending means are transferred again to the inlet/outlet port without mixture with the paper sheets inputted to the inlet/outlet port.

Meanwhile, the separating means is shifted by the separating means moving means in the direction to push the sending means for reliably sending the paper sheets with the sending means and also works to separate the inside of the inlet/outlet port and push the sending means. Therefore, the separating means can be formed simplified in low cost.

The present invention further comprises an accommodation section for accommodating the paper sheets, an inlet/outlet port to which the paper sheets are inputted, a sending means for feeding the paper sheets inputted to the inlet/outlet port, a transfer route for transferring the paper sheets to the accommodation section, a separating means for separating the inside of the inlet/outlet port at least into two spaces and a moving means for shifting the inlet/outlet port to the positions where the paper sheets can be inputted externally and the paper sheets inputted are in contact with the sending means.

The paper sheets which should not be accommodated in the accommodation section are transferred through the transfer route to the space separated by the separating means where there is no paper sheets inputted.

Accordingly, since the paper sheets which should not be accommodated in the accommodation section among those inputtted to the inlet/outlet port can be tarnsferred to the input/outlet port only with the single sending operation, only the single sending operation is required without any fault such as mistransfer, break of paper sheets and jamming of the transfer route and the manipulating time can be reduced as much as reduction of the feeding operations.

Since the inlet/outlet port may be shifted, by the moving means, to the position where the paper sheets can be inputted and the position where the paper sheet can be transferred, the paper sheets may be inputted easily to the inlet/outlet port and the paper sheet may also be reliably transferred from the inlet/outlet port.

Meanwhile, the present invention comprises an accommodation section for accommodating the peper sheets, an inlet/outlet section to which the paper sheets are inputted, a sensing means for feeding the paper sheets inputted to the inlet/outlet port, a discriminating section for discriminating the paper sheets, a transfer route for transferring the paper sheets, a separating means for separating the inside of the inlet/outlet port to at least two spaces, a change-over means for changing the route for the paper sheets to the returning transfer route from the transfer route and a temporary storing section for temporarily storing the paper sheets changed over by the change-over means.

That is, the paper sheets inputted to the inlet/outlet port are transmitted by the sending means and discriminated by the discriminating section. On the basis of the result of discrimination by the disciminating section, the paper sheets are transferred to the accommodation section or to the space in the inlet/outlet port separated by the separating means where there is no paper sheets. Further, the paper sheets transferred in the direction toward the inlet/outlet port are changed over, depending on the result of discrimination by the discriminating section, by the change-over means from the transfer route for transferring the paper sheets to the inlet/outlet port and are then stored in the temporary storing section.

Thereby, since the paper sheets which should not be accommodated in the accommodation section among those inputted to the inlet/outlet port can be transferred with only the single transfer operation, only the single transfer operation is required without resulting in a fault such as mistransfer, break of paper sheets and jamming of the transfer route and the manipulating time can be reduced as much as reduction of the feeding operations.

Moreover, since the transfer route can be changed over by the change-voer means while the paper sheets are being transferred to the inlet/outlet port, the paper sheets to be accommodated in the accommodation section and the paper sheets to be returned to the inlet/outlet port can be accommodated separately and more kinds of discrimination results can be covered.

Further, the present invention comprises an accommodation section for accommodating the paper sheets, a feeding means for feeding the paper sheets in the accommodation section, a discriminating section for discriminating the paper sheets, a transfer route for transferring the paper sheets, an inlet/outlet port for storing the paper sheets which are fed by the feeding means from the accommodation section and are transfered by the transfer route and a moving means for shifting the inlet/outlet port between the position where the paper sheets tranferred by the transfer route are stored and the position where the paper sheets in the inlet/outlet port can be taken over from the external side.

Namely, the paper sheets fed from the accommodation section by the feeding means are transferred to the transfer route and are then discriminated in the discriminating section. As a result of discrimination, those which may be transferred to the inlet/outlet port by the transfer route and are then stored therein. When the paper sheets transferred from the accommodation section are to be stored in the inlet/outlet port, this inlet/outlet port is located at the position where the input of paper sheets is possible. When input of the paper sheets is completed, the inlet/outlet port is shifted by the moving means and is then located to the position where the paper sheets in the inlet/outlet port can be taken out from the outside.

Thereby, the paper sheets fed from the accommodation section can then be fed smoothly to the inlet/outlet port.

In addition, since the paper sheets fed from the accommodation section can be inputted in direct to the inlet/outlet port, only the single feeding operation is required almost without any fault such as mistransfer, break of the paper sheets and jamming of the transfer route and the manipulating time can be reducedas much as reduction of the feeding operations.

Meanwhile, the present invention comprises an inlet/outlet port to which the paper sheets are inputted, a sending means for sending the paper sheets inputted to the inlet/outlet port, a discriminating means for discriminating the paper sheets, a transfer route for transferring the paper sheets to the accommodation section depending on the result of discrimination and a temporary storing section for temporarily storing the paper sheets discriminated as those which should not be accommodated in the accommodation section to temporarily store the paper sheets discriminated as those which should not be accommodated in the accommodation section as a result of discrimination among the peper sheets inputted to the inlet/outlet port.

Therefore, the paper sheets inputted to the inlet/outlet port which should be accepted but not accommodated in the accommodation section can be accommodated in separation from those in the accommodation section and can also be managed easily.

Moreover, if the paper sheets to be accommodated in the temporary storing section have the surface inverted from that of the paper sheets to be accommodated in the accommodation section or are different in the kinds from the paper sheets accommodated in the accommodation section, only one temporary storing section can accommodate several kinds of paper sheets which cannot be accommodated in the accommodation section, thereby simplifying the structure and also realizing cost-down.

Since the temporary storing section can accept several kinds of paper sheets which cannot be accommodated in the accommodation section, the paper sheets inputted to the inlet/outlet port can be accepted as much as possible, reducing the number of paper sheets to be rejected and moreover accelerating the transaction speed to improve operation efficiency of the apparatus.

Meanwhile, the present invention is formed to set a kind of the paper sheets to be accommodated in the temporary storing section and comprises a control section which controls to store the paper sheets in the teporary storing section based on the above setting and the result of discrimination in the discriminating section in view of freely setting a kind of the paper sheets stored in the temporary storing section.

Therefore, the temporary storing section may be used for inversion of the front and rear surfaces of the paper sheets or for storing the paper sheets in such a kind as different from that of the paper sheets to be accommodated in the accommodation section or for storing again the paper sheets which are not used for dispensation.

Meanwhile, the present invention comprises an accommodation section for accommodating the paper sheets, an inlet/outlet port to which the paper sheets are inputted, a sending means for feeding the paper sheets inputted to the inlet/outlet port, a discriminating sectionfor discriminating the front and rear surfaces of the paper sheets, a transfer route for transferring the paper sheets to the accommodation section on the bais of the result of discrimination and a temporary storing section which is formed to store the paper sheets in different surface directions to be accommodated in the accommodation section as a result of discrimination and to feed such paper sheets stpred therein in the same surface direction as the paper sheets accommodated in the accommodation section at the time of feeding. Thereby, when the paper sheets in the surface direction inverted from those to be accommodated in the accommodation section are found as a result of discrimination by the discriminating section for the paper sheets inputted to the inlet/outlet port, such paper sheets are accommodated in the temporary storing section and the surface direction is equalized to the paper sheets to be accommodated in the accommodation section. Thereafter, the paper sheets are accommodated in the accommodation section and thereby the paper sheets inputted to the inlet/outlet port can be stored in the accommodation section after the surfaces of the paper sheets are ordered only in one surface direction.

Meanwhile, the present invention comprises a plurality of accommodation sections for accommodating a plurality kinds of the paper sheets in every kind, an inlte/outlet port for inputting the paper sheets, a sending means for feeding the paper sheets inputted to the inlet/outlet port, a discriminating means for discrimin the paper sheets including discrimination for a kind thereof, a transfer route for transferring the peper sheets to the accommodation section depending on the result of discrimination and a temporary storing section for storing and feeding the paper sheets which have been discriminated as those of a kind to be accommodated in the accommodation section. Thereby, the accommodation sections are provided corresponding to each kind of the paper sheets, the paper sheets other than those of the kinds corresponding to the accommodation sections are stored in the temporary storing section to manipulate the paper sheets other thant that of the kinds to be accommodated in the accommodation sections. Moreover, when the kinds of paper sheets to be manipulated increase, such problem can be solved only by changing the discrimination capability of the discriminating section, realizing the easier modification at a low cost.

Meanwhile, the present invention comprises a plurality of accommodation sections for accommodating a plurality kinds of the paper sheets in every kind, an inlte/outlet port for inputting the paper sheets, a sending means for feeding the paper sheets inputted to the inlet/outlet port, a discriminating means for discrimin the paper sheets including discrimination for a kind thereof, a transfer route for transferring the peper sheets to the accommodation section depending on the result of discrimination, a temporary storing section which is formed to accommodate the paper sheets and feed these paper sheets in the same surface direction as those accommodated in the accommodation section at the time of feeding and a control section for controlling to accommodate the paper sheets to be accommodated in the accommodation section as a result of discrimination, accommodate, in the temporary storing section, the paper sheets of the kind not to be accommodated in the accommodation section and the paper sheets of the surface direction different from that of the paper sheets accommodated in the accommodation section and to feed the paper sheets accommodated in the accommodation section and also transfer, to the accommodation section, the paper sheets of the same kinds of those accommodated in the accommodation section among the paper sheets transferred. Thereby, since the accommodation sections are provided corresponding to each kind of paper sheets and the paper sheets of the kinds other than that corresponding to the accommodation sections and the paper sheets of the surface direction different from that of those to be accommodated in the accommodation section are stored in the temporary storing section, the paper sheets of the kinds other than that to be accommodated in the accommodation section can also be manipulated and moreover the surface direction of the paper sheets to be accommodated in the accommodation section can be ordered in the same direction. In addition, if the kinds of the paper sheets to be manipulated increase, such problem can be solved only by modifying the discrimination capability of the discriminating section, resulting in easier modification at a low cost.

Meanwhile, the present invention comprises a running reject section for storing the paper sheets which should not be accommodated in the accommodation section and a control section for controlling to accommodate, to the accommodation section, the paper sheets which are found, as a result of discrimination, as those to be accommodated in the accommodation section and accommodate the paper sheets of the kinds which should not be accommodated in the accommodation section and the paper sheets of the surface direction different from that of the paper sheets to be accommodated in the accommodation section in the temporary storing section, to feed the paper sheets accommodated in the temporary storing section, to transfer the paper sheets of the same kinds as those accommodated in the accommodation section among the paper sheets fed and to accommodate the paper sheets of the kinds which should not be accommodated in the accommodation section among those fed from the temporary storing section to the running reject section, whereby the accommodation sections are provided corresponding to respective kinds of the paper sheets to store, in the temporary storing section, the paper sheets of the kins other than that corresponding to these accommodation sections and the paper sheets of the surface directions different from that of the paper sheets to be accommodated in the accommodation sections. Therefore, the paper sheets of the kinds other than that to be accommodated in the accommodation section can also be manipulated and the surface direction accommodated in the accommodation sections can be ordered to the uniform direction. Moreover, since the paper sheets which should not be accommodated in the accommodation section can be stored separately from those accommodated in the accommodation section by storing such paper sheets in the running reject section, management of the paper sheets can be realized easily. In addition, if the paper sheets which should be manipulated increase in kinds, it can be covered only by modifying the discrimination capability of the discriminating section, resulting in easy modification at a low cost.

Meanwhile, the present invention comprises a plurality of accommodation sections for accommodating a plurality kinds of paper sheets in every kind, an inlet/outlet port to which the paper sheets are inputted, a sending means for sending the paper sheets inputted to the inlet/outlet port, a discriminating section for discriminating the paper sheets, a transfer route for transferring the paper sheets to the accommodation section depending on the result of discrimination, a temporary storing section which is formed to accommodate the paper sheets and feed the paper sheets stored in the same surface direction as those accommodated in the accommodation section, a cassette which is formed to be removably loaded to accommodate the paper sheets and a control section for controlling to accommodate, in the accommodation section, the paper sheets which are found as those to be accommodated in the accommodation section as a result of discrimination, to accommodate the paper sheets which cannot be accommodated in the accommodation section into the temporary storing section, to feed the paper sheets accommodated in the temporary storing section and to accommodate, in the cassette, the paper sheets to be accommodated in the accommodation section among those fed above, whereby since a plurality of accommodation sections are provided corresponding to the kinds of the paper sheets to store, in the temporary storing section, the paper sheets of the kinds other than that corresponding to the accommodation sections and the paper sheets of the surface directions different from that of the paper sheets accommodated in the accommodation section, the paper sheets of the kinds other than those to be accommodated in the accommodation section can also be manipulated and moreover the paper sheets can be ordered in the accommodation section in the uniform surface direction. Moreover, since the manipulation can be continued without suspending operations of the apparatus by accommodating the paper sheets in the cassette even when these cannot be accommodated in the accommodation section because it is already full of the paper sheets, the operating efficiency of the apparatus can be improved greatly. In addition, if the paper sheets to be manipulated increases in kinds, it can be covered only with modification of the discrimination capability of the discriminating section, resulting in easy modification at a low cost.

Meanwhile, the present invention comprises a running reject section for storing the paper sheets which should not be accommodated in the accommodation section and a control section for controlling to accommodate, to the accommodation section, the paper sheets which are found, as a result of discrimination, as those to be accommodated in the accommodation section and accommodate the paper sheets which cannot be accommodated in the accommodation section in the temporary storing section, to feed the paper sheets accommodated in the temporary storing section, to accommodate the paper sheets to be accommodated in the accommodation section among those fed above into the cassette and accommodate the paper sheets of the kinds which should not be accommodated in the accommodation section among those fed from the temporary storing section to the running reject section, whereby the accommodation sections are provided corresponding to respective kinds of the paper sheets to store, in the temporary storing section, the paper sheets of the kinds other than that corresponding to the accommodation sections and the paper sheets in the surface direction different from that eof the paper sheets to be accommodated in the accommodation section. Thereby the paper sheets of the kinds other than that of the paper sheets to be accommodated in the accommodation section can be manipulated and and the paper sheets accommodated in the accommodation section can be ordered only in one surface direction. Moreover, since the paper sheets which should not be accommodated in the accommodation section can be stored separately from those accommodated in the accommodation section by storing such paper sheets in the running reject section, management of the paper sheets can be realized easily. Moreover, if the paper sheets cannot be accommodated in the accommodation section because it is already full of paper sheets, since the manipulation can be continued without suspending the operation of apparatus by accommodating the peper sheets in the cassette, the operation efficiency of the apparatus can be improved greatly. In addition, if the paper sheets which should be manipulated increase in kinds, it can be covered only by modifying the discrimination capability of the discriminating section, resulting in easy modification at a low cost.

The present invention comprises an accommodation section for accommodating the paper sheets, an inlet/outlet port to which the paper sheets are inputted, a sending means for feeding the paper sheets inputted to the inlet/outlet port, a transfer route for transferring the paper sheets fed from the inlet/outlet port to the accommodation section, a cassette which is formed to be removably loaded to take at least the paper sheets in the transferring route, a temporary storing section for temporarily storing the paper sheets and a control section for controlling to once store, if the paper sheets cannot be accommodated in the accommodation section, the paper sheets inputted to the inlet/outlet port in the temporary storing section and thereafter transfer the paper sheets in the temporary storing section to the cassette through the transfer route, whereby the paper sheets which are left inaccommodated in the accommodation section can in turn be accommodated in the temporary pooling section on the occasion of accommodating the bills inputted to the inlet/outlet port into the accommodation section.

Thereby, the manipulation for receiving the paper sheets can be executed without intermission, simplifying the manipulation for inputting the paper sheets and moreover many number of paper sheets can be inputted at a time. Moreover, if the accommodation section becomes full in the source of receiving the paper sheets inputted to the inlet/outlet port, the paper sheets may be accetpted continuously without suspending operations of the apparatus, thus improving the operation efficiency of the apparatus.

In addition, the present invention comprises a takeup means for taking up the paper sheets to the accommodation section and a control section for controlling to inhibit the takeup operation of the takeup means if the bills cannot be accommodated into the accommodation section, whereby if the paper sheets can no longer be taken up to the accommodation section, operations of the takeup means can be inhibitted, preventing further deterioration of a fault when the fault such as jamming of the takeup means is generated.

Meanwhile, the present invention comprises an accommodation section for accommodating the paper sheets, an inlet/outlet port to which the paper sheets are inputted, a sending means for feeding the paper sheets inputted to the inlet/outlet port, a transfer route for for transferring the paper sheets fed from the inlet/outlet port, a cassette which is formed to be removably loaded to take up at least the paper sheets on the transfer route, a collecting section provided in the accommodation section for temporarily accommodating the paper sheets which are inputted to the inlet/outlet port and are transferred to the transfer route, a temporary storing section for storing the paper sheets which can no longer be accommodated in the collecting section and a control section for controlling to once store, to the temporary storing section, the paper sheets which cannot be accommodated in the collecting section among those inputted to the inlet/outlet port and thereafter transfer the paper sheets in the temporary storing section to the cassette through the transfer route, whereby the paper sheets which can no longer be accommodated in the collecting section of the accommodation section can be accommodated in the temporary storing section. Therefore, in the case of suspending input of the paper sheets, the paper sheets inputted to the inlet/outlet port can directly be return ed by returning the paper sheets stored in the collecting section and the temporary storing section to the inlet/outlet port and moreover in the case of accepting a large number of paper sheets at a time, the paper sheets can be inputted to the inlet/outlet port at a time without dividing the single accepting operation of the paper sheets, thus improving the input operationability to the inlet/outlet port of the apparatus.

In addition, when it is requested to increase the number of bills to be inputted to the inlet/outlet port, only modification of the inlet/outlet port is required without modification of the collecting section and therefore specifications of the apparatus can easily be modified.

Meanwhile, the present invention comprises an accommodation section for accommodating the paper sheets, a feeding means for feeding the paper sheets in the accommodation section, a transfer route for transferring the paper sheets fed from the feeding means, an inlet/outlet port for receiving the paper sheets transferred from the accommodation section by way of the transferring means and for dispensing the paper sheets received, a plurality of cassettes which are formed to be removably loaded to accommodate the paper sheets and feed the accommodated paper sheets and a control section for controlling to transfer the paper sheets in the cassettes to the inlet/outlet port through the transfer route in the case where the paper sheets cannot be fed from the accommodation secdtion, whereby, if the paper sheets cannot be fed from the accommodation section, the manipulation can be completed by transferring the paper sheets from a plurality of cassettes without suspending operations of the apparatus, even in case the accommodation section fails and cannot feed the paper sheets, by feeding the paper sheets accommodated in a plurality of cassettes and then inputting these paper sheets to the inlet/outlet port. Moreover, even when the paper sheets are all fed from the accommodation section, disabling the feeding thereof from the accommodation section, the manipulation can be continued by feeding the paper sheets accommodated in the cassettes. Accordingly, the apparatus having higher reliability and resulting in less suspension of operation can be provided.

Meanwhile, the present invention comprises an accommodation section for accommodating the paper sheets, a feeding means for feeding the paper sheets of the accommodation section, a transfer route for transferring the paper sheets fed by the feeding means, an inlet/outlet port for receiving the paper sheets transferred from the accommodation section by the tranfer means and dispensing the paper sheets accommodated, a cassette which is removably loaded and formed to accommodate the paper sheets and feed these paper sheets accommodated and a control section for controlling to inhibit the feeding operation of the feeding means, if the paper sheets cannot be red from the accommodation section, and then transfer the paper sheets in the cassette to the inlet/outlet port through the transfer route, whereby if the paper sheets in the accommodation section cannot be fed, the manipulation can be completed without suspending operation of the apparatus, even in case the accommodation section fails and cannot feed the paper sheets, by feeding the paper sheets accommodated in the cassette and then inputting such paper sheets to the inlet/outlet port. Moreover, even when the paper sheets are all fed from the accommodation section, disabling the feeding thereof from the accommodation section, the manipulation can be continued by feeding the paper sheets accommodated in the cassettes. Accordingly, the apparatus having higher reliability and resulting in less suspension of operation can be provided.

In addition, if a fault such as jamming is generated in the feeding means, stop of the feeding operation will never deteriorate the fault by inhibitting the feeding operation of the feeding means. Therefore, it is possible to provide an apparatus which results in less number of times of stoppage of operations, easier measures for fault and a short-term stoppage of operation due to the simplified measures for the fault even if the apparatus fails because the the manipulation can be completed by feeding the paper sheets from the cassette, even if the paper sheets in the accommodation section cannot be fed.

Meanwhile, the present invention comprises an accommodation section for accommodating the paper sheets, a takeup means for taking up the paper sheets to the accommodation section, a feeding means for feeding the paper sheets from the accommodation section, an inlet/outlet port for receiving the paper sheets from the accommodation section, a cassette which is formed to be removably loaded to takeup at least the paper sheets and a control section for controlling to feed, when the paper sheets cannot be accommodated in the accommodation section, the paper sheets inputted to the inlet/outle port and to inhibit the operations of the takeup means and feeding means, whereby if the accommodation section can no longer feed the paper sheets, operations of the feeding means and takeup means are stopped and the paper sheets are taken up into the cassette. Therefore, if the paper sheets cannot be taken up into the accommodation section, the manipulation can be completed without stopping operations of the apparatus by accommodating the paper sheets in the inlet/outlet port to the cassette even when the accommodation section fails and cannot take up the paper sheets. Moreover, even when the accommodation section becomes full of the paper sheets and the paper sheets can no longer be taken up into the accommodation section, the manipulation can be continued by accommodating the paper sheets into the cassette. In addition, if the feeding or takeup of the paper sheets to or from the accommodation section are impossible due to a fault such as jamming of the paper sheets to the feeding means or takeup means, the fault such as jamming of paper sheets will never be deteriorated by stopping the operations of the feeding means and takeup means, it is now possible to provide an apparatus having higher reliability which results in less number of times of stoppage of operations, easier measures for the fault and a short-term stoppage of operation due to the simplified measures for the fault even if the apparatus fails.

Meanwhile, the present invention comprises an accommodation section for accommodating the paper sheets, a takeup means for taking up the paper sheets into the accommodation section, a feeding means for feeding the paper sheets from the accommodation section, an inlet/outlet port for allowing input of the paper sheets thereto and receiving the paper sheets from the accommodation section, a cassette which is formed to be removably loaded to take up and feed the paper sheets and a control section for controlling to take up the paper sheets inputted to the inlet/outlet port to the cassette or transfer the paper sheets to the inlet/outlet port by feeding these paper sheets from the cassette and inhibit the operations of the takeup means and feeding means when the paper sheets cannot be taken up or fed to or from the accommodation section, whereby if the paper sheets cannot be taken up to the accommodation section or cannot be fed from the accommodation section, operations of the feeding means and takeup means are stopped and the paper sheets are taken up to the cassette or are fed from the cassette. Accordingly, if the paper sheets cannot be taken up to the accommodation section, the manipulation may be completed without stopping the operations of the apparatus, even when the accommodation section fails and cannot take up the papersheets, by accommodating the paper sheets in the inlet/outlet port to the cassette. Moreover, if the paper sheets cannot be fed from the accommodation section, the manipulation may be completed without stopping the apparatus even when the accommodation section fails and cannot feed the paper sheets by transferring the paper sheets to the inlet/outlet port from the cassette. In addition, when the accommodation section becomes full of the paper sheets and can no longer take up the paper sheets thereto, the manipulation may be continued by accommodating the paper sheets to the cassette. Further, when the accommodation section becomes empty and cannot feed the paper sheets therefrom, the manipulation can be continued by feeding the paper sheets from the cassette. Therefore, the apparatus which results in less number of times of stoppage of operation can be provided.

Moreover, if the feeding or takeup of the paper sheets to or from the accommodation section are impossible due to a fault such as jamming of the paper sheets to the feeding means or takeup means, the fault such as jamming of paper sheets will never be deteriorated by stopping the operations of the feeding means and takeup means, it is now possible to provide an apparatus having higher reliability which results in less number of times of stoppage of operations, easier measures for the fault and a short-term stoppage of operation due to the simplified measures for the fault even if the apparatus fails.

Meanwhile, the present invention comprises an accommodation section for accommodating the paper sheets, an inlet/outlet port to which the paper sheets are inputted, a sending means for sending the bills in the inlet/outlet port, a discriminating section for discriminating the paper sheets transmitted from the sending means, a transfer route for transferring the pape sheets to be accommodated in the accommodation section depending on the discrimination result in the discriminating section, a collecting section for temporarily accommodating the paper sheets to be accommodated in the accommodation section, a takeup means for accommodating the paper sheets in the collecting section, a feeding means for feeding the paper sheets from the accommodation section, a temporary storing section for temporarily storing the paper sheets which are discriminated, as a result of discrimination in the discriminating section, as those which should be accepted but should not be stored in the accommodation section and a control section for controlling to accommodate the paper sheets in the collecting section to the accommodation section depending on establishment of transaction, whereby the paper sheets inputted to the inlet/outlet port are temporarily stored in the collecting section provided in the accommodation section and the paper sheets in the collecting section are then accommodated in the accommodation section when an operator has issued a message indicating the trasaction has been established. Thereby, until the transaction is established, the the paper sheets inputted to the inlet/outlet port can be accommodated in separation from the paper sheets already accommodated in the accommodation section and moreover the paper sheets which are discriminated as those to be accepted as a result of discrimination in the discriminating section and should not be stored in the accommodation section can also be accommodated in separation from the paper sheets in the collecting section, realizing acceptance and manipulation of a variety of kinds of the paper sheets. Moreover, if the facilities are provided so that the paper sheets accommodated in the accommodation section are dispensed for the other transactions, since dispensation can be made more quickly and accurately when the predetermined kinds of paper sheets are accommodated in the accommodation section, the predtermined kinds of paper sheets can be accommodated in the accommodation section by separating the paper sheets which should not be accommodated in the accommodation section from the paper sheets being accommodated in the accommodation section and thereby the subsequent manipulation can also be made quickly and accurately. In addition, since the paper sheets different from those which should be accommodated in the accommodation section can also be accepted by the temporary storing section, a variety of manipulations can also be executed. Furthermore, when a transaction is set up, since the manipulation required is only accommodation of the paper sheets in the collecting section into the accommodation section, the paper sheets can be accommodated quickly after the transaction is set up and since the paper sheets are not required for re-feeding, a fault such as jamming will never be generated.

The present invention also comprises a running reject section for storing the paper sheets which should be accepted but not be stored in the accommodation section. The control section accommodates the paper sheets of the collecting section into the accommodation section and also accommodates the paper sheets in the temporary storing section into the running reject section, upon setup of the transaction. When the transaction is set up, the control section accommodates the paper sheets in the temporary storing section into the running reject section in order to separate the paper sheets which should be accepted but not be stored in the accommodation section from the paper sheets which should be accommodated in the accommodation section. Accordingly, if the paper sheets having been accommodated in the accommodation section is determined to be dispensed for the other transactions, the paper sheets can be dispensed more quickly and accurately when the predetermined kinds of paper sheets are accommodated in the accommodation section. Therefore, when the paper sheets which should be accommodated in the accommodation section are accommodated in separation from those which should not be accommodated in the accommodation section, the paper sheets of the particular kinds can be accommodated in the accommodation section, realizing more quick and accurate manipulations. Moreover, since the paper sheets which should not be accommodated are accommodated in the running reject section, the paper sheets which should not be accommodated are never dispensed, ensuring more reliable manipulations.

Meanwhile, the present invention comprises an accommodation section for accommodating the paper sheets, an inlet/outlet port to which the paper sheets are inputted, a sending means for sending the bills in the inlet/outlet port, a discriminating section for discriminating the paper sheets transmitted by the sending means, a transfer route for transferring the paper sheets to be accommodated in the accommodation section, a collecting section provided in the accommodation section for temporarily storing the paper sheets to be accommodated in the accommodation section, a takeup means for accommodating the paper sheets to the collecting section, a feeding means for feeding the paper sheets from the accommodation section and a control section for controlling to feed the paper sheets in the collecting section to the inlet/outlet port with the feeding means when a transaction is not set up, whereby accommodation of the paper sheets which is once accommodated in the inlet/outlet port into the collecting section in separation from the paper sheets which are already accommodated in the accommodation section enables that the paper sheets inputted to the inlet/outlet port can be returned in direct to the inlet/outlet port by feeding the paper sheets from the collecting section when the transaction is disabled. Therefore, since the bills inputted by an operator can be returned thereto, unwanted trouble with the operator can be avoided.

Meanwhile, the present invention comprises a temporary storing section for temporarily storing the paper sheets which are discriminated by the discriminating section to be accepted but not to be accommodated in the accommodation section and the control section feeds the paper sheets in the collecting section to the inlet/outlet port with the feeding means when a transaction is disabled and also transfers the paper sheets in the temporary storing section to the inlet/outlet port. Thereby, when a transaction is not set up, since the bills inputted to the inlet/outlet port are returned immediately in direct, quickly covering the manipulations required when the transaction is disabled. In addition, since the collecting section can accommodate the paper sheets to be accommodated in the accommodation section, while the temporary storing section can accommodate the paper sheets which should not be accommodated in the accommodation section, the paper sheets which should be accommodated in the accommodation section can be accommodated in separation from those which should not be accommodated in the accommodation section and the paper sheets of the kinds different from those which should be accommodated in the accommodation section, thus realizing a variety of transactions. Furthermore, since the paper sheets which should be accommodated in the accommodation seciton can be separated from the paper sheets which should not be accommodated, if the paper sheets must be dispensed for the other transactions, the paper sheets can be fed immediately from the accommodation section in which the predetermined kinds of the paper sheets are accommodated and the paper sheets can be fed from the accommodation section in which the predetermined kinds of paper sheets are accommodated, thus never feeding errorneous paper sheets and ensuring quick and reliable transactions.

Meanwhile, the present invention comprises an accommodation section for accommodating the paper sheets, a takeup means for taking up the paper sheets into the accommodation section, a feeding means for feeding the paper sheets stored in the accommodation section and an accommodation guide located to guide downward the front end part of the paper sheet and separate the paper sheet from the feeding means in such a case that the paper sheets are taken up to the accommodation section by the takeup means, whereby the paper sheets can reliably be accommodated in the accommodation section since the end part of the paper sheet is guided downward by the accommodation guide in such a case that the paper sheets are taken up to the accommodation section. Moreover, when both feeding means and takeup means are provided opposed with each other above the paper sheets, the end part of the paper sheets is never projected into the feeding means at the time of takeup operation, never generating a fault such as jamming of the paper sheets.

Meanwhile, in the present invention, the accommodation guide is located, in the case of taking up the paper sheets to the accommodation section with the takeup means, to guide downward the front end part of the paper sheets and to separate the paper sheets from the tekeup means, or is located, in the case of feeding the paper sheets from the accommodation section with the feeding means, to allow the paper sheets to be in contact with the feeding means. Moreover, the accommodation guide moves, in the case of taking up the paper sheets into the accommodation section, to guide the paper sheets to accommodate into the accommodation section or, in the case of feeding the paper sheets from the accommodation section, to draw itself to ensure smooth feeding of the paper sheets. Thereby, there is provided an apparatus which can neatly accommodate the paper sheets and rarely generate a fault such as Jamming of the paper sheets.

The present invention is capable of stopping the takeup operation in the case of executing the feeding operation by suspending the operations of the takeup means in conjunction with the operation for positioning the accommodation guide to the position where the paper sheets may be in contact with the feeding means in the case of feeding the paper sheets from the accommodation section with the feeding means. Therefore, the takeup means never impede the feeding operation during the feeding operation by the feeding means, ensuring reliable feeding of the paper sheets.

Meanwhile, the present invention comprises an accommodation section for accommodating the paper sheets, an inlet/outlet port to which the paper sheets are inputted, a sending means for sending the bills in the inlet/outlet port, a discriminating section for discriminating the paper sheets transmitted by the sending means, a transfer route for transferring the paper sheets to be accommodated in the accommodation section, a collecting section for temporarily accommodating the paper sheets to be accommodated in the accommodation section, a takeup means for taking up the paper sheets in the collecting section, a feeding means for feeding the paper sheets from the accommodation section and a control section for contolling, when the transaction is disabled, the feeding means to feed the paper sheets in the collecting section to the inlet/outlet port with the feeding means and also controlling the takeup means to stop the takeup operation, whereby the paperr sheets to be accommodated in the accommodation section are accommodated once in the collecting section and when the transaction is disabled, operations of the takeup means is stopped to return the paper sheets in the collecting section to the inlet/outlet port with the feeding means. Thereby, if the transaction is disabled, since the bills inputted to the inlet/outlet port are immediately returned in direct, the manipulations required when the transaction is disabled can be covered quickly. In addition, since the takeup means is stopped during the feeding operation by the feeding means, the feeding operations are never impeded, the paper feeds can be fed reliably and the paper sheets inputted to the inlet/outlet port can be returned immediately.

Meanwhile, the present invention comprises a cassette accommodation section which is formed to be removably loaded to accommodate a plurality of cassettes for accommodating the paper sheets, a cassette moving means for guiding the cassette accommodation section to swivel between the position for removing a cassette and the position for loading a cassette and a lock means for locking a cassette at the cassette loading position so that the cassette can no longer be removed and also unlocking the other cassettes when the front most cassette is unlocked, whereby a cassette is swiveled by the cassette moving means and can be locked so that the cassette cannot be removed at the cassette loading position and moreover when the front most cassette is unlocked, the other cassettes can also be unlocked. Accordingly, since the cassette is moved by the cassette moving means and the cassette is loaded or unloaded after it is moved to the position enabaling the removal of the cassette, the cassette can be loaded or unloaded very easily. Moreover, unlocking of the only one cassette makes possible the removal of all cassettes, namley unlocking of all cassettes, realizing the removal of the front most cassette.

Meanwhile, the present invention comprises a cassette accommodation section which is formed to be removably loaded to accommodate a plurality of cassettes for accommodating the paper sheets, a cassette moving means for guiding the cassette accommodation section to swivel between the position for removing a cassette and the position for loading a cassette, a lock means for locking a cassette at the cassette loading position so that the cassette can no longer be removed and also locking the cassette when it is moved to the loading position and an inclining means for inclining a cassette toward the cassette loading direction, whereby a cassette is swiveled by the cassette moving means, locked at the cassette loading position and removed at the unloading position, moreover the cassette is inclined toward the loading position and is then moved to the loading position with the cassette moving means. Accordingly, since the cassette is moved by the cassette moving means, the cassette can be loaded and unloaded very easily. In addition, since the cassette is inclined, the cassete is surely locked and since the front most cassette is locked first when the front most cassette is inclined, the front most cassette can be locked reliably.

In the present invention, the inclining means is formed to rotate the cassette accommodation section and is composed of a spring for energizing the cassette in the loading direction in view of inclining the cassette and giving redundancy at the cassete loading position. That is, since the cassette is energized and inclined with the spring, the cassette can be locked surely and the cassette can also be loaded surely at the loading position because the spring is compressed therein. Moreover, when the inclining means is provided for the front most cassette, the front most cassette is locked first and the other cassettes can also be locked since the spring is compressed when the cassette moving means is pushed. Therefore, the front most cassette can be locked surely and thereafter the other cassettes can also be locked, surely realizing the lock of all cassettes.

Moreover, the present invention comprises a cassette accommodation section which is removably loaded and is formed to load a plurality of cassettes constituted to takeup the paper sheets from the collecting port to accommodate therein and can be loaded so thatthe collecting ports of respective cassettes are not closed with the cassette in the preceding stage when a plurality of cassettes are loaded, whereby the cassettes can be loaded step by step. Therefore, since each cassette can be loaded to the position so that the collecting port of the cassette is not closed by the cassette loaded in the position before such cassette, the shape shape of cassettes may be used. Accordingly, since the cassettes or the special shape are no longer required, mass-production of cassettes is possible, realizing cost-down thereof. Furthermore, since a plurality of cassettes for taking up the paper sheets can be provided, capacity for storing the paper sheets can be increased. In addition, when the cassettes are provided corresponding to the kinds of the paper sheets, these can be accommodated in the cassettes in every kinds and thereby the paper sheets can be accommodated quickly and managed very easily.

Meanwhile, the present invention is provided with a structure to allow the loading of a plurality of cassettes of the same shape and also allow step by step the loading of the cassettes of the same shape. Therefore, since the cassettes of particular shapes can be ruled out, the cassettes can be produced by the mass-production system, thus realizing cost-down. In addition, if a cassette is loaded to the different position, any problem does not occur in the operaiton since the cassettes are all formed in the same shape.

Meanwhile, the present invention comprises an accommodation section for accommodating the paper sheets, a discriminating section for discriminating the paper sheets, a cassette which is removably loaded to accommodate the paper sheets and feed at least the paper sheets accommodated therein, a cassette reject section which is porivided in the cassette to accommodate the paper sheets different from the paper sheets accommodated in the cassette and a control section for controlling to discriminate the paper sheets fed from the cassette with the discriminating section and to transfer the paper sheets to the cassette reject section when these paper sheets are discriminated as those which should not be transferred to the accommodation section, whereby when the paper sheets fed from the cassette are discriminated as those which should not be t ransf erred to the inlet/outlet port, these paper sheets are accommodated in the cassette reject section provided in the cassette.

Therefore, since the paper sheets under the condition which makes impossible the discrimination among those fed from the cassette, for example, the paper sheets stacked in two or more sheets, can be accommodated in the cassette reject section, the paper sheets fed from the cassette but is discriminated to have the kinds not designated are accommodated within the cassette with separtion from those already accommodated. Therefore the paper sheets discriminated among those fed from the cassette are managed in the kinds and the number thereof in direct. Moreover, the paper sheets which cannot be discriminated are accommodated in the cassette reject section. Accordingly, the kinds and the number of the paper sheets accommodated in the cassette reject section can also be confirmed later. Therefore, the paper sheets accommodated in the cassettes can be surely managed.

Meanwhile, the present invention comprises an accommodation section for accommodating the paper sheets, a discriminating section for discriminating the paper sheets, a cassette which is removably loaded to accommodate the paper sheets and feed at least the paper sheets accommodated, a cassette reject section which is provided in the cassette to accommodate the paper sheets in separation from those accommodated in the cassette and a control section for controlling to transfer, to the cassette reject section, the paper sheets which are fed from the cassette and are then discriminated as those which should not be accommodated in the accommodation section, whereby the paper sheets fed from the cassette and are then discriminated as those which should not be accommodated in the accommodation section are accommodated in the cassette reject section provided in the cassette. Accordingly, since the paper sheets under the condition which makes impossible the discrimination among those fed from the cassette, for example, the paper sheets stacked in two or more sheets, can be accommodated in the cassette reject section, the paper sheets fed from the cassette but is discriminated to have the kinds not designated are accommodated within the cassette in separation from those already accommodated. Namely, the paper sheets discriminated among those fed from the cassette are stored and managed in the kinds and the number thereof in direct and moreover the paper sheets which cannot be discriminated are accommodated in the cassette reject section. Accordingly, the paper sheets accommodated in the cassettes can be surely managed by confirming later the paper sheets within the cassette reject section.

Meanwhile, the present invention comprises an accommodation section for accommodating the paper sheets, a discriminating section for discriminating the paper sheets, a running reject section for accommodating the paper sheets depending on the result of discrimination of the discriminating section, a cassette which is formed to be removably loaded to accommodate the paper sheets and feed at least the paper sheets accommodated therein, a cassette reject section which is provided in the cassette to accommodate the paper sheets different from that accommodated in the cassette and a control section for controlling to transfer the paper sheets, when these are fed from the cassette and discriminated by the discriminating section as those which should not be accommodated in the accommodation section, to the cassette reject section and to transfer the paper sheets, when these are fed from the accommodation ection and disciminated as those which should not be transferred to the inlet/outlet port, to the running reject section, whereby the paper sheets which are fed from the cassette and discriminated as those which should not be transferred to the accommodation section are fed to the cassette reject section from the accommodation section, while the paper sheets which should not be transferred to the inlet/outlet port are accommodated respectively in the running reject section. The paper sheets which are fed from the cassette and accommodation section and are then discriminated as those which can be transferred respectively to the accommodation section and inlet/outlet port are stored and controlled in the kinds and the number of sheets, while the paper sheets which should not be transferred to respective sections mentioned above will be accommodated later in each reject section and can be controlled in the kinds and then number of sheets. Accordingly, since the paper sheets accommodated in the cassette and those accommodated in the accommodation section can be managed separately, the paper sheets accommodated respectively in the cassette and accommodation section can be surely managed.

Moreover, since the paper sheets which should not be transferred to the inlet/outlet port among those fed from the accommodation section are accommodated in the running reject section, the cassette can be loaded and unloaded even when the paper sheets are being fed from the accommodation section, and accommodation of paper sheets into the cassette can be realized without suspending the operations of apparatus, making it possible that the paper sheets can be charged without waiting for an operator and thereby the apparatus can be operated very efficiently.

Meanwhile, the present invention comprises an accommodation section for accommodating the paper sheets, a discriminating section for discriminating the paper sheets, a running reject section for accommodating the paper sheets depending on discrimination in the discriminating section, a cassette formed to be removably loaded to accommodate the paper sheets and feed at least the paper sheets accommodated therein, a cassette reject section which is provided in the cassette to accommodate the paper sheets in separation from those accommodated in the cassette and a control section for controlling to transfer the paper sheets, which are fed from the cassette and are discriminated by the discriminating section as those which should not be accommodated in the accommodation section, to the cassette reject section and to transfer the bills, which are fed from the accommodation section and discriminated as those which should not be accommodated in the cassette, to the running reject section, whereby, in the case of feeding the paper sheets from the cassette and then accommodating these paper sheets into the accommodation sectio, the paper sheets which should not be accommodated in the accommodation section are fed from the accommodation section and are then accommodated in the cassette reject section, while in the case of accommodating the paper sheets in the cassette, the paper sheets which should not be accommodated in the cassette are accommodated in the running reject section. The paper sheets fed from the cassette and accommodation section and are then discriminated as those which can be transferred respectively to the accommodation section and cassette may be stored and managed in the kinds and number of sheets, while the paper sheets which should not be transfserred to these setions are accommodated later to each reject section and are then managed in the kinds and the number of sheets. Therefore, since the paper sheets which are fed from the cassette and accommodation section and rejected can be accommodated in the different reject sections, the paper sheets accommodated in the cassette and accommodation section can be easily managed including the the paper sheets which should be rejected.

Moreover, since the paper sheets which should not be transferred to the cassette among those fed from the accommodation section are accommodated in the running reject section the cassette can be loaded and unloaded even when the paper sheets are being fed from the accommodation section, and therefore accommodation of paper sheets into the cassette can be realized without suspending the operations of apparatus, making it possible that the paper sheets can be charged without waiting for an operator and thereby the apparatus can be operated very efficiently.

Meanwhile, the present invention comprises a discriminating section for discriminating the paper sheets, an accommodation section for accommodating the paper sheet, a reject means for separatly accommodating the paper sheets from the accommodation section and storing the paper sheets discriminated by the discriminaing section as those which should not be accommodated in the accommodation section, a temporary storing section for temporarily storing the paper sheets discriminated as those which should not be accommodated in the accommodation section and a control section for controlling to store, in the temporary storing section, the paper sheets discriminated as those which should notbe accommodated in the accommodation section, accommodate the paper sheets which are accommodated in the temporary storing section and are then discriminated again as those which should not be accommodated in the accommodation section to the reject.means and to accommodate the paper sheets discriminatedas those which can be accommodated in the accommodation section to such accommodation section, whereby the paper sheets which are once discriminated as those which should not be accommodated in the accommodation section are once stored in the temporary storing section and are then discriminated again. Therefore, in the case of providing, for example, the removable cassette and accommodating the paper sheets to the accommodation section from this.cassette, if the paper sheets are discriminated as those which should not be accommodated in the accommodation section because the paper sheets are transferred while two or more sheets are stacked or transferred obliquely, the paper sheets may be discriminated as those can be accommodated in the accommodation section by executing the discriminating again for these paper sheets, thus reducing the rejection rate of the paper sheets and utilizing the paper sheets with higher efficiency.

Meanwhile, the present invention also comprises a cassette which is removably loaded to accommodate the paper sheets and the control section mentioned above executes controls so that the paper sheets fed from the cassette are discriminated and the paper sheets which are discriminated as those which should not be accommodated in the accommodation section are stored in the temporary storing section, the paper sheets in the temporary storing section are discriminated again and the paper sheets which are discriminated as those which should not be accommodated in the accommodation section are accommodated in the reject means and the paper sheets which are discriminated as those which may be accommodated in the accommdation section are accommodated in the accommodation section. Thereby, when the paper sheets fed from the cassette are discriminated as the bills which should not be accommodated in the accommodation section, such bills are stored in the temporary storing section and the pape sheets stored in the temporary storing section are discriminated again. Therefore, when it is attempted to accommodate the paper sheets into the accommodation section from the cassette, if the paper sheets are discriminated as those which should not be accommodated in the accommodation section because the paper sheets are transferred as those stacked in two or more sheets or are transferred obliquely, these may be discriminated as those which can be accommodated in the accommodation section by repeatedly discriminating them in the discriminating section. Accordingly, the reject rate of the paper sheets can be lowered and the paper sheets can be used very efficiently.

Since the reject means in the present invention is a cassette reject section which is provided in the cassette and is formed to accommodate the paper sheets in separation from the paper sheets accommodated in the cassette and to takes up the paper sheets, the present invention can surely manage the paper sheets stored in the cassette including the paper sheets to be rejected by storing the paper sheets fed from the cassette, if these are discriminated again as those which should not be accommodated in the accommodation section, to the cassette reject section.

Meanwhile, the present invention comprises a discriminating section for discriminating the paper sheets, a cassette which is structured to be removably loaded to accommodate the paper sheets and feed or take up these paper sheets, a reject means for accommodating the paper sheets in separation from those in the cassette and also accommodating the paper sheets which are discriminated as those which should not be accommodated in the cassette, a temporary storing section for temporarily storing the paper sheets which are discriminated as those which should not be accommodated in the cassette and a control section for controlling to store, in the temporary storing section, the paper sheets discriminated by the discriminating section as those which should not be accommodated in the cassette, to discriminate again the paper sheets in the temporary storing section and then accommodate, in the reject means, the paper sheets which are discriminated as those which should not be accommodated in the cassette and to accommodate, in the cassette, the paper sheets which are discriminated as those which can be accommodated in the cassette, whereby the paper sheets which are discriminated as those which should not be accommodated in the cassette are temporarily stored in the temporary storing section and thereafter these are discriminated again. Thereby, the paper sheets which are once discriminated as the bills which should not be stored in the cassette may sometimes be discriminated as the bills which can be accommodated in the cassette by discriminating again such paper sheets. That is, if the paper sheets are discriminated as those which should not be accommodated in the cassette because these are transferred stacked in two or more sheets or obliquely, these can also be discriminated as those which can be accommodated in the cassette when these are transferred in the correct attitude for repeated discrimination. Thereby the number of paper sheets which may be rejected can be reduced and the paper sheets can be used very efficiently.

Since the reject means of the present invention is a running reject means which can accommodate the paper sheets in separation from that in the accommodation section and thereby can accommodate the paper sheets fed from the accommodation section and discriminated as those which should not be accommodated in the cassette in separation from those in the accommodation section, the paper sheets being accommodated in the accommodation section can effectively managed in separation from the paper sheets accommodated in the reject means.

Moreover, since the accommodation section of the present invention comprises a collecting section for collecting the paper sheets, a collecting/moving means for moving the collecting section to the position enabling collection of the paper sheets and to the draw-back position disabling collection of the paper sheets and a collecting/driving means which is structured to vertically move and drive the collecting/moving means with the vertical movement of itself, the collecting section can easily be located to the collecting position and the draw-back position with the simplified structure because the collecting section may be positioned to the collecting position and the draw-back position with the vertical movement of the collecting/driving means and the space which is required for movement of the collecting section can be reduced, thereby realizing reduction in size of the apparatus.

In the present invention, since the collecting/moving means comprises a collecting section rotating shaft for rotating the collection section between the position enabling collection of the paper sheets and the draw-back position disabling collection of the paper sheets, a collecting section rotating pulley which rotates together with the collecting section rotating shaft, a collecting section drive belt for rotating the collecting section rotating pulley, a collecting section drive pulley for driving the collecting section drive belt and a rotating cam which is provided on the same pulley together with the collecting section drive pulley to rotate in conjunction with the collecting section drive pulley, while the collecting/driving means comprises a rotating plate cam which is engaged with the drive pulley to move vertically, a collecting section drive gear for vertically moving the rotating plate cam and a collecting section moving motor for rotating the collecting section drive gear, the collecting section can be positioned with the simplified structure to the collecting position and the draw-back position because the collecting section can be located to the collecting position and the draw-back position with the vertical movement of the collecting/driving means, and moreover the space required for movement of the collecting section can be reduced, realizing reduction in size of the apparatus.

Meanwhile, the present invention comprises an accommodation section for accommodating the paper sheets, an inlet/outlet port to which the paper sheets are inputted, a transfer route for transferring the paper sheets, a collecting section which is provided in the accommodation section to move between the collecting position for collecting the paper sheets and the draw-back position for disabling collection of the paper sheets and temporarily accommodate the paper sheets transferred from the transfer route and a control section for controlling to move the collecting section to the draw-back position when an instruction is issued to terminate the manipulation of paper sheets, whereby the paper sheets of the manipulation unit can be managed easily because these paper sheets are separated by the collecting section from those in the accommodation section and if a trouble occurs regarding the paper sheets, it can be recovered easily.

Moreover, since the present invention comprises a temporary storing section for storing the paper sheets which cannot be staccommodated in the accommodation section in view of temporarily storing the paper sheets which cannot be stacked in the accommodation section and also a control section for controlling to move the collecting section when the manipulation is terminated, the paper sheets in unit of manipulation can be managed easily because these are distinguished by the collecting section so as not to be mixed with the paper sheets in the accommodation section until the manipulation is completed and moreover if a trouble occurs regarding the paper sheets, it may be recovered easily.

Furthermore, since the present invention comprises an instructing means which is operated by an operator to instruct termination of manipulation and a control section for controlling to move the collecting section to the draw-back position depending on the instruction to terminate manipulation issued from the instructing means, the paper sheets in unit of manipulation can be managed easily because such paper sheets are distinguished by the collecting section so as not to be mixed with the paper sheets in the accommodation section until the mannipulation is completed and moreover if a trouble occurs regarding the paper sheets, it may be recovered easily and termination timing can be set freely because termination can be instructed depending on the operator's will.

Meanwhile, the present invention comprises an accommodation section for accommodating the paper sheets, an inlet/outlet port to which the paper sheets are inputted, a transfer route for transferring the paper sheet, a collecting section which is removably loaded to move between the collecting position for collecting the paper sheet and the draw-back position for disabling collection of the paper sheets and to temporary store the paper sheets transferred from the transfer route, an intermission instructing means which is operated by an operator to instruct intermission of manipulation and a control section for controlling to transfer the paper sheets in the collecting section to the inlet/outlet port from the transfer route depending on the instruction for intermission of manipulation issued from the intermission instructing means, whereby the paper sheets in unit of manipulation can be managed easily because the paper sheets are distinguished by the collecting section so as not to be mixed with the paper sheets in the accommodation section until the manipulation is completed and moreover if a trouble regarding the paper sheets occurs, it can easily be recovered and since intermission of the manipulation can be instructed freely depending on the operator's will, realizing the apparatus having higher flexibility.

Moreover, since the present invention comprises a temporary storing section for storing the paper sheets which cannot be accommodated in the accommodation section and a control section for controlling to transfer the paper sheets in the collecting section and temporary storing section to the inlet/outlet port throughthe transfer route depending on the instruction to intermit the manipulation issued from the intermission instructing means, the paper sheets in unit of manipulation can be managed easily because the paper sheets are distinguished by the collecting section so as not to be mixed with the paper sheets in the accommodation section until the manipulation is completed, if a trouble regarding the paper sheets occurs, it may be easily recovered and moreover the paper sheets inputted to the inlet/outlet port can all be returned thereto when the manipulation is termitted. In addition, since intermission of manipulation can be issued freely depending on the operator's will, an apparatus having higher flexibility can be provided.

Meanwhile, the present invention comprises an accommodation section for accommodating the paper sheets, a cassette which is formed to be removably loaded to accommodate the paper sheets and to feed the paper sheets accommodated, a transfer route for transfering the paper sheets, a collecting section provided in the accommodation section to move between the collecting position for collectging the paper sheets and the draw-back position for disabling collection of the paper sheets and temporarily accommodate the paper sheets transferred from the transfer route and a control section for controlling to locate the collecting section to the draw-back position when the paper sheets are fed from the cassette and are then accommodated in the accommodation section, whereby, in the case of charging the paper sheets to the accommodation section from the cassette, a large amount of paper sheets can be accommodated at a time into the accommodation section from the cassette at a high speed because the collecting section is located to the draw-back position and moreover the collecting section is not required to be located to the collecting position and draw-back position for each manipulation.

Moreover, since the present invention comprises a stage provided in the accommodation section to stack the paper sheets and to be slidable in the collecting direction and a control section for controlling, in the case of accommodating the paper sheets to the accommodation section, the position of the stage so that the space above the stage becomes the predetermined space, the stable accommodating operation can be ensured, in the case of accommodating the paper sheets in the accommodation section, because the sapece can always be maintained under the constant condition.

Meanwhile, the present invention comprises an accommodation section for accommodating the paper sheets, an inlet/outlet port to or from which the paper sheets are inputted or exhausted, a cassette which is formed to be removably loaded to accommodate the paper sheets and feed the paper sheets accommodated therein, a transfer route for transferring the paper sheets, a collecting section which is provided in the accommodation section to move between the collecting position for collecting the paper sheets and the draw-back position for disabling collection of the paper sheets and temporarily store the paper sheets transferred from the transfer route, an exhaust priority instruction means for instructing priority of exhaustion and a control section for controlling to locate the collecting section to the draw-back position depending on the exhaust priority instruction and transfer the paper sheets in the cassette to the accommodation section, whereby the paper sheets can be accommodated as much as possible in the accommodation section when the paper sheets exhaust manipulation priority is set.

Since the exhaust priority instruction means of the present invention is a maintenance operation section to be operated by an operator, an operator can easily issues the exhaust priority instruction, giving flexibility to the operation mode.

Moreover, since the present invention comprises a control section for cotnrolling to transfer the paper sheets to the accommodation section from the cassette, depending on the exhaust priority instruction issued from the exhaust priority instruction means, until the paper sheets to be accommodated in the accommodation section exceed the collecting position of the collecting section, the paper sheets can be accommodated in the accommodation section as much as possible when the paper sheet exhaust manipulation priority is set.

Moreover, the present invention comprises a temporary storing section for temporarily storing the paper sheets and a control section for controlling to transfer the paper sheets inputted to the inlet/outlet port to the temporary storing section and transfer the paper sheets in the temporary storing section to the accommodation section depending on a manipulation terminating instruction, whereby the paper sheets inputted to the inlet/outlet port can be manipulated even if the collecting section of the accommodation section cannot be used and furthermore since the paper sheets are distinguished by the collecting section so as not to be mixed with the paper sheets in the accommodation section until the manipulation is completed, the paper sheets in unit of manipulation may be managed easily and if a trouble regarding the paper sheets occurs, it can be recovered easily.

Meanwhile, the present invention comprises a temporary storing section for temporarily storing the bills and a control section for controlling to transfer the paper sheets inputted to the inlet/outlet port to the temporary storing section and also transfer the paper sheets in the temporary storing section to the inlet/outlet port depending on the manipulation intermitting instruction, whereby the paper sheets inputted to the inlet/outlet port can be manipulated even when the collecting section of the accommodation section cannot be used, moreover, since the paper sheets are distinguished by the collecting section so as not to be mixed with the paper sheets in the accommodation until the maniplation is completed, the paper sheets in unit of manipulation can be managed easily, furthermore, if a trouble regarding the paper sheets occurs, it can easily reovered and the paper sheets inputted to the inlet/outlet port can all be returned to the inlet/outlet port when the manipulation is intermitted. Moreover, intermission of manipulation can be instructed freely depending on the operator's will, the apparatus having higher flexibility can be provided.

Meanwhile, the present invention comprises a discriminating section for discriminating the paper sheets, a temporary storing section for temporarily storing the bills, a running reject section for accommodating the paper sheets which should not be accommodated in the accommodation section and cassette and a control section for controlling to transfer the paper sheets inputted to the inlet/outlet port to the temporary storing section and to transfer the paper sheets in the temporary storing section, depending on the discrimination result by the discriminating section, to the accommodation section, cassette or running reject section in accordance with the manipulation terminating instruction, whereby the paper sheets inputted to the inlet/outlet port can be manipulated even when the collecting section of the accommodation section cannot be used and the accommodation section is full of paper sheets and can no longer accommodate them, moreover, since the paper sheets are distinghished by the collecting section so as not to be mixed with the paper sheets in the accommodation section, the paper sheets in unit of manipulation can be managed easily and if a trouble regarding the paper sheets occurs, it can be recovered easily.

BRIEF DESCRIPTION OF THE DRAWINGS

FIG. 49 and FIG. 40 are manipulation flows showing the expensing manipulation from a bill cassette.

PREFERRED EMBODIMENTS OF THE INVENTION

The present invention will be explained hereunder in more detail with reference to the accompanying drawings.

In addition, the preferred embodiments of the present invention will also be explained with reference to FIG. 2 to FIG. 51.

Figure 2:
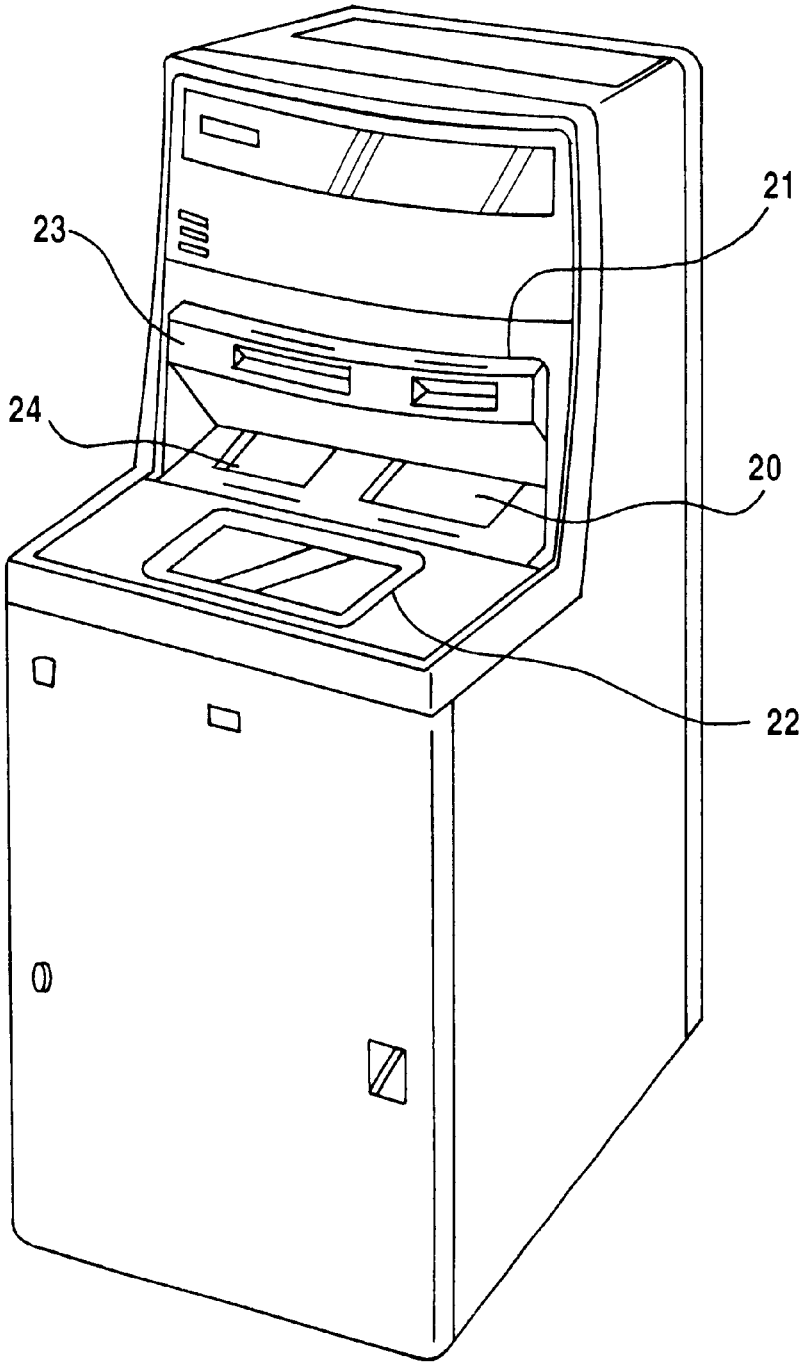
FIG. 2 is a perspective view of an automatic transaction apparatus.

The automatic transaction apparatus as shown in FIG. 2 is generally installed in financial institutions such as a bank and is manipulated by customers.

This automatic transaction apparatus can execute various transactions such as the receiving transaction, expensing transaction, payment/transfer transaction, entry of data and balance check, etc.

Figure 3:
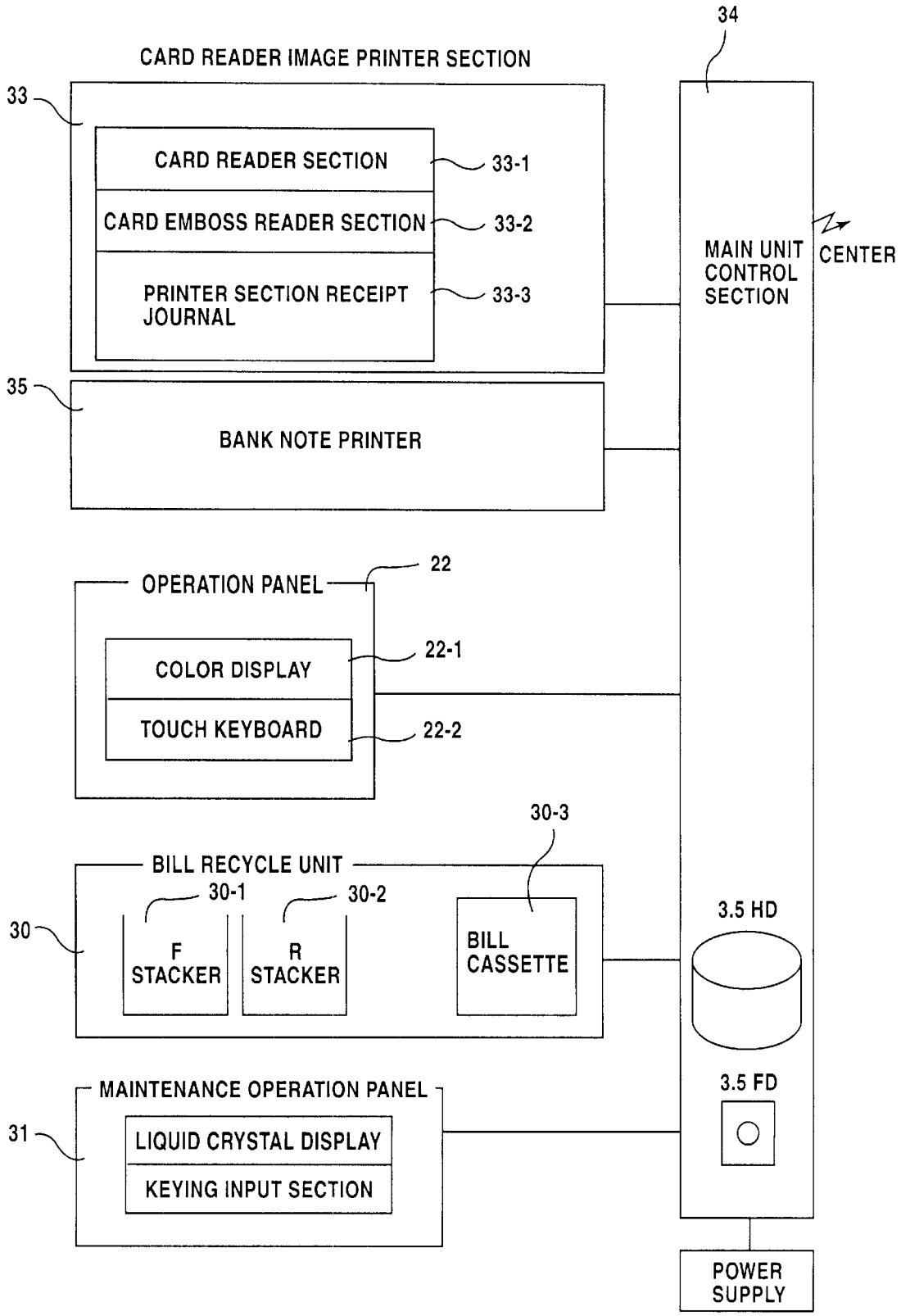
FIG. 3 is a structural diagram of an automatic transaction apparatus.

As shown in FIG. 2 and FIG. 3, the customers manipulates the operation panel 22 to input necessary information which is required for transaction such as the selection of a kind of transaction.

The operation panel 22 is formed by a touch keyboard 22-2 at the surface of a color display 22-1. On this color display 22-1, various guides for customers such as those for urging operator's operation and indicating the condition of waiting for operator's manipulation and the information to be inputted by customers are displayed. Moreover, the touch keyboard 22-2 detects the position touched by customer's fingers to invalidate the information to be inputted by customer displayed on the color display 22-1 corresponding to such touched position and uses such information as the input information to execute manipulations.

A customer selects the transaction from the operation panel 22 for executing the selected transaction.

[Receiving Manipulation]

The receiving transaction will be explained with reference to FIG. 2 and FIG. 3.

When a customer selects the receiving transaction, a guide for urging insertion of a cash card is displayed on the color display 22-1.

When the card is inserted into a card inlet port 2, a card reader 33-1 takes up the card with a roller (not illustrated) to read the information magnetically recorded on the card with a magnetic head (not illustrated).

On the basis of this information, the apparatus intercommunicates with a host computer to check justification of the card.

When the card is found normal as a result of a check, a guide for urging input of the bills is displayed on the color display 22-1. Moreover, the shutter of the bill inlet/outlet port 20 is opened, enabling input of the bills.

When a customer inputs the bills into the bill Inlet/outlet por t 20, the shutter closes to take up the bills in the bill inlet/outlet port 20 and the bills taken up in every kind of denmomination preset for the F, R stackers are accommodated separately.

When the bills are all taken up, the result of the transaction is printed on a receipt and a Journal by a printer section 33-3 and a receipt is exhausted together with the card from the card inlet port 21.

When a customer takes out the exhausted card and receipt, the receiving transaction is completed.

[Expensing Transaction]

The expensing transaction will be explained with reference to FIG. 2 and FIG. 3.

When a customer selects the expensing transaction, a guide for urging insertion of a cash card is displayed on a color display 22-1.

When a customer inserts the cash card into the card inlet port 21 depending on the instruction displayed, the card reader 33-1 provided in a card image reader printer unit 33 takes up the card with a roller (not illustrated) to read, with the magnetic head (not illustrated) the information required for specifying a customer such as a branch number and an account number, etc. magnetically recorded on the cash card.

An apparatus makes intercommunication, based on the information read from the cash card, with a host computer installed at the center of the financial institute from which the cash card has been issued to receive the information about a customer and the information such as a code number from a file (a ledger file) connected to the host computer.

While the information read from the cash card is being processed, a guide for urging the operator to input the code number is displayed on the color display 22-1 and simultaneously the information such as numerals required for inputting the code number is displayed.

The customer touches on the touch keyboard 22-2 at the part corresponding to the positions of numerals displayed on the color display22-1 in order to input his own code number. The customer operation panel 22 detects the positions on the touch keyboard 22-2 touched by the customer and invalidates the numerals corresponding to the positions touched by the customer to input the corresponding numerals as a part of the code number. That is, the numerals 0 to 9 are displayed, for example, on the color display 22-2 and when the customer touches on the position of numeral "4", "4" is inputted and the color display 22-1 displays "●○○○", indicating the input conditiont of the code number. Therefore, when the customer touches on the position of numeral "3" displayed subsequently, "3" is inputted and the color display 22-1 displays "●●○○", indicating that two digits are inputted.

The code number is usually formed of four digits and when numerals of four digits are inputted, input of the code number is completed and the code number inputted is verified.

Verification of the code number is executed using the information registered previously as the code number in the ledger of the host computer received through the intercommunication with the host computer conducted on the basis of the information read from the cash card.

The color display 22-1 of the customer operation panel 22 displays a guide for urging input of the amount of bills to be expensed, numerals required for inputting the amount of bills or units of bills such as thousand or ten thousands units.

Under the guidance the display, the customer touches on the positions corresponding to the numerals displayed on the touch keyboard 22-2 to input the amount of bills to be expensed.

The customer operation panel 22 invalidates the numerals of the positions touched by the customer as the amount of bills to be expensed.

When the amount of bills to be expensed is inputted from the customer operation panel 22 and the code number is verified normal, expensing operations are started.

The bills to be expensed are accommodated in the stacker F 30-1 and the stacker R 30-2. In the stackers F and R, 30-1, 30-2, the bills of ¥10000 and ¥1000 are respectively accommodated and these bills are fed sheet by sheet for necessary amount from each stacker depending on the expense instruction.

The bills fed from the stackers F and R are transferred to the bill inlet/outlet port 20.

Transaction result is printed, by a printer 33-3 on a receipt paper and is also printed on a journal paper together with an image data of emboss read from the surface of cash card with an emboss reader 33-2 of the card reader/image reader printer unit 33.

The bills transferred to the bill inlet/outlet port 20 are maintained under the condition that the customer can take up the bills by opening the shutter provided at the bill inlet/outlet port 20, so that the bills are ready for being taken up by the customer from the bill inlet/outlet port 20.

The receipt (detail statement slip) printed by the card reader/image reader printer unit 33 is partly exhausted from the card inlet port 21 together with the cash card inputted to the card reader 33-1, enabling the customer to take up these receipt and cash card.

When the card, receipt and bills are all taken up, the shutter of the bill inlet/outlet port 20 closes, completing the expensing transaction.

In the case of transaction, or expensing transaction using coins, necessary coins are fed from a coin manipulating unit (not illustrated) and are then transferred to the coin inlet port 24 to open the shutter of the coin inlet port 24, resulting in the condition that the coins can be taken up.

Moreover, in the case of a receiving transaction using coins, the shutter of the coin inlet port 24 opens making ready for inputting coins. When the customer inputs coins from the coin inlet port 24, the shutter closes and takes up coins with the coin manipulating unit.

Moreover, when the customer hopes to execute the transaction and also to print the transactions executed in the past to a bank note which the customer has carried, the customer selects a bank note and inputs it to the bank note inlet port 23. When a bank note is inputted, a bank note printer 35 reads the information magnetically recorded on the bank note and checks justification of the bank note and thereafter prints the unwritten data of the transactions in the past to the predetermined positions of the bank note and finally exhaust the bank note from the bank note inlet port 23.

The automatic transaction apparatus is provided with a rear door at the rear surface thereof and this rear door may be opened or closed by a person in charge. When the rear door is opened, the maintenance operation panel 31 is provided for use by maintenance person to execute the maintenance and to recover the apparatus from a fault.

The main control section 34 totally controls the respective sections explained above and also makes communications with a host computer installed in the center to execute transactions.

The bill cassette 30-2 is used for charging and collecting of bills to the stackers F, R.

Figure 4:
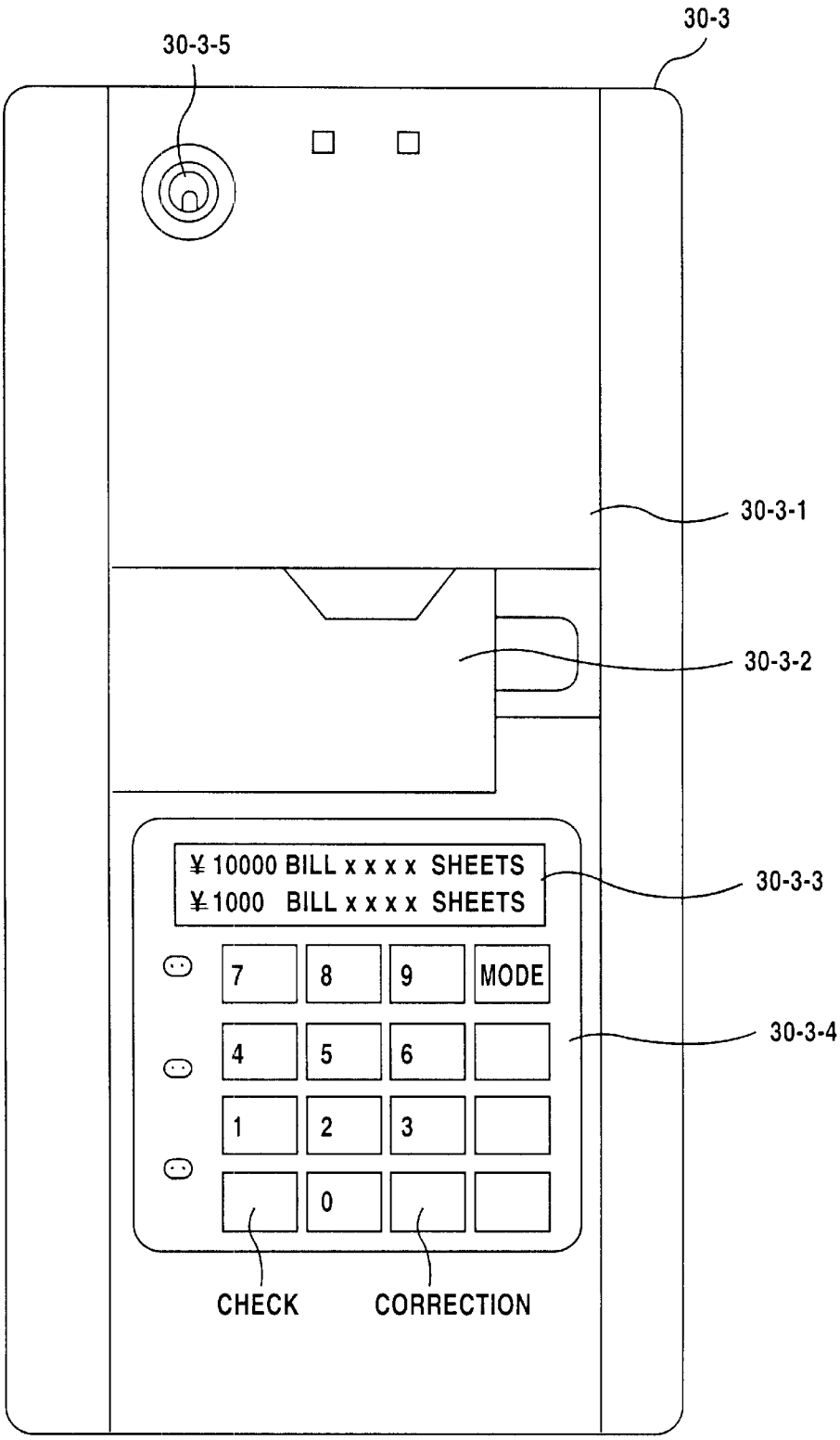
FIG. 4 is a diagram showing a bill cassette.

As shown in FIG. 4, the bill cassette 30-3 is provided with a door of safe 30-3-1, a card reader 30-3-2, a display 30-3-3, a keying input section 30-3-4, a key 30-3-5 for locking and unlocking the safe door 30-3-1 and also comprises a microcomputer therein.

In the case of setting the bills to this bill cassette 30-3 or taking out the bills therefrom, the key 30-3-5 is unlocked to open the safe door 30-3-1. In this case, when it is required to know who has manipulated the bill cassette 30-3, a person in charge designated as an operator is urged to scan the ID card assigned to him with the card reader 30-3-2.

The display 30-3-3 can display the information about the bill cassette 30-3, for example, the number of bills of every denomications being set in the bill cassette 30-3 and the ID number of the automatic transaction apparatus to be set.

Moreover, the keying input section 30-3-4 inputs the information about the bill cassette 30-3, for example, the information such as denominations and the number of sheets of bills being set, and the code number corresponding to the ID card required for manipulating the bill cassette, etc.

[Explanataion about Structure and Operations of Bill Recycle Unit]

Operations of the bill recycle unit at the time of executing the transaction will be explained with reference to the drawings.

Figure 5:
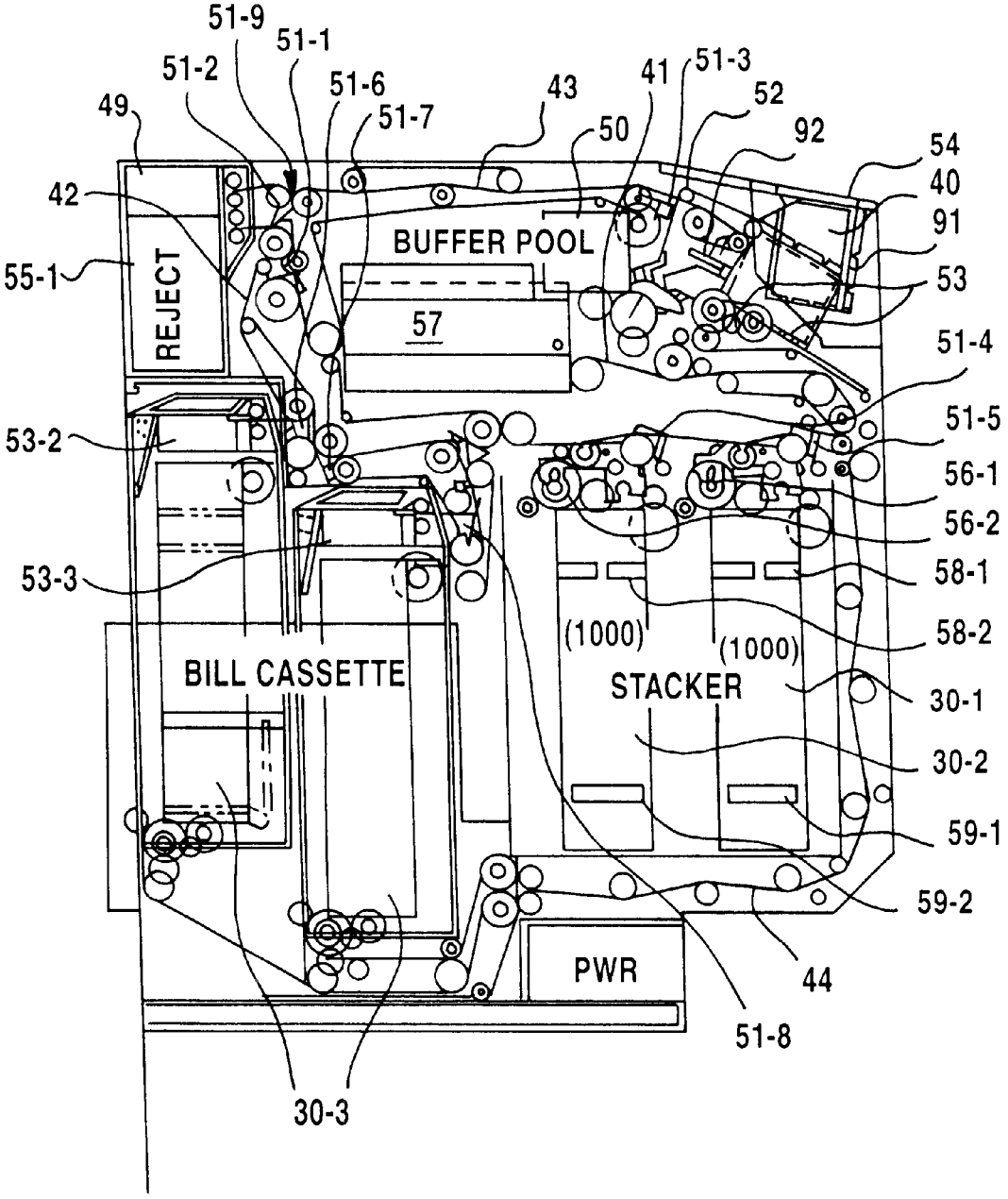
FIG. 5 is a structural diagram showing a bill recycle unit.
Figure 6:
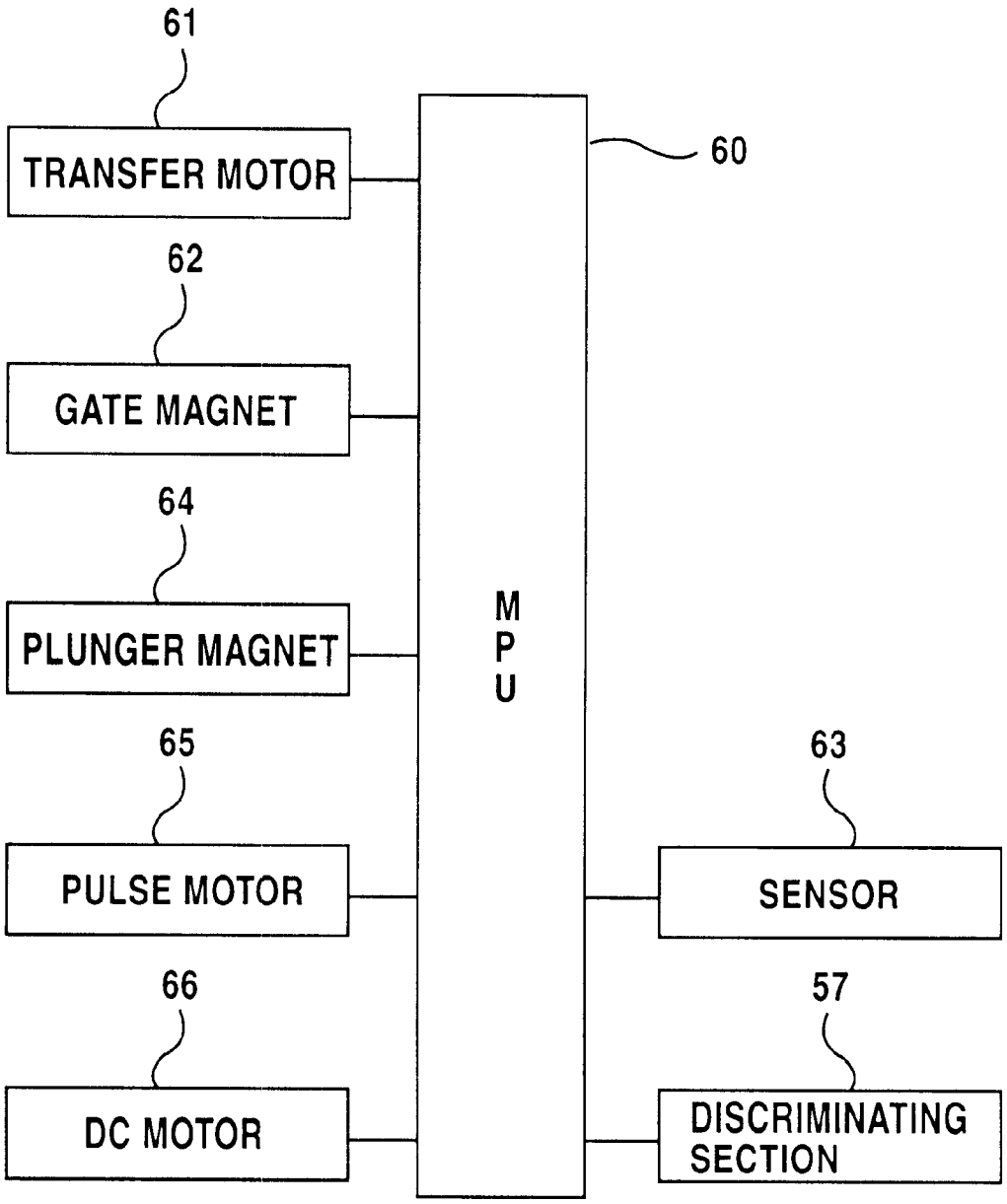
FIG. 6 is a diagram showing control configuration of a bill recycle unit.

The bill recycle unit 30 shown in FIG. 3 has the layout of respective sections as shown in FIG. 5 and moreover comprises a microcomputer(MPU) as shown in FIG. 6 to control respective sections and execute the transaction while making communication with the main control section 34.

A transfer motor 61 drives the transfer belt to transfer the bills.

A gate magnet 62 is provided at the area where the transfer route consisting of the transfer belt to transfer the bills is branched into two routes to drive the gate for changing over the transfer direction of the bills and the transfer route is branched to many routes in the bill recycle unit. The gate magnet 62 is used for each gate.

A sensor 63 detects existence of the bills provided in the transfer route and the bill inlet/outlet port. This sensor is an optical sensor including a light emitting element and a photosensitive element. The light emitting element always emits the light, while the photosensitive element receives the light emitted by the light emitting element. A medium passes between the light emitting element and the photosensitive element. The amount of light received by the photosensitive element changes depending on existence or not existence of the bills. Amount of light received is converted to an electrical signal and is outputted as the signal including high and low levels to detect existence of the bills.

A plunger magnet 64 can be located at two positions by sliding a link and is used to drive each section which is required to be located at two positions of an electromagnetic lock, etc.

A pulse motor 65 rotates a roller for feeding the stacked bills sheet by sheet.

A DC motor 66 is provided for opening and closing the shutter 54 of the bill inlet port 40.

A discriminating section 57 optically and magnetically discriminates true or false bills and conditions of bills such as braking conditions, denominations and front or rear surface.

Figure 1:
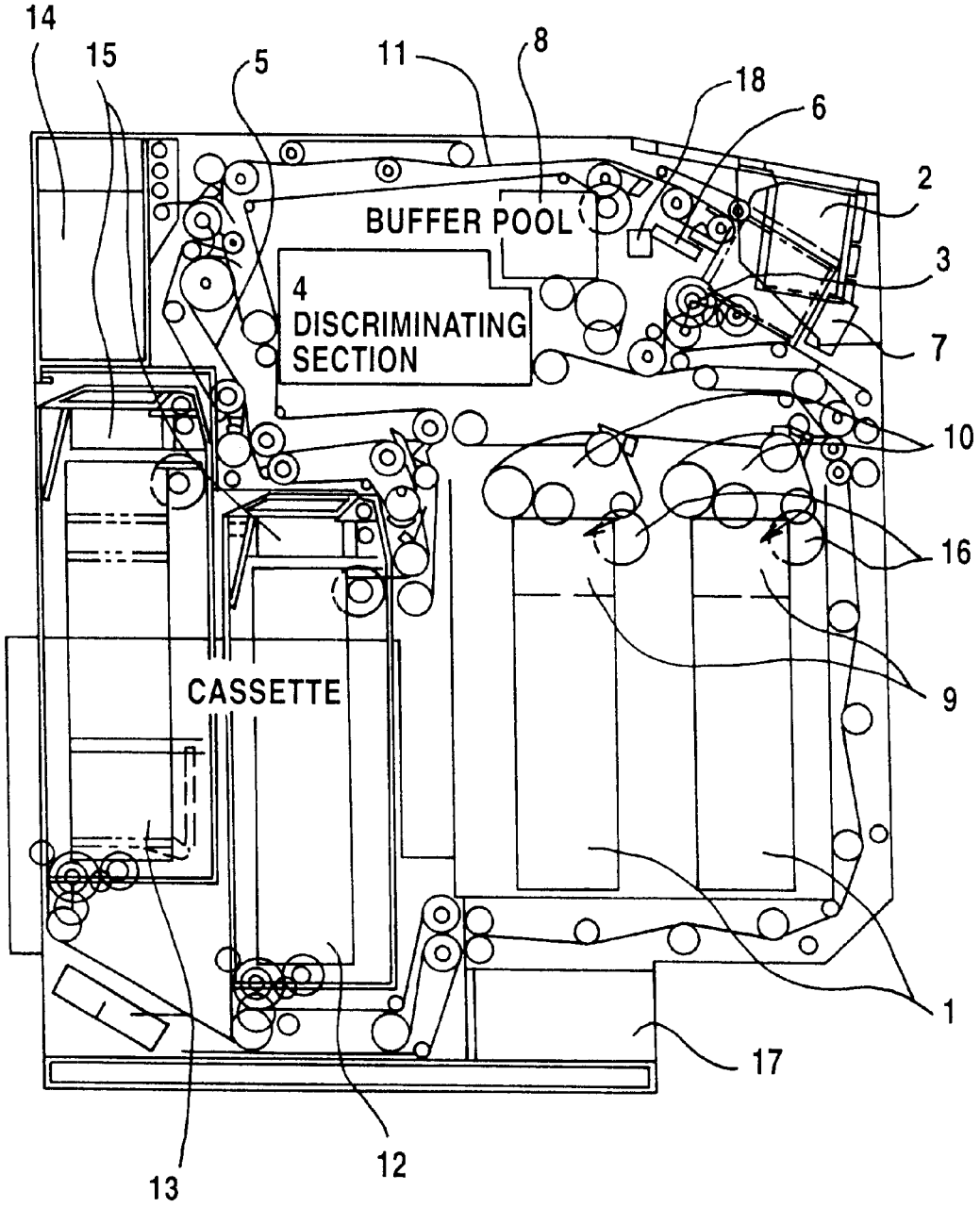
FIG. 1 is an explanatory diagram showing the principle of the present invention.

Correspondence between FIG. 1 and FIG. 5 is then explained hereunder.

The accommodation section 1 corresponds to stackers F 30-1 and R 30-2; while the inlet/outlet port 2 to an outlet port 91; the sending section 3 to a feeding section 53; the discriminating section 4 to a discriminating section 57; the transfer route 5 to an accommodation/transfer route 42; the separating means 6 to a presser 92; the temporary storing section 8 to a buffer pool 50; the collecting section 9 to collecting sections 58-1, 58-2; the feeding means 10 to stacker feeding sections 56-1, 56-2; the returning transfer route 11 to a returning transfer route 43; the front cassette 12, rear cassette 13 to a bill cassette 30-3; the running reject section 14 to a reject 55-1; and the cassette reject 15 to cassette rejects 53-2, 53-3, respectively.

Figure 15:
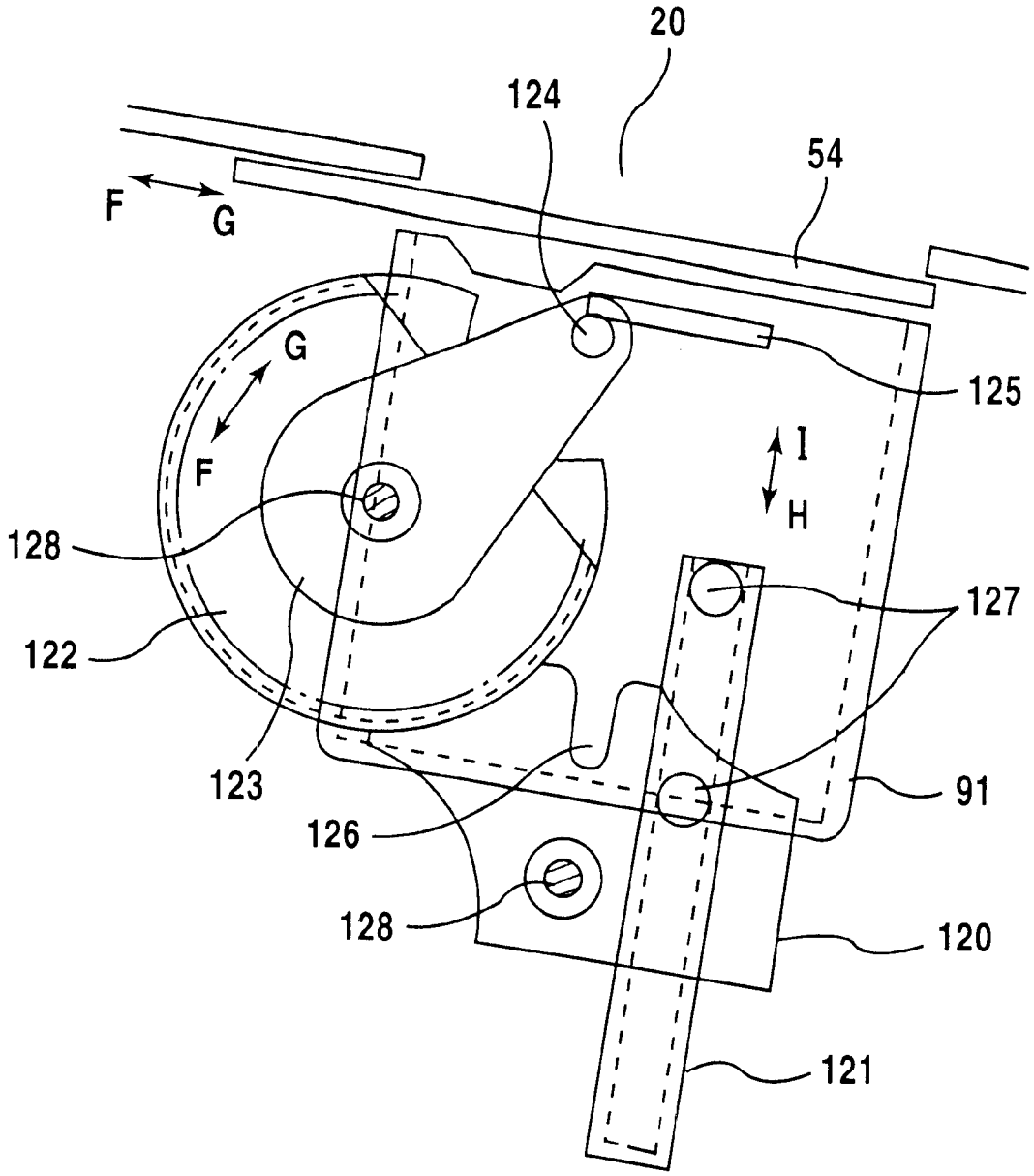
FIG. 15 to FIG. 19 show the moving operation of an inlet/outlet port.

The moving means of FIG. 1 corresponds to Geneva 130, Geneva slider 121, drive gear 122, drive link 123, drive shaft 128, projected portion 124, engaging portion 125, cutout portion 126, rotating roller 127 and rotating shaft 128 of FIG. 15.

Figure 20:
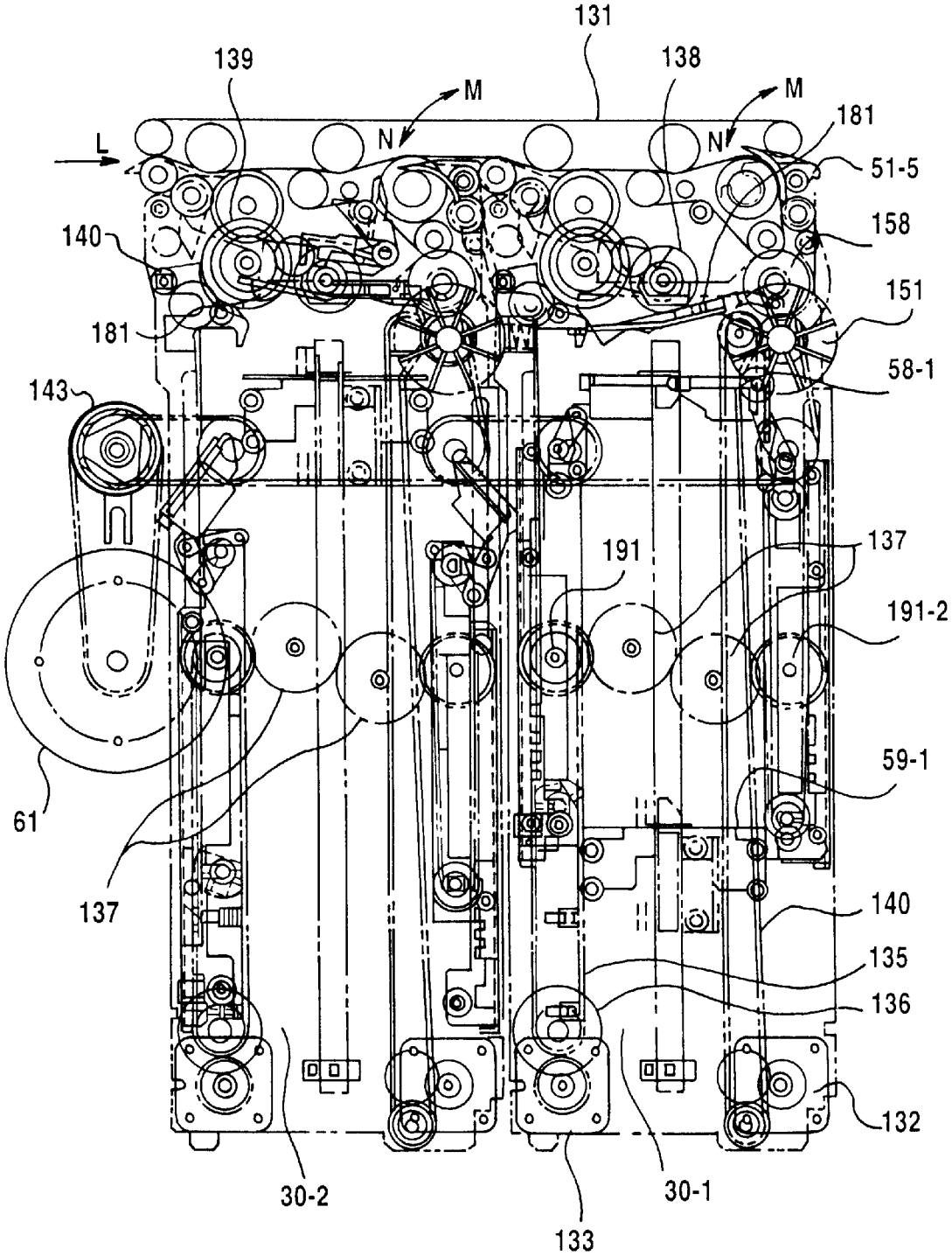
FIG. 20 is a structural diagram of a stacker.
Figure 28:
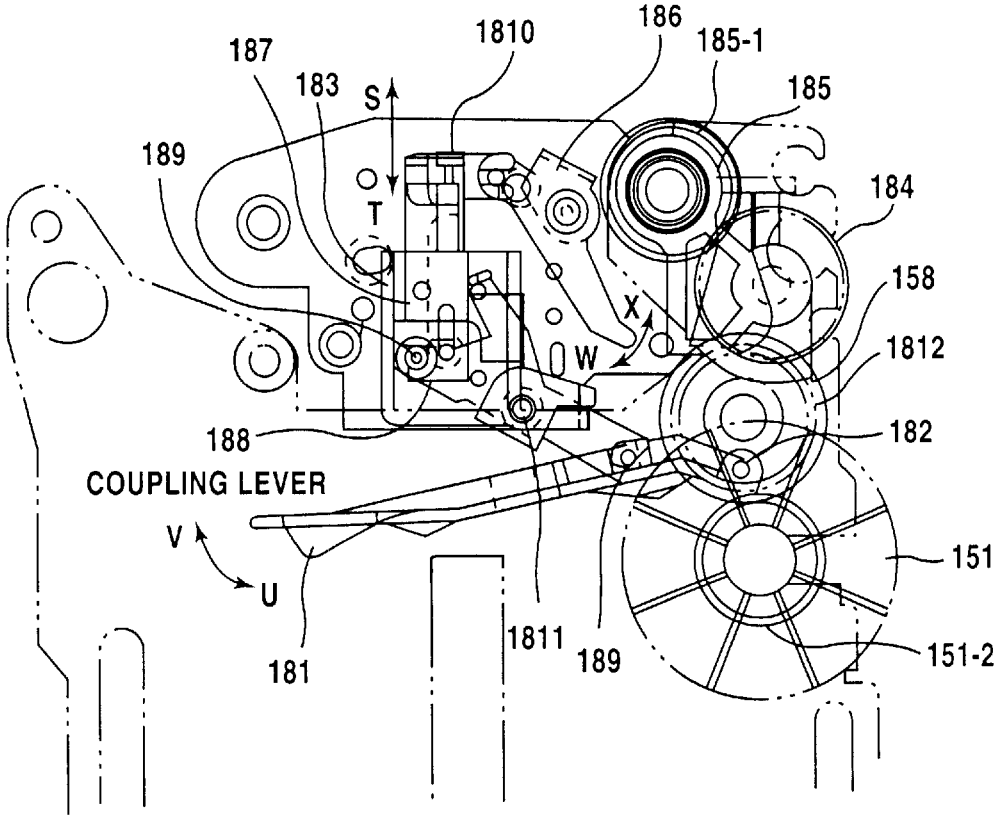
FIG. 28 is a diagram showing operation for accommdating the bills on a stacker.

The feeding means 16 of FIG. 1 corresponds to feed roller 158, vane wheel 151 of FIG. 20 and vane wheel side roller 151-2 of FIG. 28.

The control section 17 of FIG. 1 corresponds to MPU 60 of FIG. 6.

The separating means moving means 18 of FIG. 1 corresponds to presser motor 93, support guide 96, vertical moving motor 97, presser guide 98, forward/backward rack 99, forward/backward gear 100, upper/lower rack 101, upper/lower roller 103, coupling gear 104 and vertical shaft 105.

MPU 60 operates depending on the following manipulation flow to control respective sections.

[Receiving Transaction]

Figure 7:
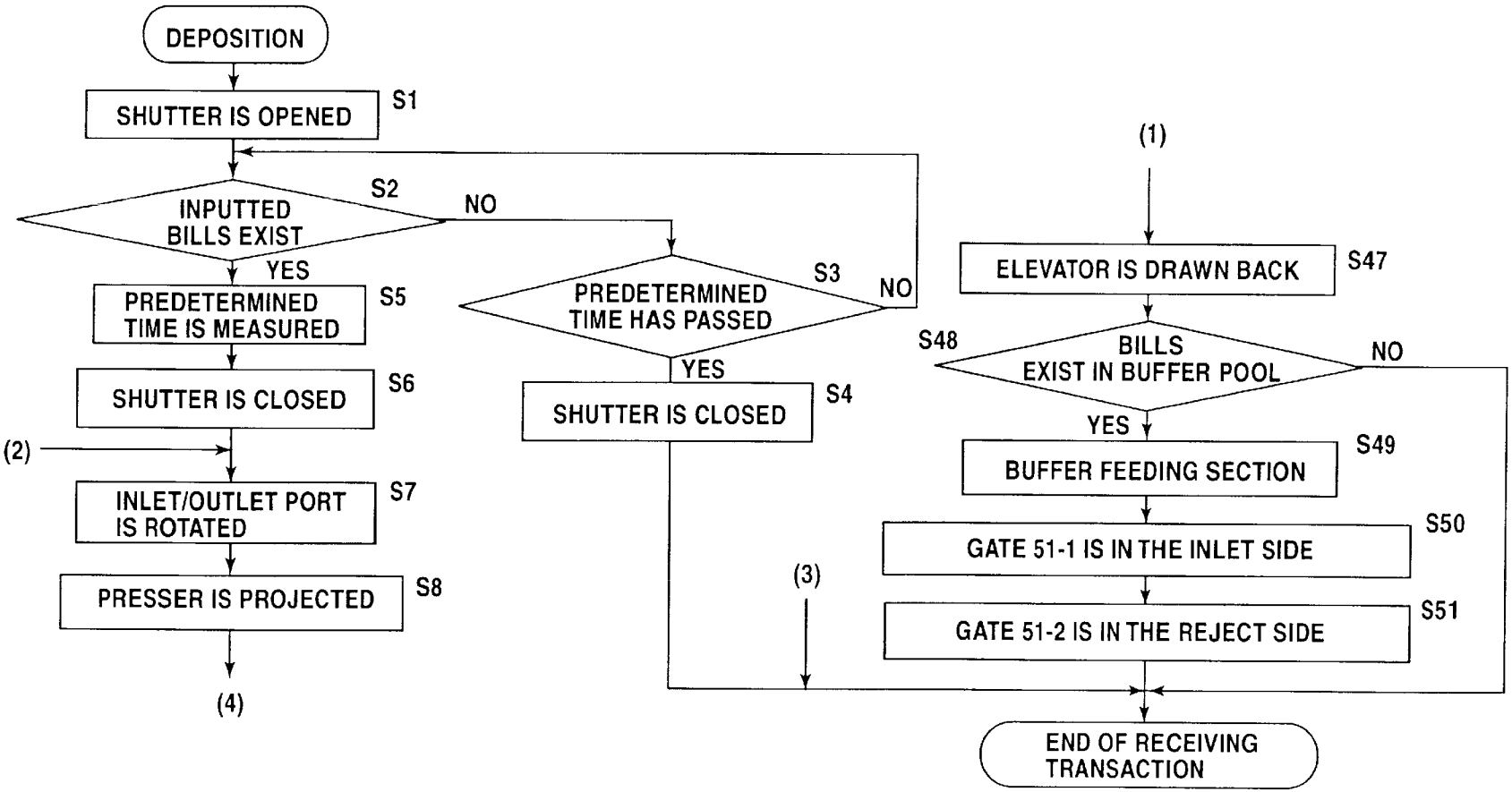
FIG. 7 to FIG. 9 are manipulation flows of a bill recycle unit at the time of the receiving transaction.
Figure 8:
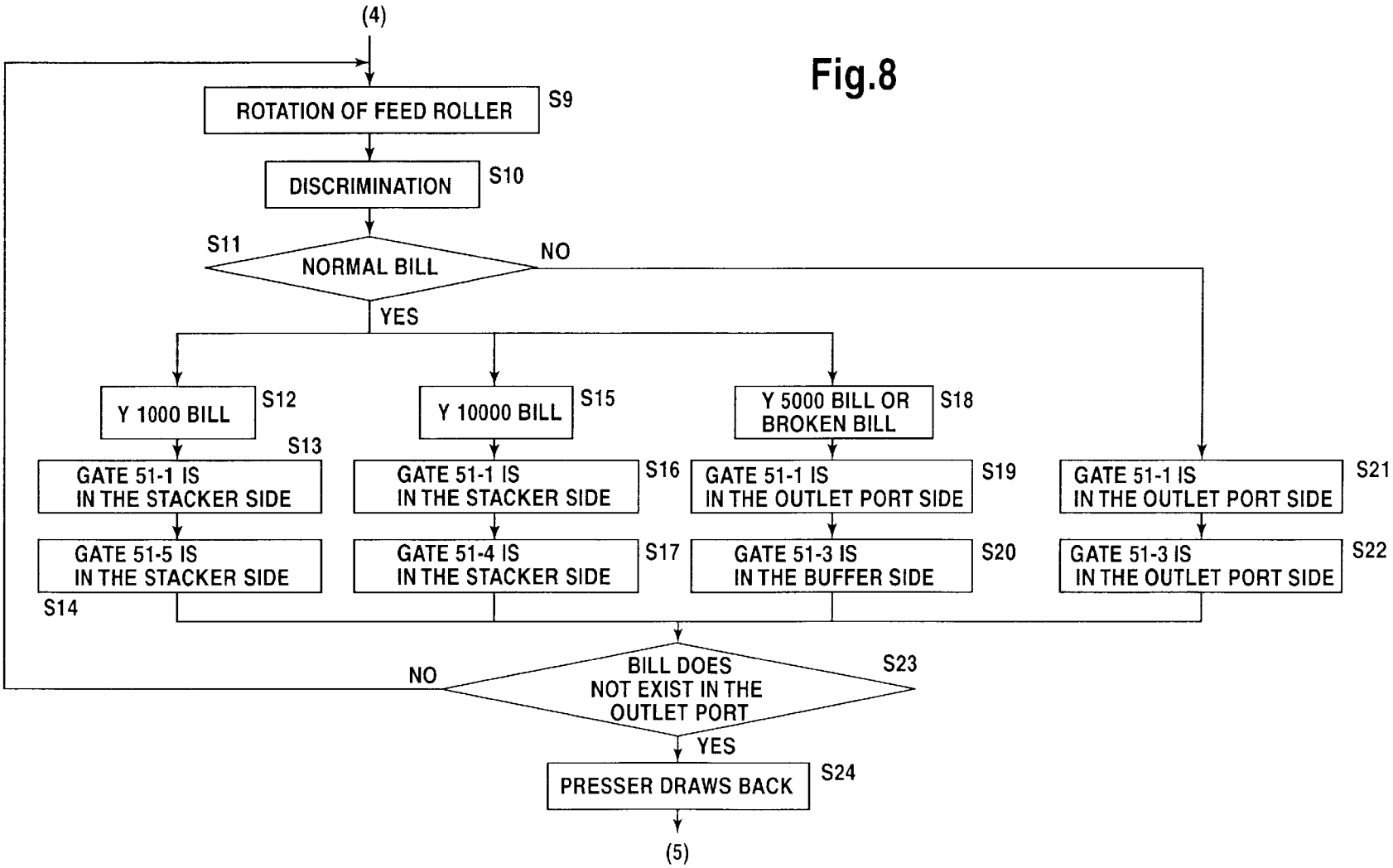
Figure 9:
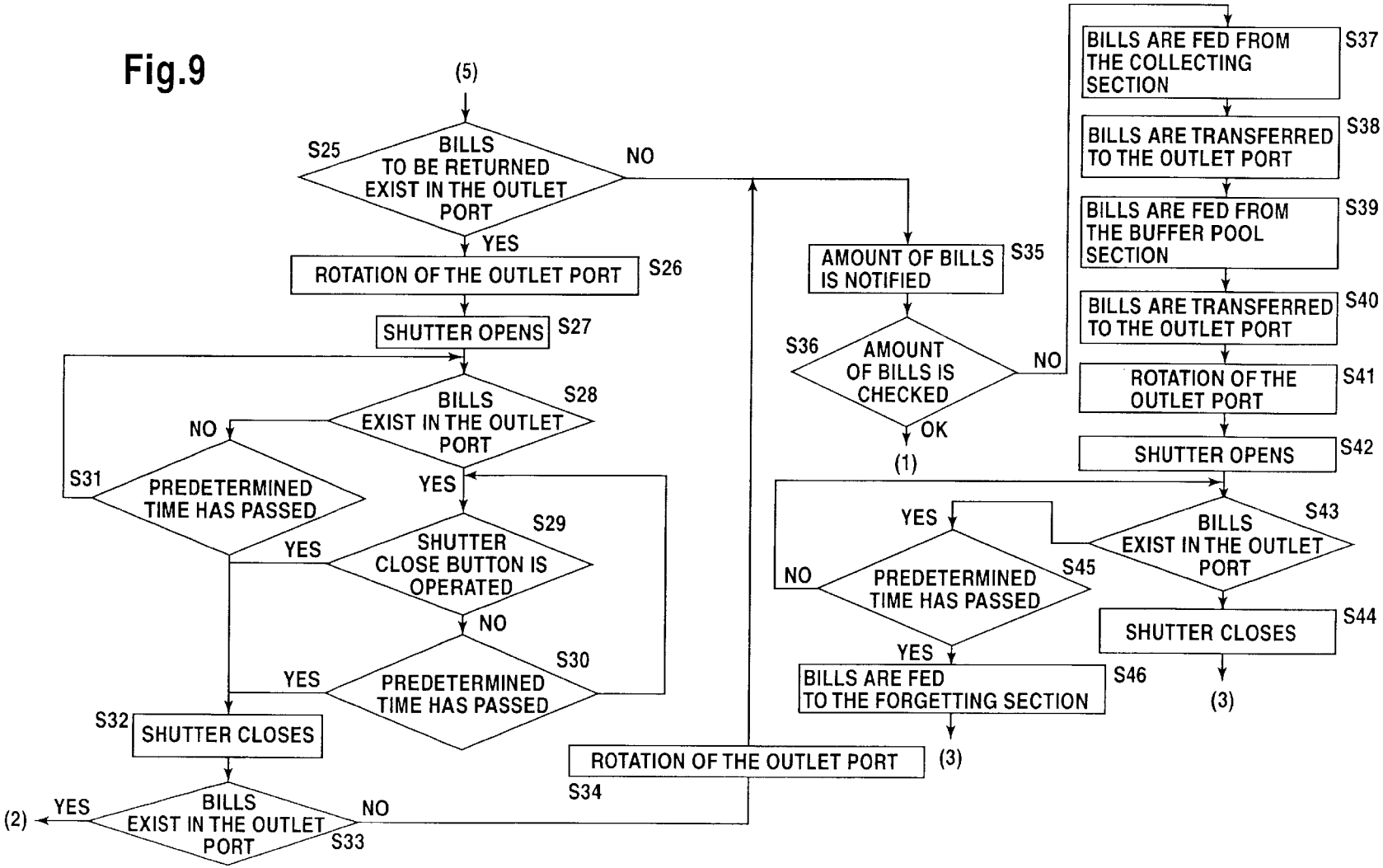

Operations of the bill recycle unit during the receiving transaction willbe explained depending on the manipulation flows of FIG. 7 to FIG. 9 using FIG. 2 to FIG. 9.

When a customer operates the customer operating panel 22 and selects the receiving transaction, the receiving transaction starts.

In this case, the stackers F, R 30-1, 30-2 check whether these stackers can accommodated the bills inputted by the receiving transaction. If accommodation is impossible, irregular manipulation is carried out.

When the bills inputted can be accommodated, MPU 60 drives a DC motor 66 in order to open (S1) the shutter 54 of the bill inlet/outlet port 40, enabling the customer to input the bills to the bill inlet/outlet port 20.

Whether the bills are inputted to the bill inlet/outlet port 40 or not is detected (S2). If the bills are not inputted to the bill inlet/outlet port 40, whether the predetermined period has passed or not after the shutter 54 is opened is detected (S3). If the predetermined period does not yet have passed, input of the bills is continuously watched.

If the predetermined has passed while the bills are not inputted to the bill inlet/outlet port 40, the shutter 54 is closed (S4), completing the transaction.

When it is detected that the bills are inputted to the bill inlet/outlet port 40 (S2), the shutter 54 is closed (S6) after the predetermined period has passed (S5).

When the shutter 54 is closed, the outlet port 92 of the bill inlet/oulet port 40 rotates (S7) to move to the position for feeding the bills from the outlet port 91.

When the outlet port 91 moves up to the position enabling the feeding of bills, the presser 92 is projected into the outlet port 91 (S8) to push the bills toward the feeding section 53.

The bills in the outlet port 91 are fed sheet by sheet from the feeding section 53 after it has rotated (S9) and are then transferred to the discriminating section 57 by way of the discriminating and transferring route 41.

The discriminating section 57 discriminates the bills transferred by the discriminating and transferring route 41

(S10). The discriminating section 57 discriminates whether the bills are true bills or false bills, a degree of damage of bills (whether bills may be recycled or not), denominations and front or rear surface of the bills.

Depending on the result of discrimination (S11), MPU60 controls the gate magnet 62, changes over the gate and controls the transfer direction of the bills.

That is, when the bills are discriminated as the true bills as the result of discrimination and may also be recycliced used for the expensing transaction which dispenses the bills, the gate 51-1 is changed over (S13, S16) and the bills are transferred to the stacker side by the accommodation and transfer route 42.

Moreover, the bills other than the true bills, for example, false bills or those which are not discriminated as the true bills because these are transferred obliquely, or transferred stacked in two or more sheets, or transferred too deviated in the width direction of the transfer route are transerred to the outlet 91 side through the returning transfer route 43 by changing over the gate 51-1 (S21).

Moreover, the bills which are discriminated as the true bills but are not accommodated in the stackers F, R 31-1, 31-2 and are not recycled for the expensing transaction which dispenses the bills, for example, the bills which are broken or severely contaminated, ¥5000 bill or the bill which may be expected to be issued in future and higher than ¥10000 are accommodated in the buffer pool section 50 by changing over the gate 51-1 to the outlet side (S19), changing the gate 51-3 to the side of buffer pool section 50 and by separation from the returning transfer route 43.

The bills transferred to the stackers are distributed by the gates 51-4, 51-5 to the stackers of the predetermined denominations. That is, when it is determined that the ¥10000 bills are accommodated in the stacker F 30-1, while the ¥1000 bills are accommodated in the stacker R 30-2, the ¥1000 bills among the bills transferred to the stackers are accommodated by the gate 51-4 to the stacker R 30-2 (S14) and the ¥1000 bills are accommodated by the gate 51-5 to the stacker F 30-1 (S17).

This operation is continued until the bills inputted to the outlet port 91 are no longer detected by the sensor 63, namely, the bills inputted to the inlet/outlet port 91 are all transferred (S23).

When the bills inputted to the outlet port 91 are all discriminated, the presser 92 is drawn from the inlet/outlet port 91 (S24).

If the bills are partly returned to the outlet port 91 becaue these are not discriminated as the true bills (S25), since these returned bills are stacked at the upper part of the presser 92, when the presser 92 draws back (S24), only the returned bills are left in the outlet port 91.

When the outlet port 91 rotates after the presser 92 draws back (S26), the inlet/outlet port 91 is positioned to the input position from the feeding position.

Thereafter, the DC motor 66 is driven to open the shutter 54 (S27) so that a customer can take up the bills returned to the inlet/outlet port 91 and an instruction for taking up the bills from the bill inlet port 20 is displayed on the color display. 22-1 of the customer operation panel 22.

MPU60 detects whether the customer has taken up the bills in the outlet port 91 or not from an output of the sensor 63 (S28). When there is no bills in the outlet port 91, the predetermined period is counted up (S31) and thereafter the shutter 54 is closed (S32).

Moreover when the bills exist in the outlet port 91, the shutter 54 is kept open until he shutter close button is depressed (S29) or until the predetermined period passes (S30). This shutter close button is displayed on the color display 22-1 utilizing the color display 22-1 and touch keyboard 22-2 of the customer operation panel 22 and input of instruction for closing the shutter is recognized when the position corresponding to the touch keyboard 22-2 indicating the shutter close button is operated.

When the shutter close button is operated or the predetermined time passes, the shutter 54 is closed (S329).

When the sensor 63 detects whether there are bills in the outlet port 91 (S33) or not and the bills are detected, the outlet port 91 is rotated (S7) again and the bills in the outlet port 91 are discriminated again. This operations are required because the bills are sometimes not discriminated as the true bills, although these are true bills, depending on the transfer condition of bills to the discriminating section 57, for example, the bills are transferred stacked in two or more sheets or transerred obliquely or the bills are transferred deviated in the width directioni of the transfer route and these bills can be discriminated as the true bills by the repeated discimination. Therefore, the bills are fed from the inlet port 91 for the repeated discrimination.

When any bills are not returned (S25) and when the returned bills are taken out from the inlet port 91, the transaction can be continued with the bills discriminated as the true bills. Amount of the bills discriminated by the discriminating section 57 is displayed on the color display 22-1 of the customer operation panel 22 through the main control section 34 (S35), urging the customer to verify the amount of bills.

When the customer verifies the displayed amount matches the amount of bills inputted, it is inputted from the touch keyboard 22-2 of the customer operation panel 22. If these are not matched or the customer desires to intermit the transaction, it is inputted from the touch keyboard of the customer operation panel (S36).

When the amount of bills is verified and the instruction for continuing transaction is also inputted, the collecting sections 58-1, 58-2 separating the stackers F, R 30-1, 30-2 are drawn back to perfectly accommodate the bills temporarily stored in the stackers F, R 30-1, 30-2 thereto (S47). Thereby, the bills inputted in the current receiving transaction can be accommodated stacking over the bills already accommodated in the stackers F, R 30-1, 30-2.

In this case, when there are bills in the buffer pool section 50, the buffer feeding section 52 feeds the bills in the buffer pool section 50 and transfers these bills to the discriminating section 57 by way of the discriminating transfer route 41 and moreover are accommodated in the reject section 55-1 via the gate 51-1 (S50) and the gate 51-2 (S51). Since the bills in the buffer pool section 50 are true bills but are not used for the transaction, these are accommodated in the reject section 55-1 in separation from the bills accommodated in the stackers F, R 30-1, 30-2.

If the customer inputs the instruction for suspending the transaction from the customer operation panel 22 (S36) when the amount of bills inputted and discriminated in the step S35 are displayed on the customer operation panel 22, the bills in the collecting sections 58-1, 58-2 of the stackers F, R 30-1, 30-2 are fed by driving the stacker feeding sections 56-1, 56-2 (S37) and are then transferred to the inlet/outlet port 91 through the discriminating transfer route 41, gates 51-1, 51-2 and the returning transfer route 43 (S38).

In this case, when there are bills in the buffer pool section 50, the buffer feeding section 52 is driven (S39) to feed the bills in the buffer pool section 50 and to transfer the bills to the outlet port 91 through the discriminating transfer route 41, gates 51-1,7 51-2 and returning transfer route 43 (S40).

When the bills in the collecting sections 58-1, 58-2 of the stackers F, R 30-1, 30-2 and the bills in the buffer pool section 50 are transferred to the outlet port 91, the outlet port 91 is rotated to move to the position enabling input of the bills (S41) and the shutter 54 is opened (S42), enabling the customer to take up the bills in the bill inlet port 40.

When existence of the bills in the outlet port 91 is detected (S43) and the bills are taken out, the shutter 54 closes (S44), completing the transaction.

Moreover, when the bills in the outlet port 91 is detected (S43), the bills are not taken out and the predetermined time has passed (S45), the shutter 54 is closed, the bills are fed again from the outlet port 91 and are accommodated in a forgetting section 49 through the discriminating section 57, gates 51-1, 51-2, 51-6, 51-9. In this case, a trouble with the customer who have forgot to take out the bills may be avoided by discriminating the bills fed from the outlet port 91 in the discriminating section 57 and by verifying that the bills of such amount returned to the outlet port 91 are fed again from the outlet port 91.

[Expensing Transaction]

Operations of the bill recycle unit for expensing transaction will be explained depending on the the bill dispensing flows of FIG. 10 to FIG. 11 with repect to FIG. 2 to FIG. 6 and FIG. 10 to FIG. 11.

When a customer operates the customer operation panel 22 to select the expensing transaction, the expensing transaction can be started.

Based on the expensing amount of bills inputted by the customer, the bills are to be dispensed.

Namely, the bills of the predetermined denominations are accommodated in the stackers F, R 30-1, 30-2, that is, the ¥10000 bills are accommodated in the stacker F 30-1, while the ¥1000 bills in the stacker R 30-2, respectively. Therefore, for the expensing transaction of ¥100,000, ten ¥10000 bills are fed from the stacker F 30-1. Moreover, for the expensing transaction of ¥55,000, five ¥10000 bills are fed from the stacker F 30-1 and five ¥1000 bills from the stacker R 30-2. Here, since the ¥5000 bills are certainly circulated but in small number of sheets and may also be substituted by the ¥1000 bills, when this ¥5000 bills are inputted, these are accepted but are determined to be never dispensed at the time of expensing transaction. However, the senominations of bills to be accommodated in the stackers F, R can be set freely and the ¥5000 bills may be accommodated in the stacker F 30-1 so that the ¥5000 bills can be dispensed in place of the ¥10000 bills.

In addition, since the expensing transaction in unit of ¥1000 designating the amount of bills to be dispensed such as ¥10000 or ¥20000, etc. occupies the greater part of the expensing transactions, a small amount of bills may be charged and a long term operation may be realized by accommodating the ¥10000 bills into both stackers F, R 30-1, 30-2 in order to increase the anount of ¥10000 bills and limiting the expensing transactions only to that in unit of ¥10000.

When the expensing transaction is requested (S60), whether the mechanism for feeding the bills to the stackers F, R 30-1, 30-2 operates normally or not must be detected (S61).

When such mechanism operates normally, it is then detected (S62) whether the bills which are enough for dispense of wanted amount exist or not in the stackers 30-1, 30-2. It may be realized by managing the number of sheets of bills accommodated in the stackers 30-1, 30-2 because input and output of the bills in the stackers 30-1, 30-2 are controlled using a counter.

When the bills in the stackers 30-1, 30-2 are enough for dispensing the wanted amount of sheets, the stacker feeding sections 56-2, 56-3 are respectively driven to feed the number of sheets of bills corresponding to the wanted amount from the stackers 30-1, 30-2 (S63).

The bills fed from the stackers 30-1, 30-2 are transferred by the transfer belt to the discriminating section 57 through the discriminating transfer route 41 and are discriminated (S67) in the discriminating section 57 for double-feedding (S66) and denominations (S67). This discrimination is necessary to dispense the correct bills in such cases that the bills fed from the stackers are transferred and dispensed stacked in two or more sheets or the bills of the denominations different from the predetermined denominations are erroneously accommodated in the stackers.

If the bills are transferred stacked in two or more sheets or the bills including those of the denominations which should not be expensed are transferred as a result of discrimination, these bills are transferred and accommodated in the reject section 55-1 through the gates 51-1, 51-2 (S68).

Moreover, when only one sheet of bill is fed and the amount of bill is equal to that wanted as a result of discrimination, such one sheet of bill is transferred to the outlet port 91 from the returning transfer route 43 through the gates 51-1, 51-2, 51-6, 51-3 (S69).

This operation is,continued until the amount of bills transferred to the outlet port 91 matches the desired expensing amount requested by the expensing transaction (S70).

When the amount of bills requested to be dispensed is transferred to the outlet port 91, the outlet port 91 is rotated to move to the position enabling the customer to take up the bills from the bill inlet port 40 (S71).

After completion of movement of the outlet port 91, the shutter 54 opens (S72), urging the customer to take out the bills in the bill inlet port 40.

When it is detected that the bills are taken out (S72), the shutter 54 closes (S74), comleting the expensing transaction.

When the predetermined time has passed (S75) after starting the counting of time from such a timing that the shutter 54 opens reslting in the condition that the bills can be taken out, the outlet port 91 is rotated to move to the position where the bills in the outlet port 91 can be taken out (S77) after the shutter 54 is closed (S76).

After the outlet port 91 is moved to the feeding position, the feeding section 53 is rotated to feed sheet by sheet the bills in the outlet port 91 (S78).

The bills fed from the outlet port 91 are then transferred to the discriminating transfer route 41 and are the discriminated for true or false bills and denominations thereof in the discriminating section 57 (S79). Here, the discrimination is repeated in order to avoid generation of troubles with customers because when the bills are transerred to the outlet port 91 and the shutter 54 is opened, it is probable that the amount of bills dispensed to the outlet port 91 does not match the amount of bills taken out after these are once forgot because the bills are partly substituted by the other bills or are partly removed while the bills are maintained in the outlet port 91.

The discriminated bills are accommodated in the forgetting section 49 through the gates 51-1, 51-2, 51-6, 51-9 (S80), thereby completing the expensing transaction.

[Detailed Description of Each Mechanism]

[Shutter]

The shutter 54 is structed as described in the Japanese Utility Model Application No. 61-142750 (patent gazette of the Japanese Utility Model Application 63-53172) which have already been filed by the same applicant of the present invention and is now laid open.

That is, as shown in FIG. 1 of the above patent gazette, the shutter 54 comprises a shutter 1, an elongated hole 11 provided on the shutter, a pulse motor 5 for opening or closing the shutter 1, a lever 2 which is rotated by the pulse motor 5, having a stad 10 at the end part thereof being engaged with the elongated hole 11 and swaying therein and a spring 12 which energizes the lever 2 only in one direction.

The laid-open patent gazette is different from the present invention in the point that the former uses a pulse motor 5 as a driving source for opening or closing the shutter 11, while the latter uses a DC motor as the driving source for opening and closing the shutter 1, but these patents are same in the other points.

Therefore, in view of opening the shutter 54, MPU60 shown in FIG. 6 of the present invention drives and rotates first the DC motor in the direction for opening the shutter. With this rotating force, the lever 2 rotates to move the enlongated hole 11 with which the stad 10 is engaged and also move the shutter 1 in the opening direction.

The shutter 1 moves up to the position of the stopper 3 to open itself.

In the case of closing the shutter 1, the shutter 1 is moved to the closing direction when the motor stops or the motor is moved in the inverse direction and stops at the shutter closing position and is held in this position.

[Structure of Bill Inlet Port]

The bill inlet port 40 comprising a bill outlet port 91, a feeding section 53 and a presser 92, etc. will be explained with reference to FIG. 12 to FIG. 19.

Figure 12:
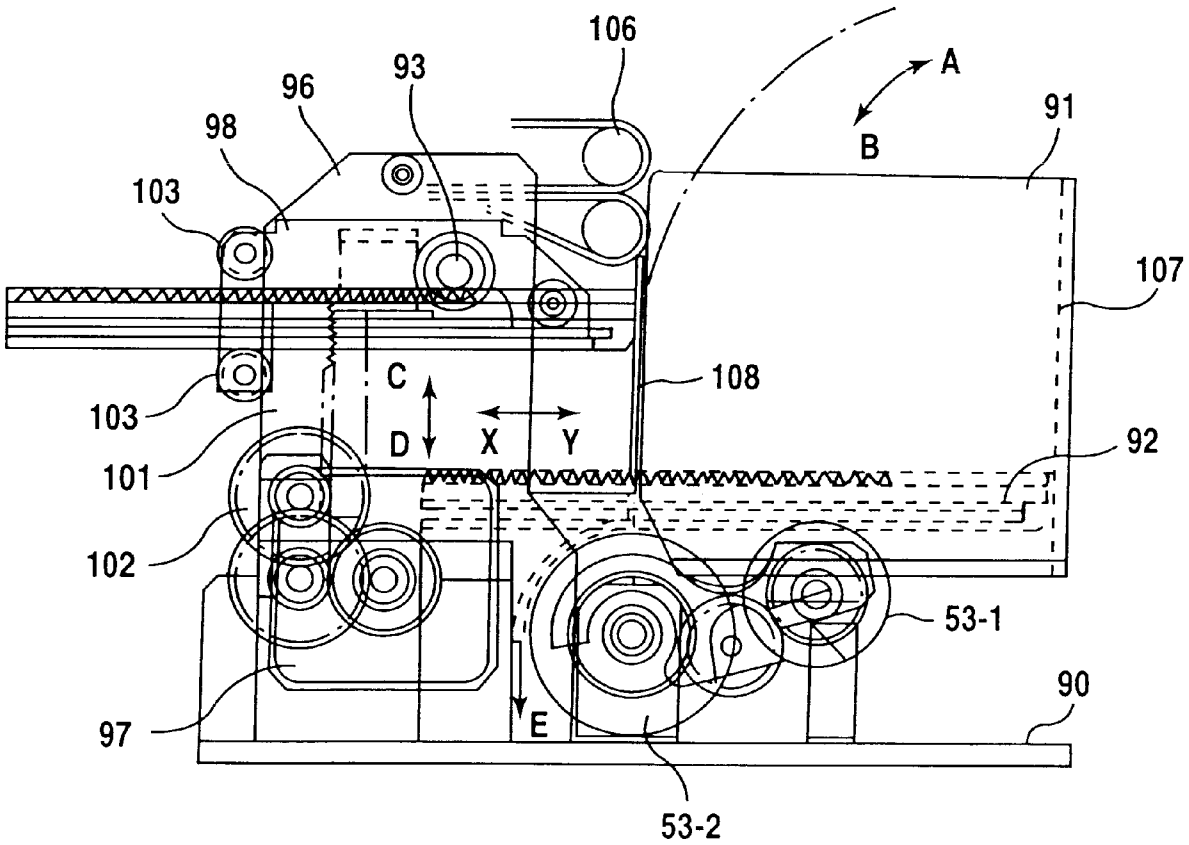
FIG. 12 is a side elevation of a bill inlet/outlet port.
Figure 13:
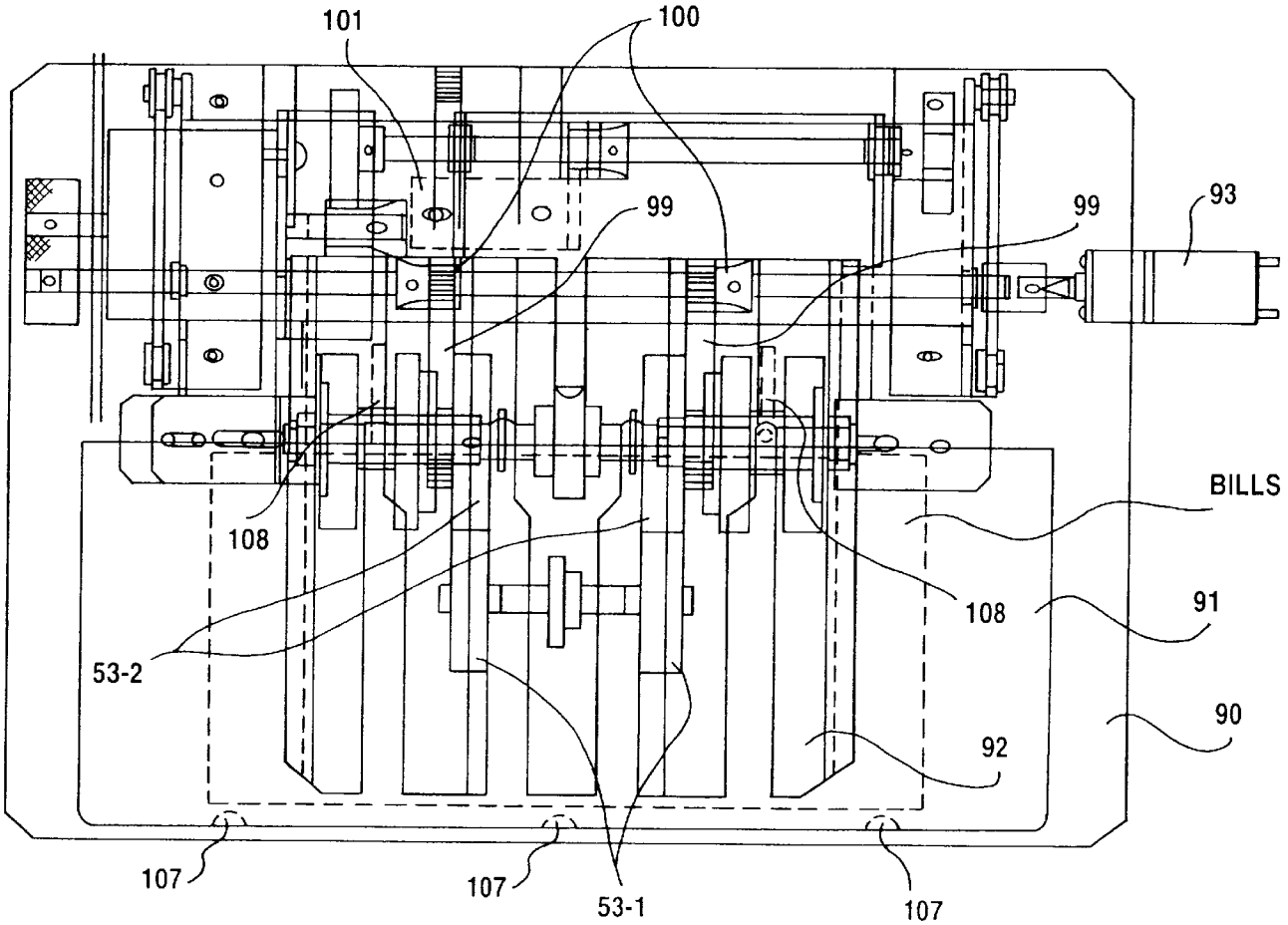
FIG. 13 is a plan view of a bill inlet/outlet port.
Figure 14:
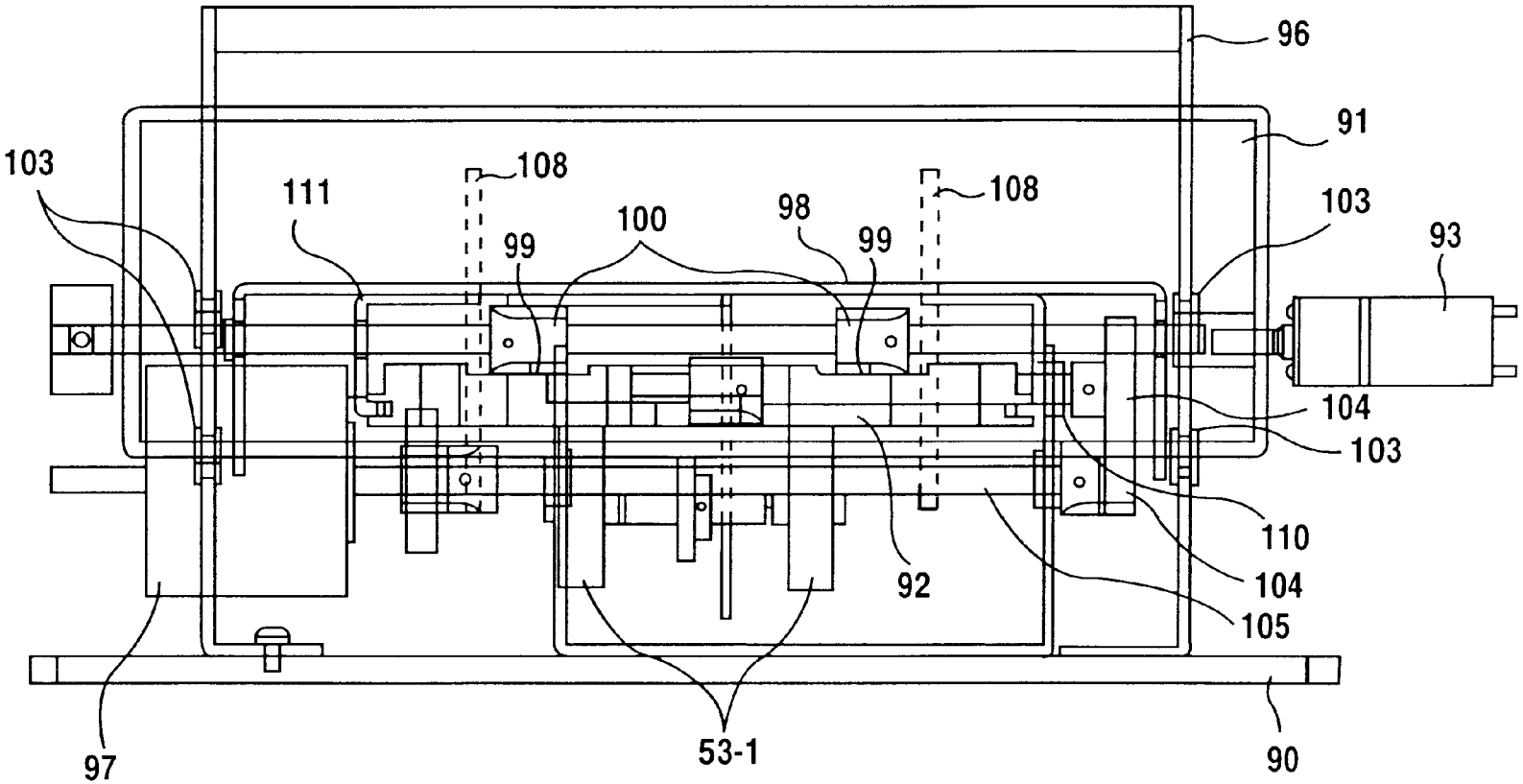
FIG. 14 is a front elevation of a bill inlet/outlet port.

FIG. 12 is a side elevation of the bill inlet port seen from the same direction as FIG. 5. FIG. 13 is a plan view of the bill inlet port seen from the upper part thereof 40. FIG. 14 is a plan view of the bill input port 40 seen from the right side of FIG. 12 and FIG. 5.

Pulse motors which are controlled by MPU 60 of FIG. 6 are used as the presser motor 93, vertical moving motor 97, a motor (not illustrated) for rotating the pick roller 53-1 or feed roller 53-2 and a motor (not illustrated) for rotating the drive gear 122.

Moreover, the sensors for detecting transfer or existence of the bills, that is, the sensors 63 are provided at respective areas of the bill inlet port 40. This sensor is an optical sensor including a light emitting element and a photosensitive element. The light emitting element always emits the light, while the photosensitive element receives the light emitted by the light emitting element. A medium passes between this light emitting element and photosensitive element. Existence or not existence of the bills changes the amount of light received by the photosensitive element. Amount of light received is converted to an electrical output signal including high and low levels to detect existence of the bills. The sensors may be classified into the transparent type sensor where a light emitting element and a photosensitive element are arranged in both sides of the transfer route and the reflection type sensor where a light emitting element and a photosensitive element are arranged in the same side of the transfer route and the photosensitive element receives the reflected light beam of the light emitting element.

In the case of the receiving transaction, the outlet port 91 shown in FIG. 12 is moved in the direction of arrow mark A and is located to the position enabling the customer to input or take out the bills.

When the bills are inputted to the outlet port 91, the outlet port 91 is rotated in the direction indicatd by the arrow B to move to the position to enable the feeding of the bills.

When the outlet port 91 moves up to the feeding position, rotation of the outlet port 91 stops.

In this position, the pick roller 53-1, feed roller 53-2 are provided and these rollers rotate, in the case of FIG. 12, counterclockwise to feed the bills in the direction indicated J by the arrow mark E.

Moreover, a supporting guide 96 is fixed on a frame 90. This supporting guide 96 is provided with a presser guidel 98 movalbe in the vertical direction by means of an upper and lower roller 103.

This presser guide 98 supports the presser 92, presser motor 93, upper/lower rack 101 and forward/backward gear 100 and moves vertically with these elements in the direction indicated by the arrows C–D of FIG. 12.

The presser 92 is provided with the forward/backward rack 99 and a sliding groove 110. The forward/backward rack 99 engages with a forward/backward gear 100 provided on the shaft of the presser motor 93 to move forward and backward the presser 92 in the direction indicated by the arrow X–Y of FIG. 12 by driving the presser motor 93. In this case, the sliding groove 110 engages with a sliding piece 111 which is a part of the presser guide 98 and therefore the presser 92 moves forward and backward (in the direction of arrows X–Y of FIG. 12) along the sliding piece 111 of the presser guide.

Moreover, the upper/lower rack 101 provided on the presser guide 98 engages with the upper/lower gear 102 coupled with the vertical moving motor 97 to drive this motor 97 in view of vertically moving the puressure guide 98, followed by vertical movement of the presser 92. The vertical moving motor 97 is coupled with the upper/lower gear 102 through the upper/lower shaft 105 and coupling gear 104 and coupling the motor 97 and gear 102 via the coupling gear 104 transfers rotating force of the vertical moving motor 97 to the upper/lower gear 102 through step-down of the rotating speed thereof. Moreover, the speed of vertical movement of the presser 92 can be adjusted through the upper/lower gear 102 and upper/lower rack 101, preventing high speed movement of the presser 92.

With the structure explained above, the presser 92 moves forward, stops in such a condition as being projected into the outlet port 91 and then moreover moves vertically.

In FIG. 12 and FIG. 14, the bill inlet port 40 is provided horizontally, but actually it is inclined by about 30 degrees with the right side lowered in FIG. 5. This structure is provided to prevent foreign matters included (coins or clips, etc.) to be fed together with the bills. Namely, when the bottom section 107 of the outlet port 91 is formed lower than the port of the outlet port 91 from which the bills are inputted and the bottom section 107 is formed in the shape of lattice, foreign matters may be exhausted to the outside of outlet port 91 from the bottom section 107, thereby eliminating a cause of fault such as jamming of foreign matters in the transfer route. Accordingly, the apparatus can be freed from stoppage of operation due to foreign matters. Particularly, the apparatus installed in the area where a person in charge is not attendant can be freed from manipulation for eliminating foreign matters and thereby wording efficiency of the apparatus can be as much improved.

Moreover, when a foreign matter can be returned to a customer by providing a returning port and a transfer means for transferring it to the returning port, for example, a foreign matter returning path, a foreign matter can be surely returned to a customer who has errorneously inputted a foreign matter other than the bill to the outlet port 91. Thereby, a person in charge is no longer need to be called by a customer and the apparatus, if it is installed in the area where a person in charge is not attendant, is capable of returning the foreign matters to customers, realizing an improvement of services to customers.

In view of preventing a dischargre of the bills from the outlet port 91 when the outlet port 91 is moved to the feedible position, a bill guide 108 is provided to prevent a discharge of the bills. Namely, when the presser 92 is provided in the shape of comb as shown in FIG. 13, a bar type guide is provided at the position with which the recessed portion of the pressure 92 may be engaged when the presser 92 has moved forward and moreover one end of the bill guide 108 regulates the bill feeding direction of the feed roller 53-2, the presser can also be used as the guide, improving cost reduction.

In addition, when the outlet port 91 is located at the feeding position, the bills transferred to the returning transfer route 43 from the apparatus can be sent to the outlet port 91 by way of the feeding section 106.

Accordingly, the bills inputted to the outlet port 91 by a customer at the time of receiving transaction are feds, transferred by the discriminating transfer route 41 and discriminated by the discriminating section 57. Here, the bills not discriminated as the true bills as a result of discrimination can be returned to the outlet port via the returning transfer route 43 and feeding section 106. Therefore, since a structure for temporarily storing the bills to be returned may be ruled out and the feeding of the bills to be returned from the structure for temporarily storing these bills is also no longer necessary, the returning operation of the bills can be realized at a high speed and manipulation speed of the transactions can also be improved.

The outlet port 91 operates as shown in FIG. 15 to FIG. 19 and also executes the rotating operation.

The outlet port 91 comprises a drive gear 122, a drive link 123, a projected portion 124, an engaging portion 125, a Geneva 120, a Geneva sliding portion 121, a cutout portion 126, a rotating roller 127 and a rotating shaft 128. Moreover, the drive gear 122 is rotated in the direction indicated by the arrows F–G through a belt (not illustrated) by the pulse motor 65 shwon in FIG. 6.

The drive shaft 128 of the drive gear 122 is rotatably fixed to the frame (not illustrated). The drive link 123 is fixed to the drive gear 122 and rotates coaxially with the drive gear 122 and is also provided with the projected portion 124 at the end portion thereof.

The outlet port 91 is provided with the engaging portion 125 which is to be engaged with the projected portion 124 of the drive link 123. Moreover, the outlet port 92 is rotatably provided with a plurality (two, in this embodiment) of rotating rollers 127 fixed thereto.

In addition, the Geneva 120 is also provided in the outlet port 91. This Geneva 120 comprises the Geneva sliding portion 121 and the cutout portion 123. Thereby, the rotating roller 127 rotatably fixed to the outlet port 91 is capable of sliding within the groove of the Geneva sliding portion 121 and the cutout portion 125 engages with the drive link 123.

[Rotating Operation of the Outlet port to the Feeding Position from the Inputting Position]

First, when the bills to the outlet port 91 are moved to the feeding position (indicated in FIG. 19) from the takeup position (indicated in FIG. 15), the motor (not illustrated) is driven to rotate the drive gear 122 in the direction indicated by the arrow G in the figure.

When the drive link 123 also rotates together with the drive gear 122 in the direction indicated by the arrow G, the outlet port 91 alsmo moves in the direction indicated by the arrow H with its self weight. In this case, when the outlet port 91 is energized in the direction indicated by the arrow H with a means having an energizing force such has a spring, etc., the outlet port 91 can be moved quickly and surely in the direction indicated by the arrow H.

With movement of the outlet port 91, the rotating roller 127 slides within the Geneva sliding portion 121. Moreover, when the drive gear 122 rotates, the projected portion 124 of the drive link 123 engages with the cutout portion 125 of the Geneva 120 (indicated in FIG. 16).

When the drive gear 122 further rotates, the drive link 123 rotates while the projected portion 124 is engaged with the cutout portion 126. Therefore, the Geneva 120 rotates around the rotating shaft 128 in the direction indicated by the arrow J in FIG. 17.

Figure 17:
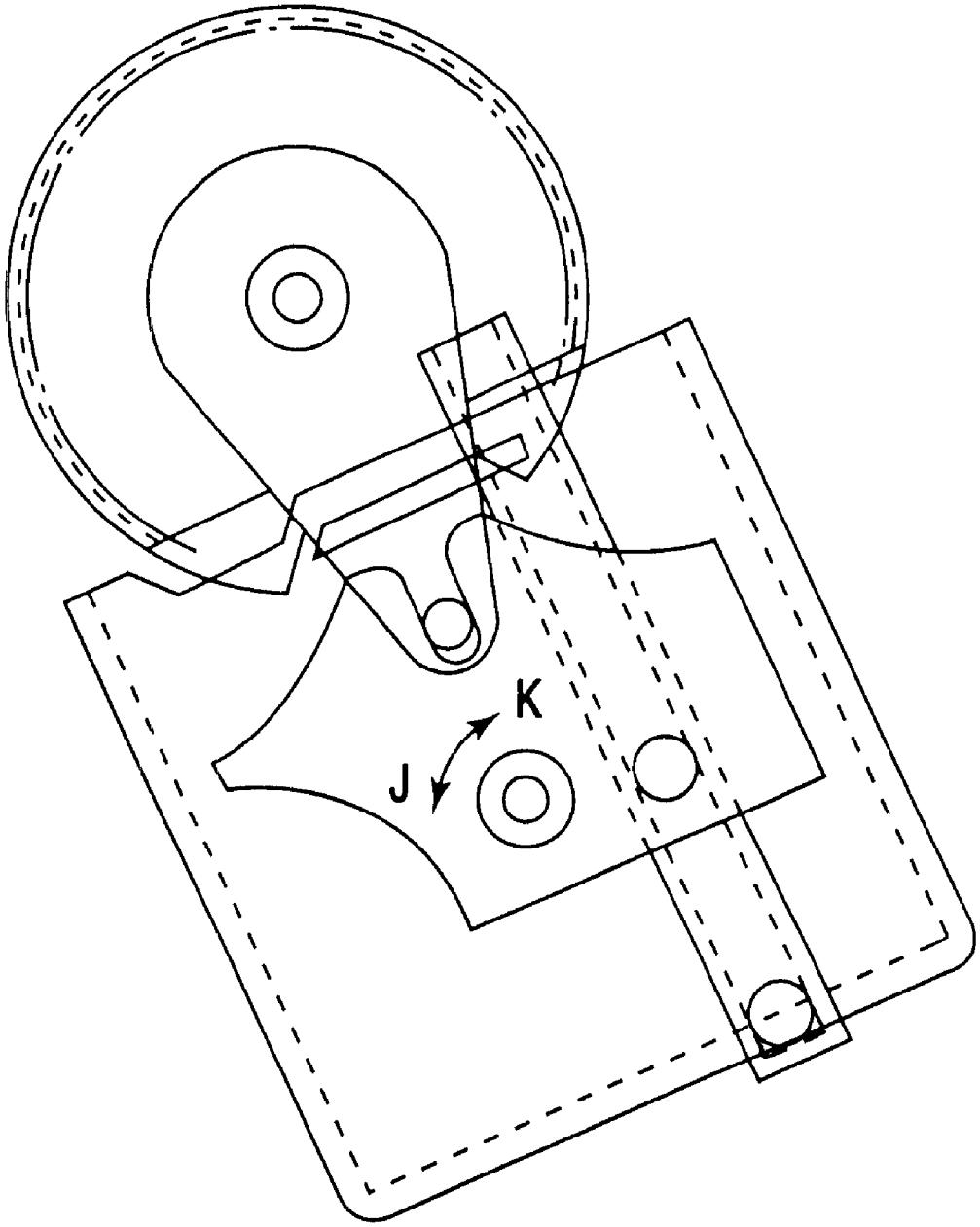

Since the rotating roller 127 of the outlet port 91 and the Geneva sliding portion 121 of the Geneva 120 are slidably fixed, the outlet port 91 also rotates with rotation of the Geneva 120 (indicated in FIG. 17).

Figure 18:
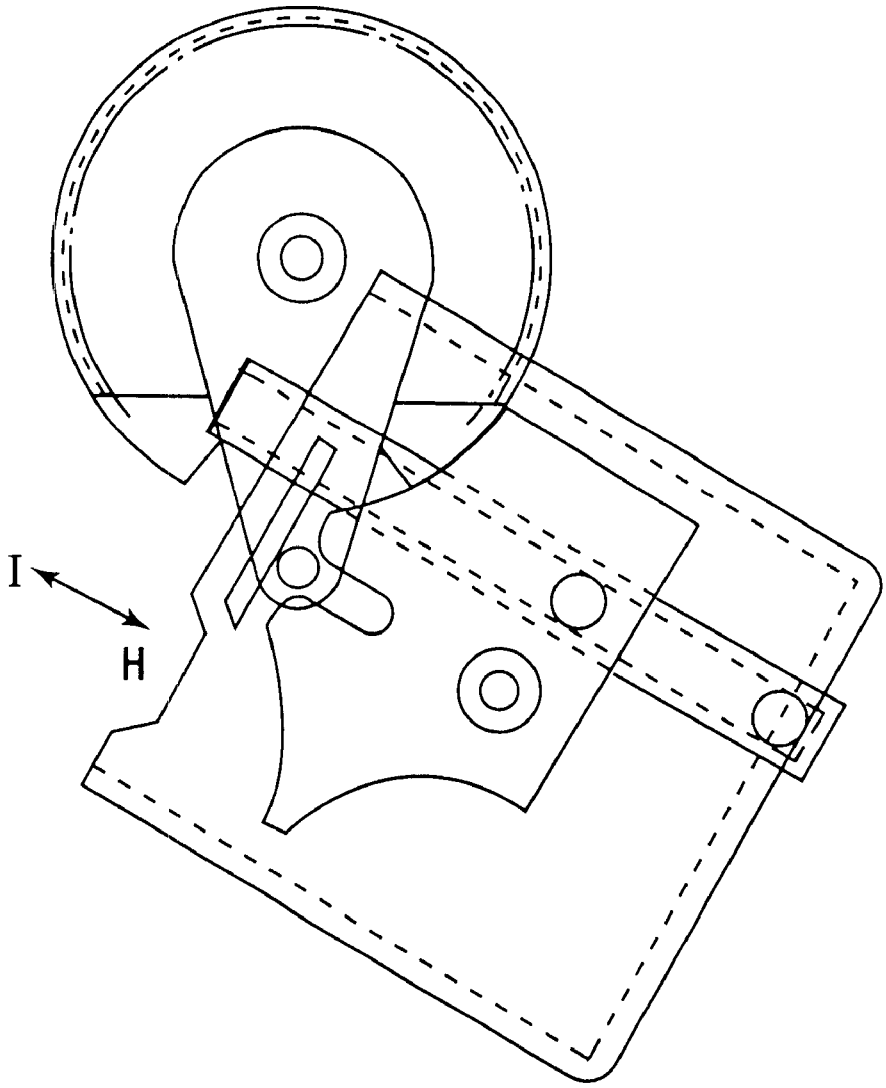

When the drive gear 122 rotaes to rotate the outlet port 91 up to the position indicated in FIG. 18, since engagement between the projected portion 124 of the drive link 123 and the cutout portion 126 of the Geneva 120 is broken, rotation of the outlet port 91 stops.

When the drive gear 122 rotates, the projected portion 124 engages with the engaging portion 125. Therefore, rotation of the drive gear 122 moves the outlet port 91 in the direction indicated by the arrow I of FIG. 18, namely in the direction toward the presser 92.

Figure 19:
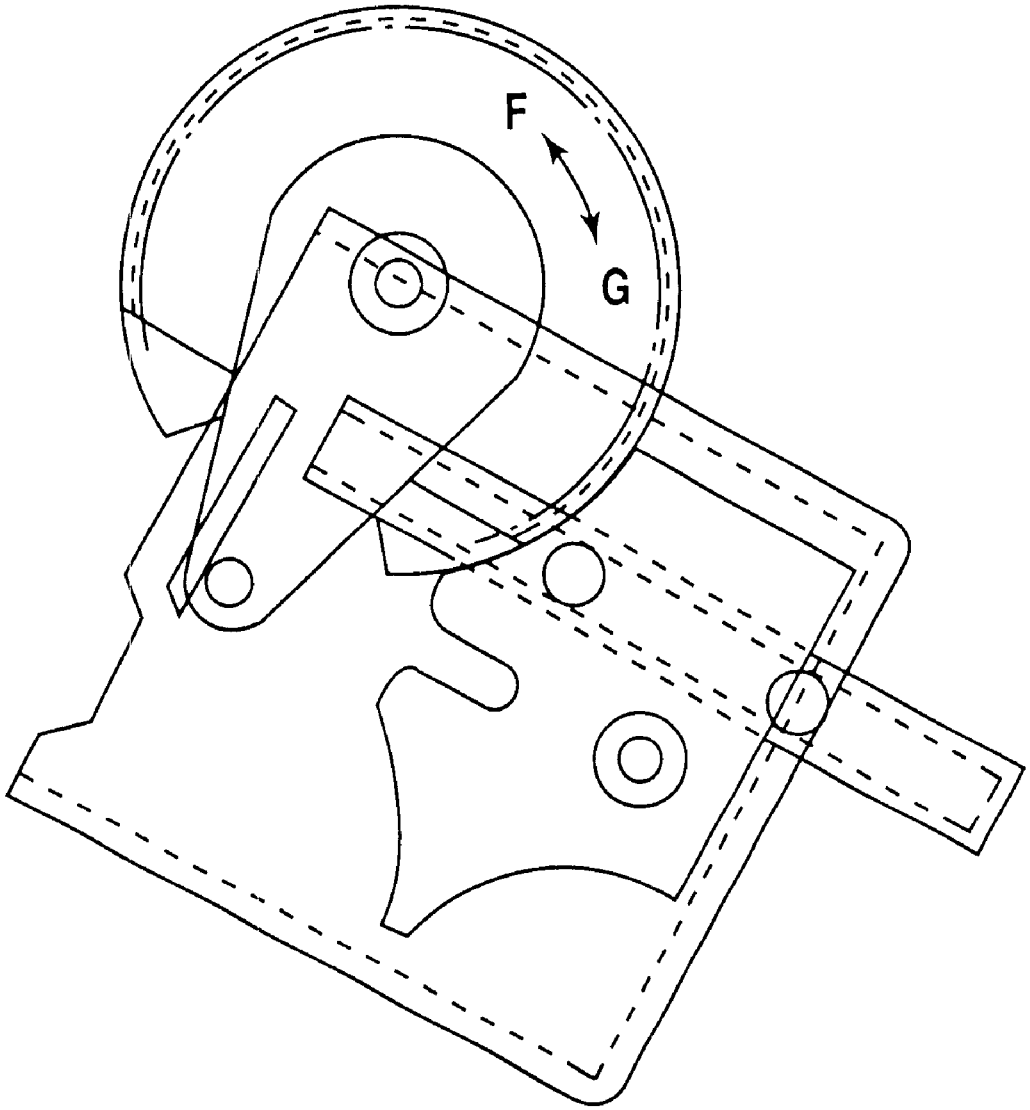

Whe rotation of the drive gear 122 stops, the outlet port 91 stops at the feeding position, namely at the position indicated in FIG. 19.

[Rotating Operation of the Outlet Port to the Inputting Position from the Feeding Position]

In the case of moving the bills fed from the outlet port 91 to the takeup position (indicated in FIG. 15) from the feeding position (indicated in FIG. 19), the motor (not illustrated) is driven to rotate the drive gear 122 in the direction indicated by the arrow F.

When the drive link 123 rotates in the direction indicated by the arrow F together with the drive gear 122, the outlet port 91 moves thereby in the direction indicated by the arrow H with its self weight. In this case, when the outlet port 91 is energized in the direction indicatd by the arrow H with a means having an energizing force such as a spring, the outlet port 91 can be moved quickly and surely in the direction indicated by the arrow H.

Movement of the outlet port 91 causes the rotating roller 127 to slide within the Geneva sliding portion 121.

Moreover, when the drive gear 122 rotates, the projected portion 124 of the drive link 123 engates with the cutout portion 126 of the Geneva 120 (indicated in FIG. 18).

When the drive gear 122 is further rotated, the drive link 123 rotates while the projected portion 124 is engaged with the cutout portion 126. Therefore the Geneva 120 rotates around the rotating shaft 128 in the direction indicated by the arrow K of FIG. 17.

Since the rotating roller 127 of the outlet port 91 and the Geneva sliding portion 121 of the Geneva 120 are slidably fixed, the outlet portion 91 is rotated with rotation of the Geneva 120 (indicated in FIG. 17).

Figure 16:
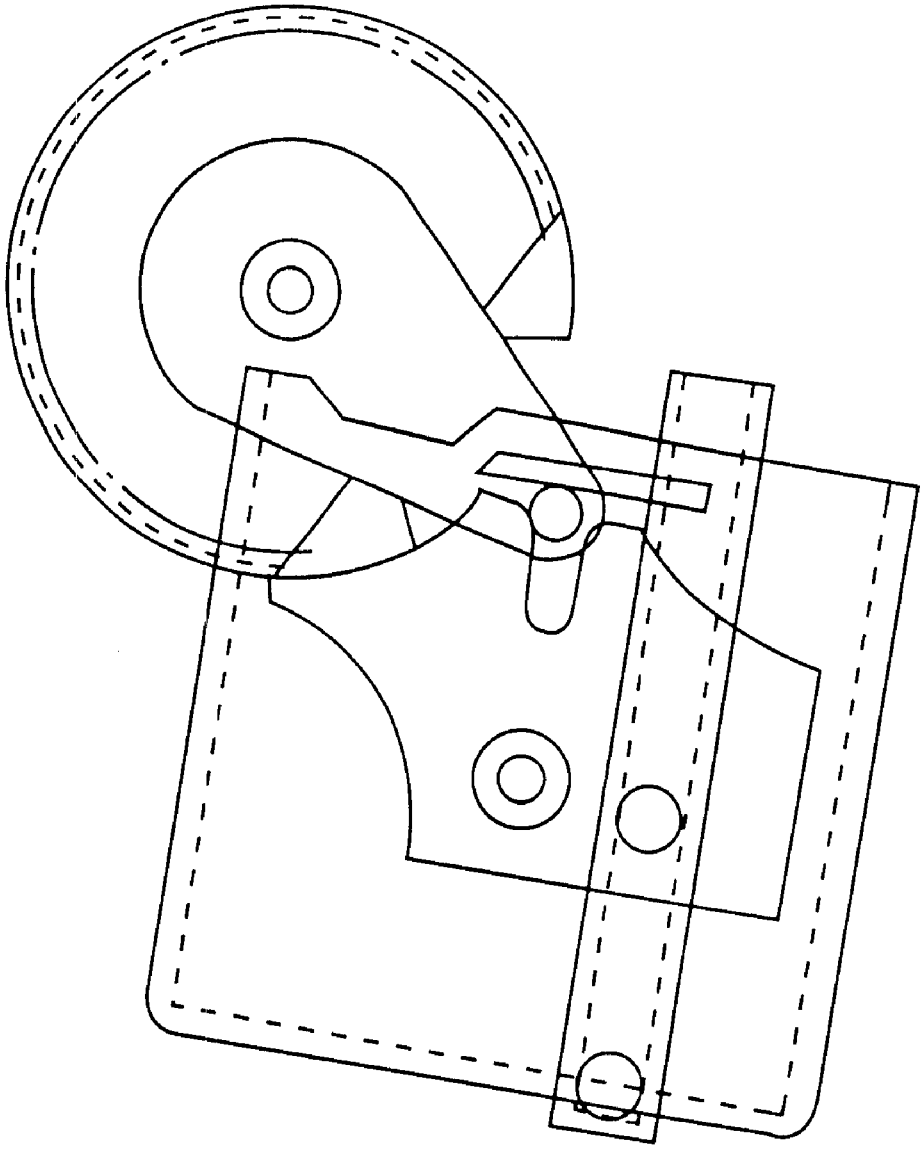

When the drive gear 122 further rotates to rotate the outlet port 91 up to the position indicated in FIG. 16, engagement between the projected portion 124 of the drive link 123 and the outout portion 126 of the Geneva 120 is broken, thereby rotation of the outlet port 91 stops.

When the drive gear 122 further rotates, the projected portion 124 engages with the engaging portion 124.

Thereby, with rotation of the drive gear 122, the outlet port 91 moves in the direction indicated by the arrow I of FIG. 15, namely, in the direction toward the shutter 54.

When rotation of the drive gear 122 stops, the outlet port 91 stops at the bill takeup position while the shutter 54 is opened, that is, at the position indicated in FIG. 15.

With its structure, the outlet port can be surely moved, within a small space, between the bill input/output position and the positon in the outlet port where the bills may be fed. Namely, when the outlet port is rotated around the shaft provided as the center of roation thereof, the corner of the outlet port comes in contact with the takeup portion or the bill guide, etc., interfering movement of the outlet port.

Therefore, the structure explained above enables smooth movement of the outlet port 91.

[Operation of Bill Outlet Port in the Receiving Transaction]

For the receiving transaction, the outlet port 91 is located to the position shown in FIG. 15, namely, to the position in the outlet port 91 where the bills can be taken out or the bills can be inputted.

The bills can be inputted for the receiving transaction by opening the shutter 54.

When the bills are inputted to the outlet port 91, the shutter 54 closes, a motor (not illustrated) is driven to rotate the drive gear 122. Thereby, the outlet port 91 can be moved up to the position indicated in FIG. 19.

When the outlet port 91 moves to the feeding position, the presser motor 93 is driven to rotate the forward/backward gear 100. The presser 92 is moved in the direction indicated by the arrow Y with the forward/backward gear 100 and forward/backward rack 99.

The presser 92 is moved in the direction indicated by the arrow Y and driving of the presser motor 93 is stopped at the position where the end portion of the presser 92 is closed to the bottom portion 107 of the outlet port 91 to stop the movement of the puressure 92.

After the movement of the presser 92 is stopped, the upper/lower moving motor 97 is driven to move the upper/lower rack 101 through the upper/lower gear 102 and move the presser guide 98 in the direction indicated by the arrow D. Thereby, the presser 92 is moved in such a direction that the bills are pushed against the pick roller 53-1, feed roller 53-2. In view of pressing the bills with the predetermined presser, the upper most position of the bills inputted to the presser 92 and outlet port 91 and stacked in the outlet port 91 are detected by sensors to determine the position of the presser 91. Thereby, friction between the pick roller 53-1 and the bills becomes optimum and the bills can be surely fed with the pick roller 53-1. Moreover, the effect similar to that of the method for detecting the position of presser with the sensors explained above can also be obtained by providing a one-way clutch which slips when the predetermined pressure is applied between the upper/lower moving motor 97 and and the upper/lower gear 102 so that when the presser 91 tries to push the bills with the pressure higher than the predetermined pressure, slip occurs between the upper/lower moving motor 97 and the presser 92 protecting the bills from application of the pressure higher than the predetermined pressure.

When the presser 92 moves, pushing the bills against the pick roller 53-1, feed roller 53-2, the bills are fed sheet by sheet in the direction indicated by the arrow E by rotating the pick roller 53-1 and feed roller 53-2 counterclockwise in FIG. 12 with a motor (not illustrated). This motor is also one of the pulse motors 65 shown in FIG. 6.

The bills fed are transferred sheet by sheet to the discriminating section 57 through the discriminating transfer route 41 and are then discriminated.

The bills which are not discriminated as the true bills by the discriminating section 57 are fed to the outlet port 91 by the feeding section 106 through the returning transfer route 43 and are then stacked at the upper part of the presser 92. That is, there are bills used for receiving transaction inputted in the side of the pick roller 53-1 and feed roller 53-2 and there are bills which are already discriminated in the opposite side in both sides of the presser 92.

When all bills are fed by the pick roller 53-1 and feed roller 53-2, the presser 91 moves up to the position indicated by a broken line in FIG. 12. Thereafter, the presser 92 is moved in the direction indicated by the arrow X by driving the upper/lower moving motor 97 and presser motor 93 up to the position where the presser 92 is no longer projected to the outlet port 91.

Since the bills on the presser 92 collides with the bill guide 108, these bills are left in the outlet port 91 without being released from the outlet port 91 and are then stacked in the outlet port 91.

When the presser 92 moves up to the position where it is not projected to the outlet port 91 and thereafter the upper/lower moving motor 97 is driven, the presser 92 moves in the direction indicated by the arrow C, that is, in the direction opposite the pushing direction and is located in the predetermined position to quickly ensuring the next pressing operation.

After the presser 92 is moved in the direction indicated by the arrow X so that the presser 92 is no longer projected to the outlet port 91 and is then moved in the direction indicated by the arrow C, that is, in the direction opposite the direction to press the bills. Thereby, since the bills are fallen into the outlet port from the lower position from the upper part of the presser 92, the bills may be left orderly within the outlet port 91.

When the presser 92 is drawn back, the motor not illustrated is driven to rotate the drive gear 122 to locate the outlet port 91 to the position of FIG. 15, that is, to the position enabling feeding of the bills therefrom when the shutter 54 is opened.

When the shutter 54 opens, the instruction urging a customer to take up the bills is displayed on the customer operation panel 22 and the customer takes up the bills, operations of the bill inlet port 40 is completed.

If the bills are not taken out or the bills are inputted again, the operation explained above, where shutter is closed again, the outlet port 91 is rotated, and the presser 92 is moved in the direction to press and feed the bills ng these, are repeated for several times. When the predetermined bills to be returned still exist even after repeating the above-mentioned operations for the predetermined number of times, the receiving transaction is suspended and the bills taken up precedingly are transferred to the outlet port 91 and returned to the customer, preventing that the apparatus is occupied by mischieves.

Therefore, the bills inputted to the outlet port 91 by a customer at the time of receiving transaction are fed by the structure and operation explained above, discriminated by the discriminating section 57 and the bills not discriminated as the true bills can be returned to the outlet port via the returning transfer route 43 and the feeding section 106. Accordingly, the structure for temporarily storing the bills to be returned is no longer necessary and feeding of the bills from the mechanism for temporarily storing the bills to be returned is naturally no longer necessary. Thereby, the returning operation of the bills can be realized at a high speed and moreover manipulation speed of the bills for transaction can also be improved.

[Operations of Bill Outlet Port in the Expensing Transaction]

For the expensing transaction, the outlet port 91 is located to the feeding position, that is, the position of FIG. 19 for feeding the bills in the outlet 91 with the pick roller 53-1 and feed roller 53-2.

In addition, the presser motor 93 is driven, causing the presser 92 to be projected in the outlet port 91. In this case, the presser 92 is located at the predetermined position in the direction indicated by the arrows C–D of FIG. 12. That is, since the outlet port 91 has the width for accommodating the bills of about 500 sheets, when the bills are inputted into the outlet port with the takeup section 106 without projecting the presser 92 in the outlet port 91, the bills taken up are fallen naturally for a longer period and cannot be stacked orderly. In view of orderly accommodating the bills in the outlet port 91, the presser 92 is projected in the outlet port 91 to form a space suitable for accommodation of the bills by means of the takeup section 106. This space may be preset and can be formed actually by moving the presser 92 in the direction indicated by the arrows C–D of FIG. 12 with the upper/lower moving motor 97.

The the presser 92 is projected in the outlet port 91, the takeup section 106 takes up sheet by sheet the bills into the outlet port 91.

The bills to be taken up into the outlet port 91 by the tekeup section 106 are detected by the sensor (not illustrated) in FIG. 12 and MPU 60 counts up the number of sheets of the bills. Depending on the number of sheets accommodated in the outlet port 91, the upper/lower moving motor 97 is rotated to move the presser 92 downward, that is, in the direction indicated by the arrow D of FIG. 12 in order to provide a gap between the presser 92 and the outlet port 91. Thereby, the space for accommodating the bills fed from the takeup section 106 becomes always constant and can orderly accommodates the bills.

The bills in such amount designated by the customer are taken up into the outlet port 91, the takeup section 106 stops and moreover the presser motor 93 is driven to move the presser 92 in such a direction as is not projected in the outloet port 91 through the forward/backward gear 100 and forward/backward rack 99, that is, in the direction indicated by the arrow X of FIG. 12.

When the presser 92 moves to the position where it is not perfectly projected in the outlet port 91, the drive gear 122 is rotated by a motor (not illustrated) to rotate the outlet port 91 and to open the shutter 54. Thereby, the outlet port 91 can be rotated up to the position where the customer can take up the bills, that is, up to the position indicated in FIG. 15.

Thereafter, the shutter 54 opens enabling the customer to take up the bills in the outlet port 91 and resulting in the codition that the bills in the outlet port 91 are ready for being taken up by the customer. In other words, existence of the bills can be detected by sensors (not illustrated) provided in the outlet port. When is is detected that the bills in the outlet port 91 are taken up, the shutter 54 closes, completing the expensing transaction.

The bills for expension transaction can be accommodated in direct in the outlet port 91 by the structure and control explained above and moreover the bills can also be stacked in the outlet port 91. Therefore, the bills can be accommodated quickly and orderly in the outlet port 91, realizing high speed expensing transaction and improvement of working efficiency of the apparatus.

[Explanation about Structure and Operation of Stacker]

The bills collected for every kinds of denominations and accommodated and dispensed for the expensing transaction and the bills deposited and recycled for dispensation are respectively accommodated in the stackers F, R 30-1, 30-2.

Structure and operation of the stacker will be explained with reference to FIG. 20 to FIG. 36.

FIG. 20 illustrates details of stacker feeding sections 56-1, 2 for feeding the bills accommodated in the stackers F, R 30-1, 30-2 of FIG. 5 and accommodating the bills transferred into the stacker. Moreover, a transfer belt 131 is provided as a transfer means above the stacker feeding sections 56-1, 2 to transfer the bills fed and transfer the bills to be accommodated in the stackers F, R 30-1, 30-2.

The stackers F, R 30-1, 30-2 have the same mechanism and thereofre only the stacker F 30-1 will be explained as an example.

The stacker F 30-1 is provided with a collecting section 58-1 for collecting the bills at the time of deposition. Moreover, it is also provided with a stage 59-1 for collecting the bills accommodated in the stacker F 30-1.

In the collecting section 58-1, the bills discriminated by the discriminating section 57 as those which can be taken up among the bills inputted to the outlet por 91 for the receiving transaction to input the bills, that is, the true bills having no damage and can be recycled for the expensing transaction can be collected. With this collecting section 58-1, the bills taken up at the time of receiving transaction are separated from the bills accommodated in the stacker F 30-1. The bills collected ini the stacker F 30-1 is separated from the bills inputted at the timeof receiving transaction because if the receiving transaction is suspended in the course of transaction, the resultant trouble must be avoided by surely returning the bills inputted to the outlet port 91 to the customer.

Moreover, at the time of expensing transaction, this collecting section 58-1 is drawn back, the stage 59-1 is moved upward, and the bills on the stage 59-1 are pressed to the stacker feeding section 56-1 and are then fed sheet by sheet and finally transfserred to the outlet port 91 through the transfer belt 131, discriminating transfer route 41 and returning transfer route 43.

[Explanation about Operations of Stacker During Receiving Transaction]

Figure 22:
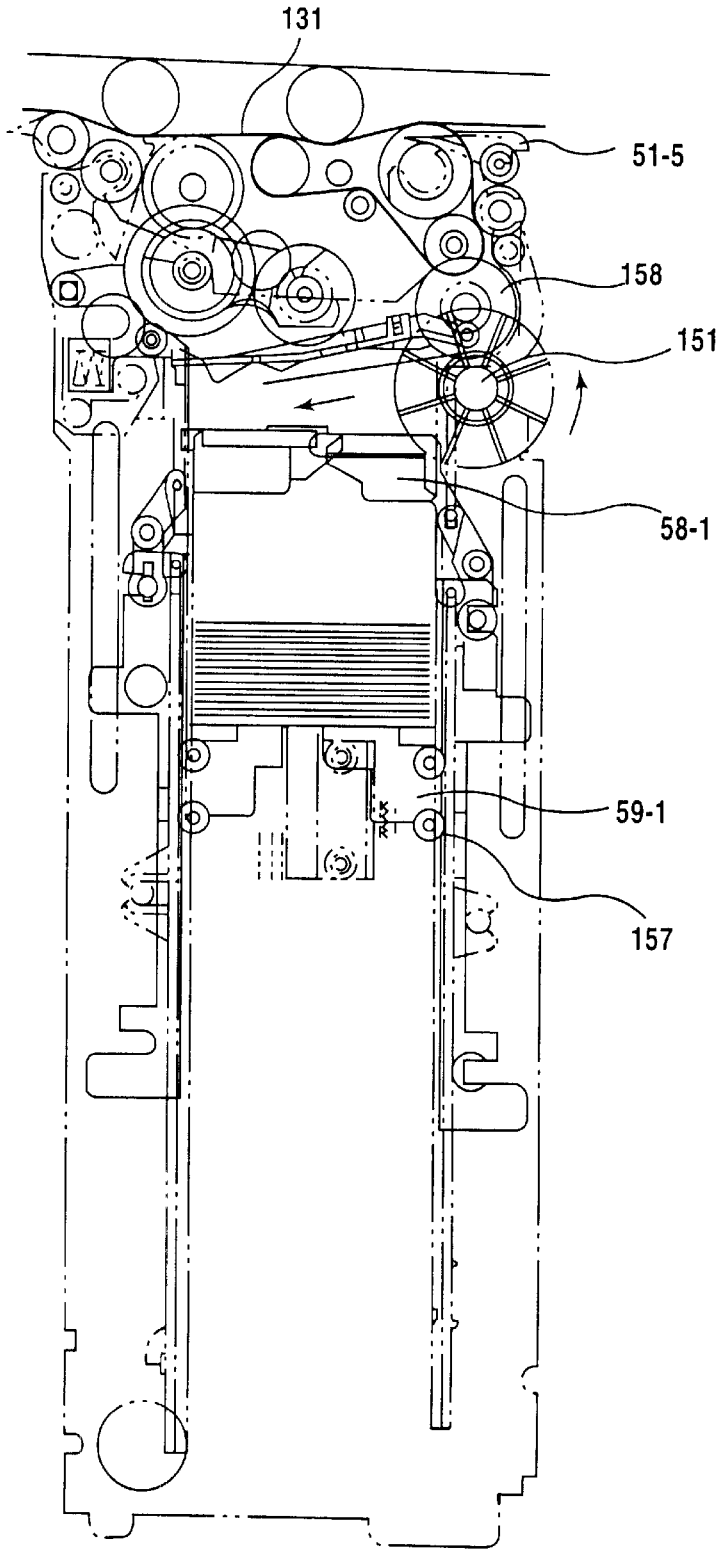
FIG. 22 is a diagram showing the bill receiving operation of a stacker.

For executing the receiving transaction, each stacker reserves a space for collecting the bills inputted as shown in FIG. 22 to set up the bill receiving condition.

Namely, the collection section 58-1 is located, by the collecting section moving motor 133, to the position for collecting the bills inputted. This position is the predetermined position and if the collecting section 58-1 is located excessively to the lower position, the bills may be collected disorderly. Meanwhile, if the collecting section 58-1 is located excessively to the higher position, the front end part of the bills to be collected next collides with the rear end part of the bills already collected on the collecting section 58-1. In order to avoid such phenomenon, the collecting section 58-1 must be frequently moved downward. For this purpose, the collecting section moving motor 133 must resultantly be controlled, making difficult the control. Therefore, the collecting section 58-1 is located to the position which has been obtained on the basis of experiment or experience. When the lowest position is set for orderly collecting the bills in order to make less the downward movement of the collecting section 58-1, the bills can be collected orderly and control can also be simplified.

The collecting section moving motor 133 is provided with a collecting section moving belt 135 through the collecting section moving gear 136 and this belt 135 causes the collecting section 58-1 to vertically move. Moreover, since both collecting section moving belt 135 and the collecting section moving gear 136 have the gear structure, any slip is not generated and the collecting section 58-1 canbe moved vertically.

The bills inputted to the outlet port 91 are discriminated by the discriminating section 57 and are transferred to the right from the left in FIG. 20, namely, in the direction indicated by the arrow L by the transfer belt 131 which is driven by the transfer motor 61.

This transfer motor 61 drvies, only with one motor, the discriminating transfer oute 41, accommodating transfer route 42, returning transfer route 43, cassette transfer route 44 and transfer belt 131. Thereby, since the transfer route can be driven only with one motor, the drive mechanism of the transfer route can be offered economically. Moreover, a shaft which is rotated by the transfer motor 61 is provided with a clutch 143 throug which the power of the transfer motor 61 can be transmitted to the transfer belt 131, takeup roller 158, vane wheel 151, pick roller 138 and feed roller 139. The clutch 143 can be selected to the condition to idly rotate against the shaft and to rotate synchronously with the shaft depending on the instruction issued. That is, in such a condition to idly rotate against the shaft, the power of the transfer motor 61 is no longer transmitted to others and therefore the transfer belt 131, takeup roller 158, vane wheel 151, pick roller 138 and feed roller 139 are not rotated. Moreover, in the condition to rotate synchronously with the shaft, the power is transmitted to the other elements via the clutch 143 and therefore the transfer belt 131, takeup roller 158, vane wheel 151, pick roller 138 and feed roller 139 are rotated.

Depending on the discrimination result in the discriminating section 57, the gate 51-5 moves in the direction indicated by the arrow M, namely to the position projected into the transfer route in which the bills are transferred. This operation is carried out by a plunger magnet 64 shown in FIG. 6.

That is, it is previously determined that the ¥10000 bills are accommodated in the stacker F 30-1, while the ¥1000 bills in the stacker R 30-2.

Therefore, when the discriminating section 57 discriminates a bill as the ¥10000 bill, it must be accommodated in the stacker F 30-1. Accordingly, if a ¥10000 bill is transferred by the accommodating transfer route 42 and the transfer belt 131, the gate 51-5 operates to accommodate the bill to the stacker F 30-1 and then collects the bill in the collecting section 58-1 through the takeup roller 158, vane wheel 151 and vane whee side roller 151-2. Here, a vane wheel is used for taking up the bills into the stacker because the bills are surely sent to the stacker and moreover press the bills downward. Namely, in the case of taking up the bills into the stacker, the vane wheel 151 pushes the rear end part of the bills causing the front end part of the pushed bills to collide with the wall provided against the takeup side of the stacker. When the front end part of bills collides with the wall, the vane wheel 151 further rotates, pushing the rear end portion of the bill downward and quickly and surely collecting the bill on the collecting section 58-1.

Horeover, a vane wheel side riller 151-2 which rotates coaxially with the vane wheel 151 is also provided in order to hold a bill and accommodate it into the stacker in combination with the takeup roller 158.

This takeup operation is executed continuously until the bills inputted to the outlet port 91 are all fed, discriminated and are distributed to each accommodating position.

At the takeup position of the collecting section 58-1, a sensor is provided to detect the bills taken up into the collecting section 58-1 and thereby the number of sheets of the bills collectd in the collecting section 58-1 is counted up. When the bills collected in the collecting section 58-1 are counted up to the predetermined number of sheets, the collecting section 58-1 is moved downward, keeping the space for taking up the bills to the predetermined interval, to orderly collect the bills.

When the bills in the outlet port 91 are all taken up and a customer has selected continuation of transaction, the bills collected on the collecting section 58-1 are collected on the bills already collected in the stage 59-1.

Figure 23:
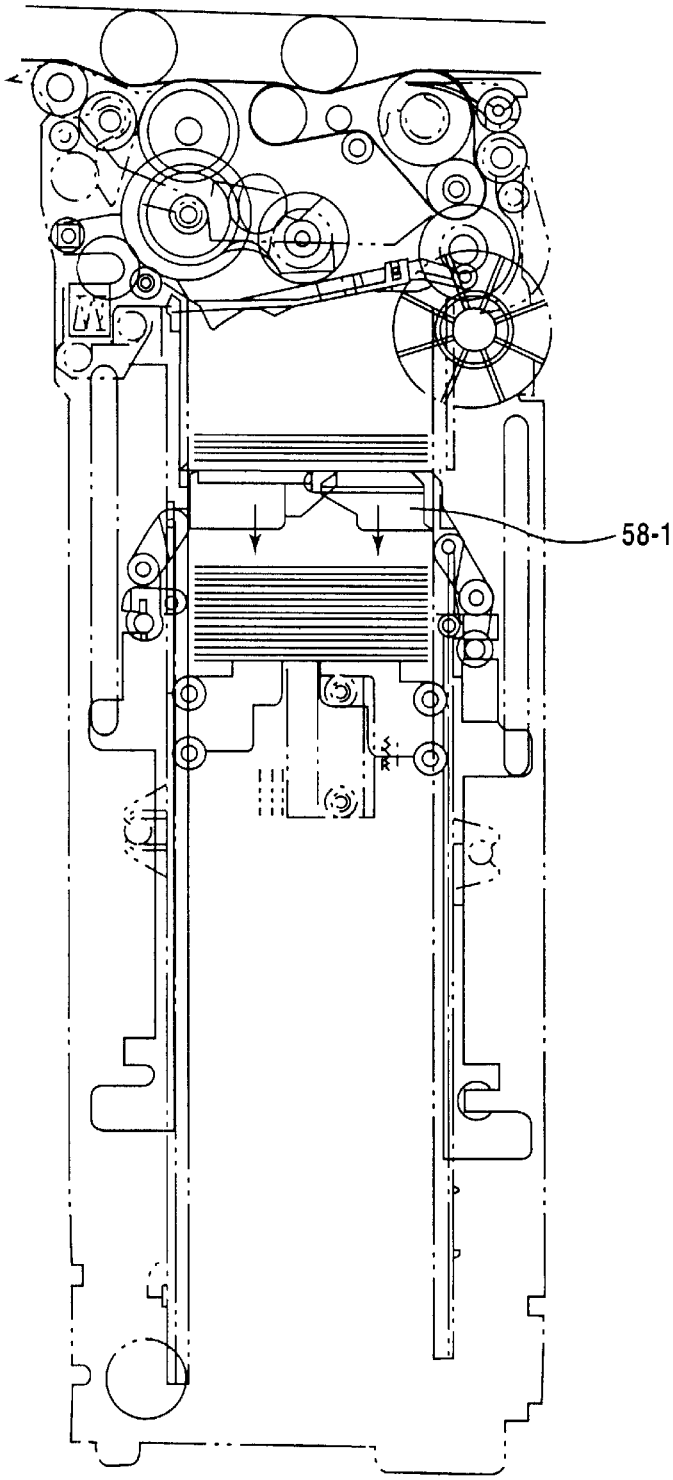
FIG. 23 is a diagram showing operation for accommodating the bills to a stacker from a collecting section.

Therefore, the collecting section 58-1 moves downward as shown in FIG. 23.

That is, the collecting section moving motor 133 is driven to move downward the collecting section 58-1 up to the position where the bills can be fallen on the bills collected in the stage 59-1.

Figure 24:
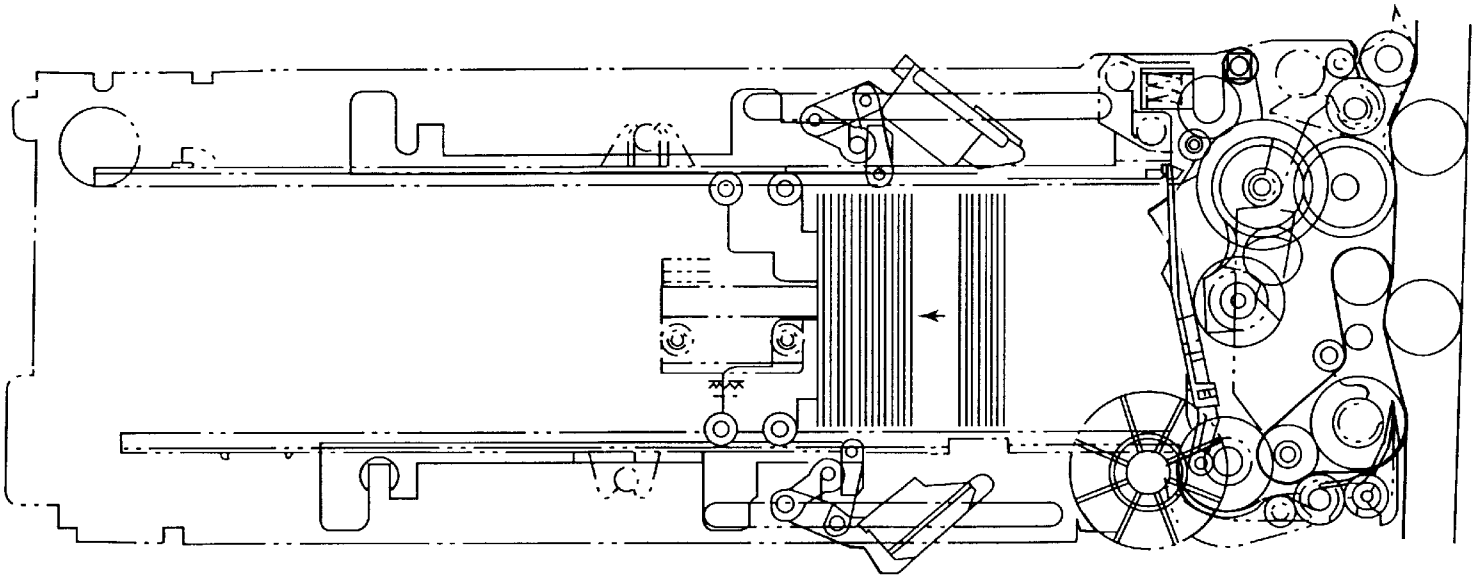
FIG. 24 is a diagram showing the condition where the bills in the collecting section are fallen into a stacker.

Accordingly, this position ensures orderly stacking of the bills even when these are fallen onto the collecting section 58-1. The bills on the collecting section 58-1 can be fallen on the bills collected in the stage 59-1 by opening the collecting section 58-1 to the right and left sides as shown in FIG. 24.

Figure 21:
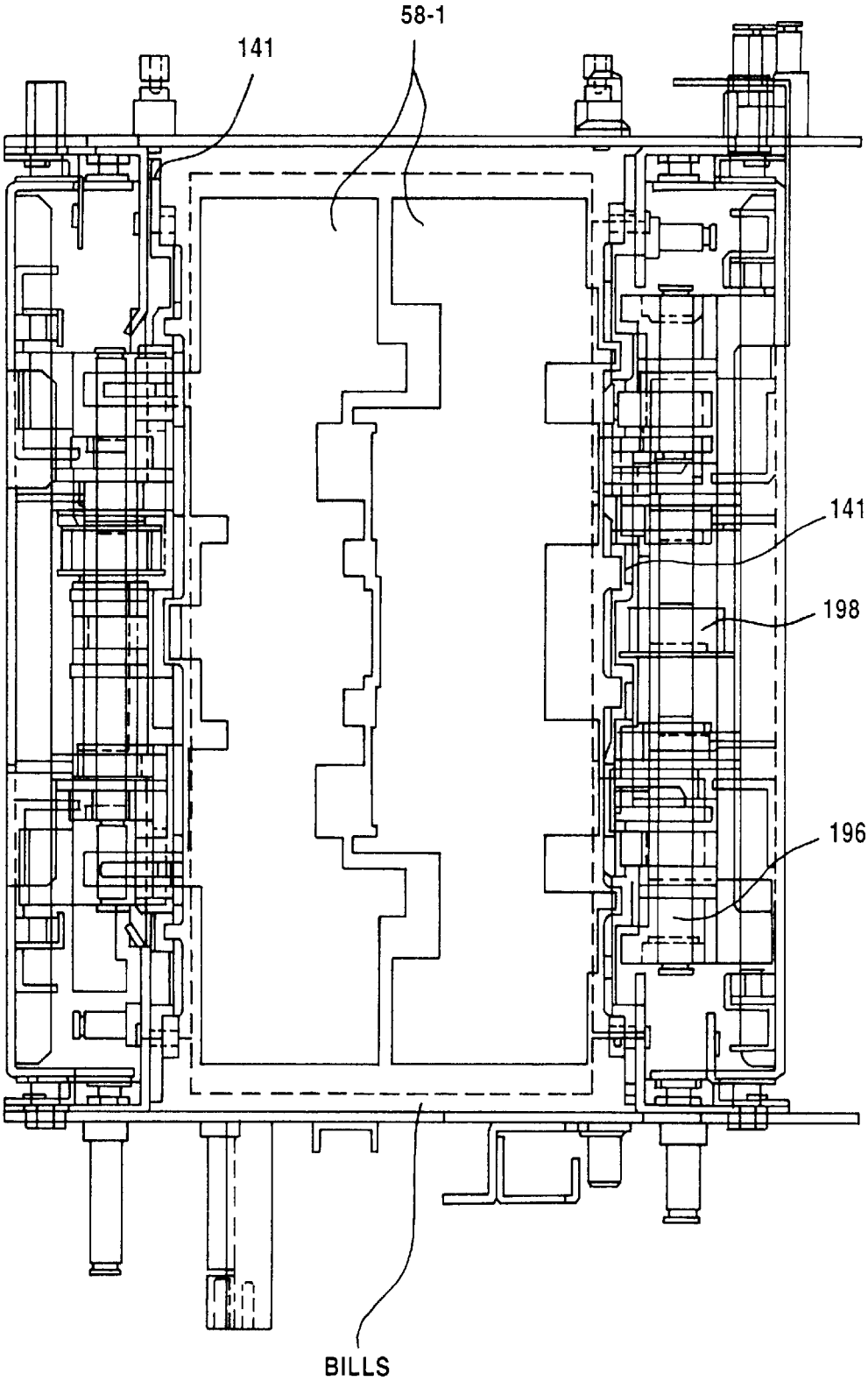
FIG. 21 is a plan view of a stacker.

This collection section 58-1 has a structure to be opened to the right and left sides so that the structural members of the right and left side sections are provided in the shape of comb, in order to prevent the bills to enter between the right and left sides of the collecting section 58-1, as shown in the plan view of the collecting section 58-1 of FIG. 21 and moreover the end portion of one member is mutually extended to enter the recessed part of the other member to prevent the bills to enter between the right and left side members.

If a customer has suspended the transaction in the course of the receiving transaction, the bills collected in the collecting section 58-1 must be returned to the outlet port 91 through the transfer route of the transfer belt 131, discriminating transfer route 41 and the returning transfer route 43.

Figure 25:
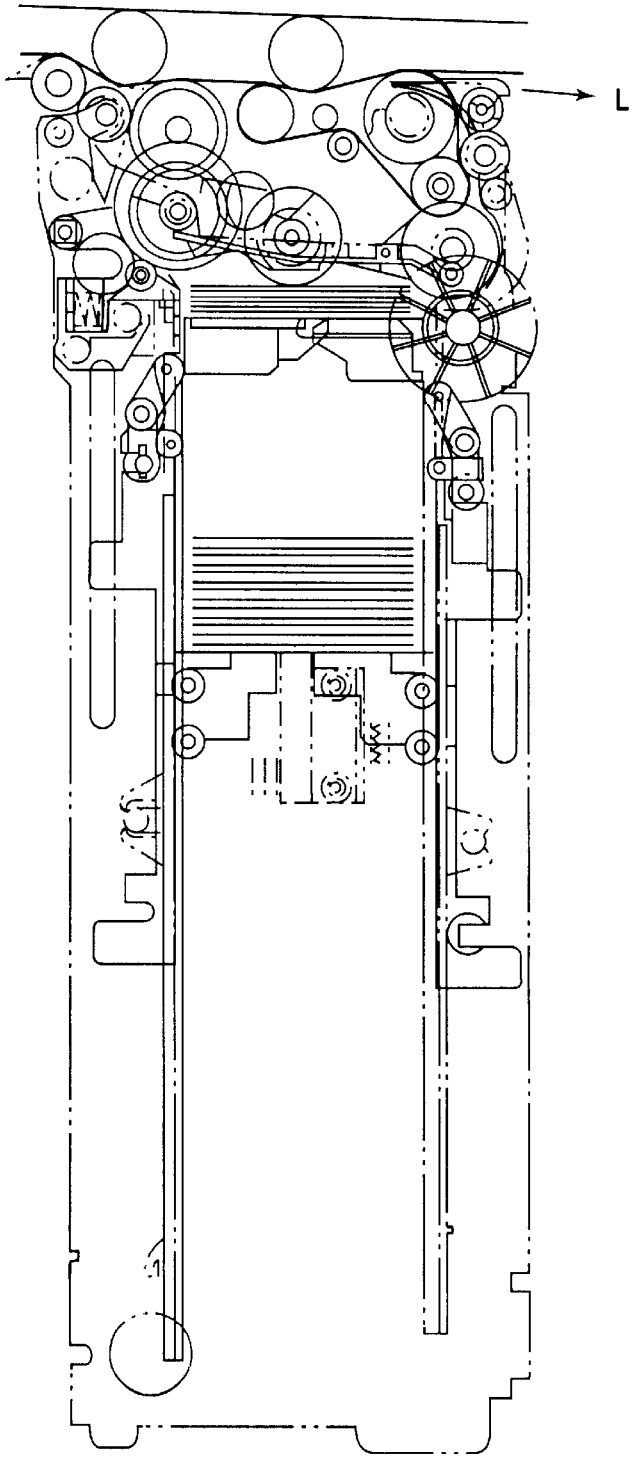
FIG. 25 is a diagram showing operation of a stacker when transaction is disabled.

When a customer has instructed to suspend the receiving transaction after the bills are collected in the collecting section 58-1, the collecting section 58-1 is moved upward as shown in FIG. 25, the stacker feeding section 56-1 feeds the bills on the collecting section 58-1 sheet by sheet and transfers these bills in the direction indicated by the arrow L.

Thereby, the bills on the collecting section 58-1, namely the bills inputted to the outlet port 91 by the customer can returned in direct.

[Structure and Operation of the Collecting Section]

The bills inputted as shown in FIG. 23 and FIG. 24 are dropped from the collecting section 58-1 and are collected together with the bills on the stage 59-1.

For this purpose, the collecting section 58-1 must be opened to the right and left sides to result in the condition that the bills can be dropped.

Therefore, the collecting section 58-1 operates as shown in FIG. 30 to FIG. 35.

FIG. 30 to FIG. 35 show the operations of the right side collecting section 58-1 of the stacker F 30-1. Since the left side collecting section 58-1 also operates in the same manner as the right side collecting section 58-1, the right side collecting section 58-1 will be explained as an example.

In order to move the collecting section 58-1 in the vertical direction, the collecting section moving motor 133 is driven first to rotate the collecting section moving gear 136 and resultingly to rotate the collecting section drive gear 191. The collecting section drive gear 191 is provided separately in the right and left sides and therefore the collecting section drive gear 191-1 which is driven in direct with the collecting section moving motor 133 transmits its rotating force, for the synchronous operation, to the other collecting section drive gear 191-2 through the in-phase gear 137.

The collecting section drive gear 191 engages with a rack provided on a holder 192. Therefore rotation of the collecting section drive gear 191 moves vertically the collecting section 58-1, holder 192 and collecting section supporting section 202.

Figure 30:
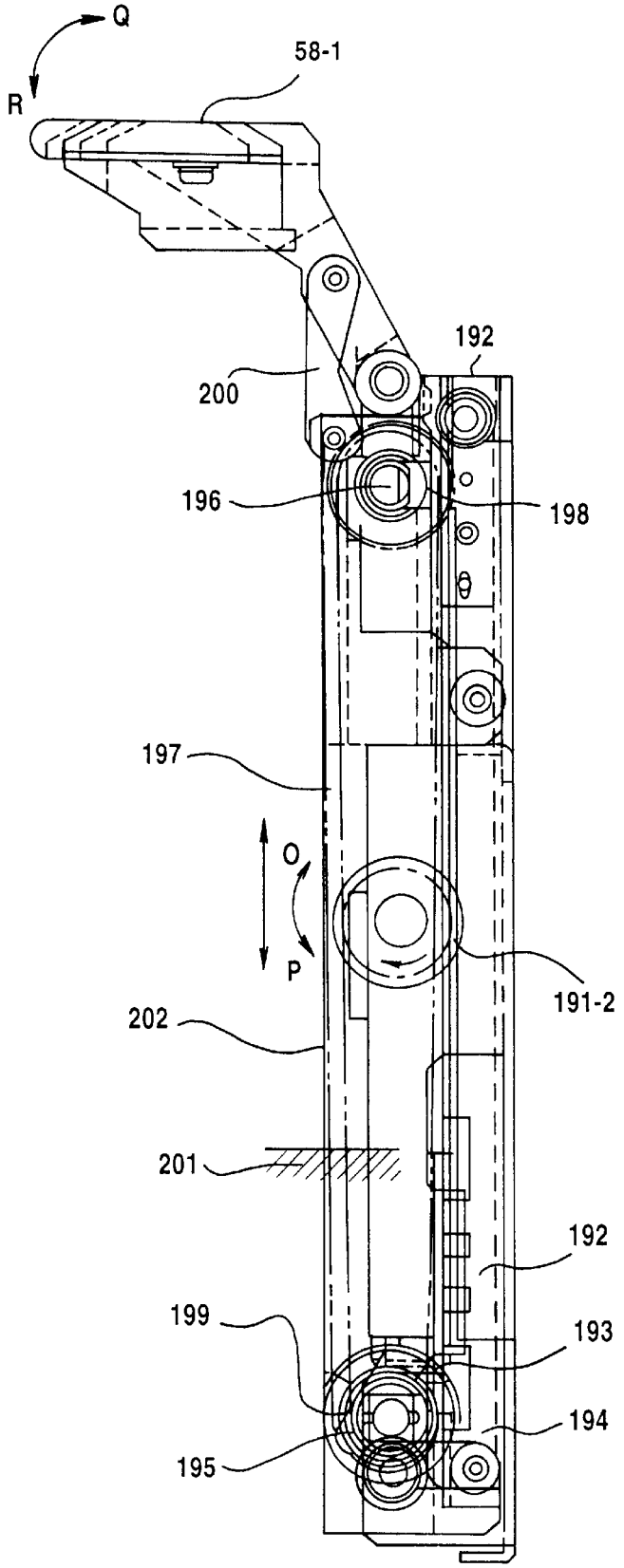
FIG. 30 to FIG. 35 are diagrams showing operation of a collecting section.

Here, the driving direction of the collecting section moving motor 133 is controlled to rotate the collecting section drive gear 191 in the direction indicated by the arrow P of FIG. 30 to move upward the collecting section 58-1 or in the direction indicated by the arrow O to move downward the collecting section 58-1.

Since the collecting section 58-1 must be moved downward to open the collecting section 58-1, the collecting section 58-1, holder 192 and collecting section supporting section 202 move downward by driving the collecting section drive motor 133 to rotate the collecting section drive gear 191 in the direction indicated by the arrow O.

Figure 36:
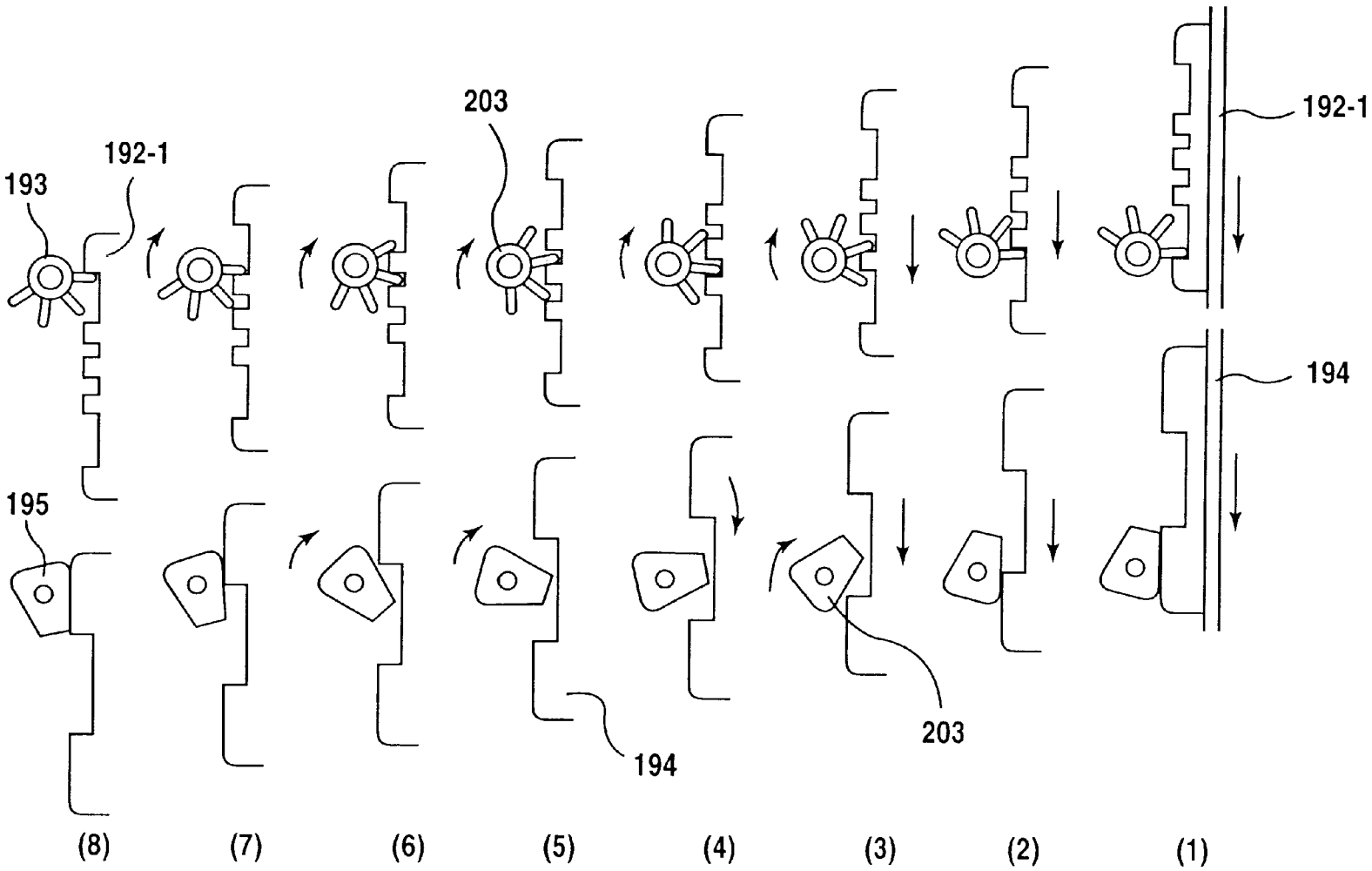
FIG. 36 is a diagram showing operation of a cam of the collecting section.

When the collecting section 58-1 starts its downward movement, since the trapezoidal cam 195 and a regulating cam 194 are in contact at a side as shown in FIG. 36(1), rotation of the cam rotating shaft 203 is regulated and moreover since the tooth of the rotating cam 193 is located at the toothless position of the rotating plate cam 192-1, the rotating cam 193 does engage with the rotating plate cam 192-1, not rotating the cam rotating shaft 203.

Accordingly, even when it is attempted to release the right and left collecting sections 58-1 at this position by giving an external force with a hand, etc., it cannot be released because rotation is regulated by the trapezoidal cam 195 and regulating cam 194.

Figure 31:
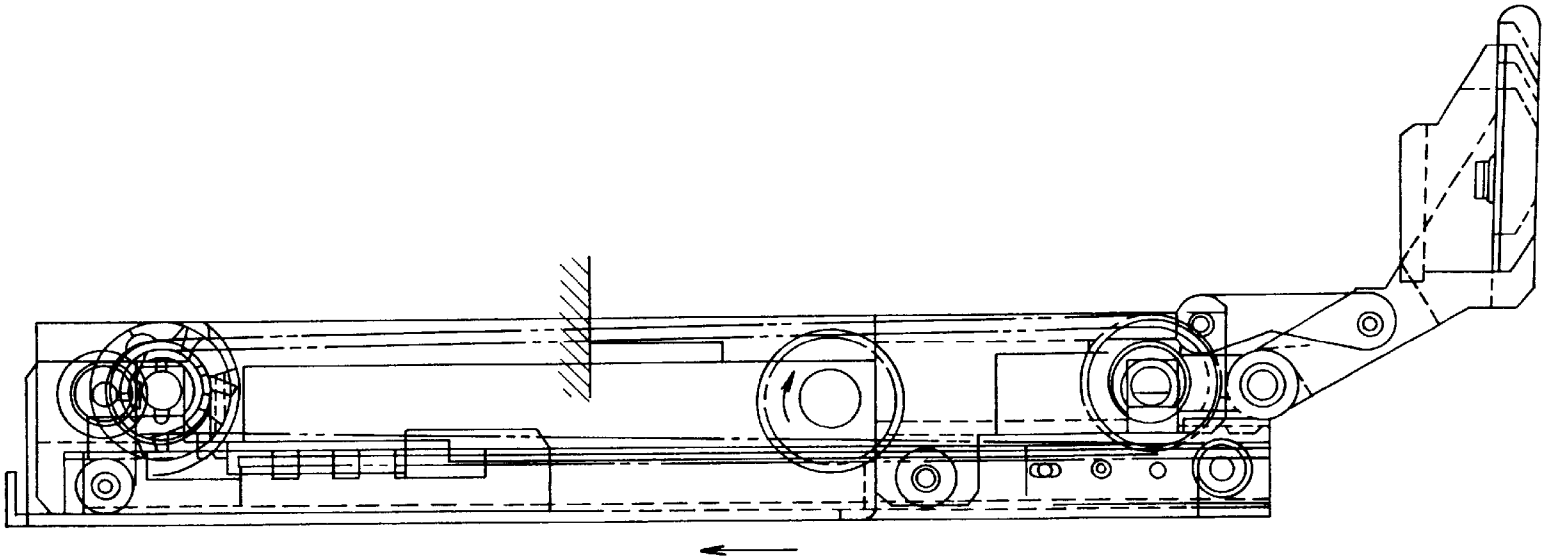

Whe the collecting section drive gear 191 is rotated, the collecting section 58-1, holder 192 and collecting section supporting section 202 move downward as shown in FIG. 31, a part of the collecting section supporting section 202 collides with a stopper 201 and thereby the collecting section 58-1 and collecting section supporting section 202 stop to move downward. In this timing, since the trapezoidal cam 195 and the regulating cam 194 are still in the contact condition at a side as shown in FIG. 36(2), the cam rotating shaft 203 does not rotate.

Figure 32:
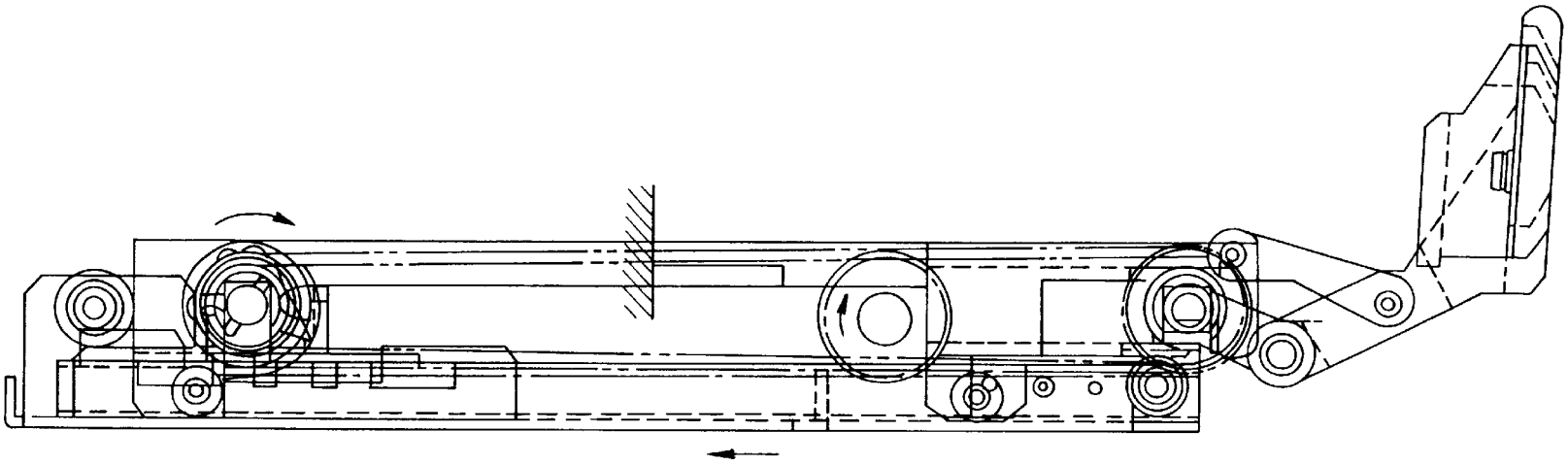

When the collecting section drive gear 191 is further rotated, the collecting section 58-1 and the collecting section supporting section 202 collide with the stopper 201 to stop the movement as shown in FIG. 32, but the holder 192 slidably fixed to the collecting section supporting section 202 further moves downward. In this timing, since the trapezoidal dam 195 is isolated from the regulating cam as shown in FIG. 36(3) and the rotating cam 193 engages with the rotating plate cam 192-1, the rotating cam 193 also rotates to rotate the cam rotating shaft 203 with the downward movement of the rotating plate cam 192-1.

With rotation of the cam rotating shaft 203, the collecting section drive pulley 199 fixed to this shaft also rotates transmitting its rotating force to a collecting section rotating pulley 108 through the collecting section drive belt 197. The collecting section rotating shaft 196 which is the rotating shaft of the collecting section rotating pulley 198 also rotates with rotationof the collecting section rotating pulley 198.

Figure 33:
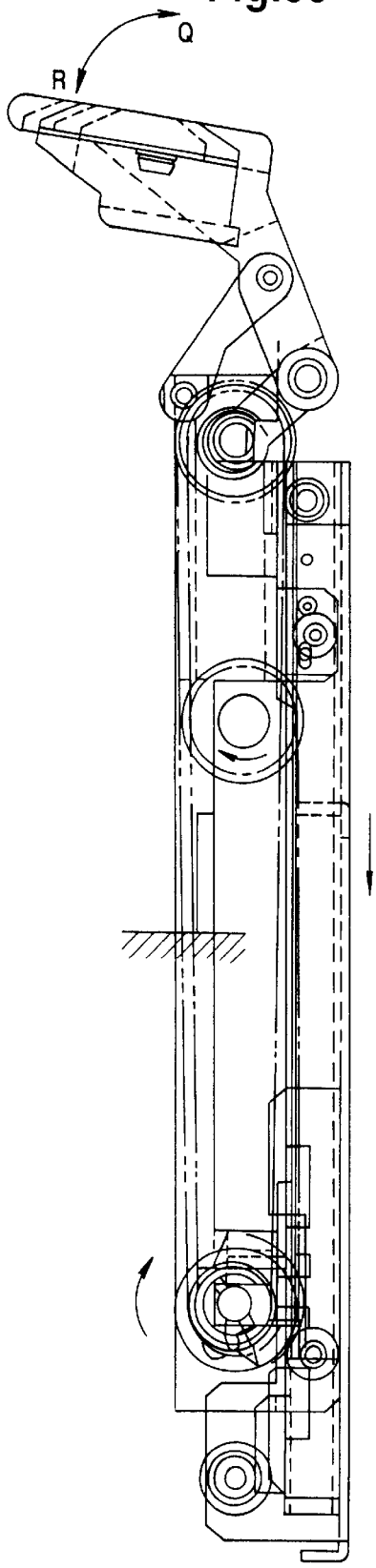

When the collecting section rotating shaft 196 rotates, the collecting section 58-1 also rotates around the collecting section rotating shaft 196 in the direction indicated by the arrow Q as shown in FIG. 33.

Figure 34:
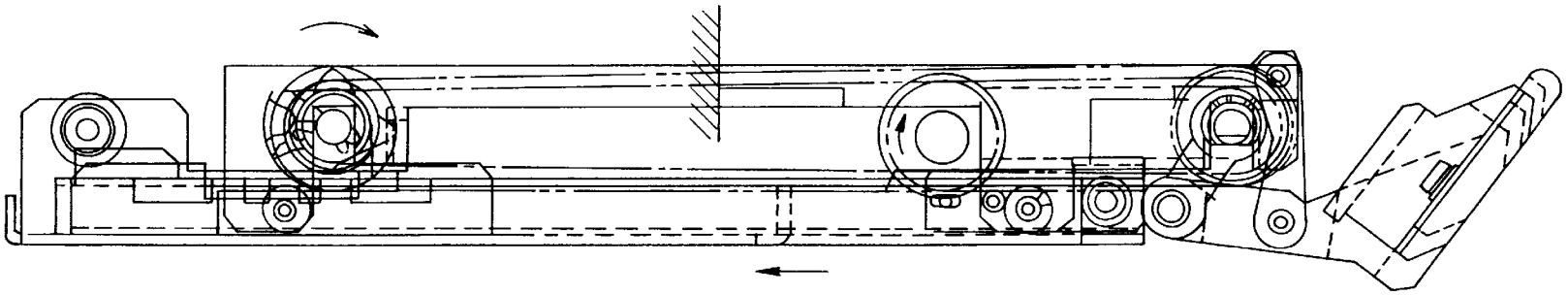
Figure 35:
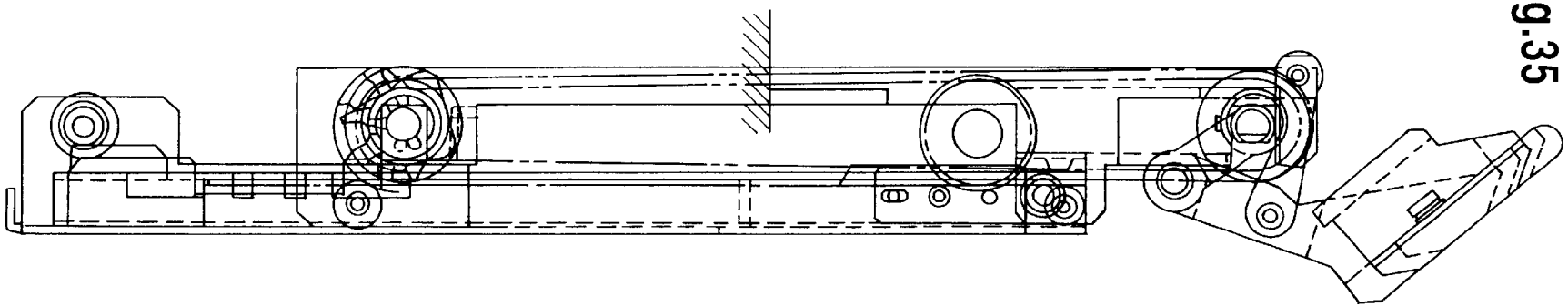

When the collecting section drive gear 191 further rotates, the holder 192 continuously moves downward as shown in FIG. 34, the rotating plate cam 192-1 also moves downward and the rotating cam 193 continuously rotates as shown in FIG. 36(4), (5), (6). Thereby, the collecting section 58-1 further rotates as shown in FIG. 34.

When the rotating plate cam 192-1 moves downward up to the position indicated in FIG. 36(7), the regulating cam 104 and the trapezoidal cam 195 are placed in contact at a side and there are no more tooth in the side of the rotating plate cam 192-1 to be engaged with the rotating cam 193. Therefore, rotation of the cam rotating shaft 203 stops. Thereby, releasing operation of the collecting section 58-1 also stops at the position indicated in FIG. 35(6).

Since the trapezoidal cam 195 is in contact with the regulating cam 194 at a side as shown in FIG. 36(8) in the position where the releasing operation of the collecting section 58-1 stops, rotation of the collecting section 58-1 perfectly stops.

The releasing operation of the collecting section 58-1 is performed as explained above and thereby the bills collected on the collecting section 58-1 can be stacked on the bills on the stage 59-1.

In the case of closing the collecting section 58-1, when the collecting section drive gear 191 is rotated in the direction opposite the releasing direction, that is, in the direction indicated by the arrow P of FIG. 30, the collecting section 58-1 executes the operation inverted from the releasing operation. In other words, the collecting section 58-1 rotates in the direction indicated by the arrow R of FIG. 30 to execute the closing operation.

The mechanism for opening or closing the collecting section 58-1 comprising the holder 192 and collecting section supporting section, etc., explained above is provided at the outside of the side wall 141 in the stacker as shown in FIG. 21. Accordingly, the bills collected in the collecting section 58-1 and stage 59-1 will be never caught or hooked by this mechanism.

With the structure explained above, since the collecting section 58-1 which can temporarily collect the bills which are inputted for the receiving transaction and also used for undetermined transactions can be provided in the stacker and moreover it is unnecessary to provide a wider space for drawing back the collecting section 58-1, the apparatus itself can be reduced in size.

[Explanation about Operations of Stacker for Expensing Transaction]

In the case of executing the expensing transaction, the bills onthe stage 59-1 is fed and transferred to the outlet port 91 sheet by sheet.

Figure 26:
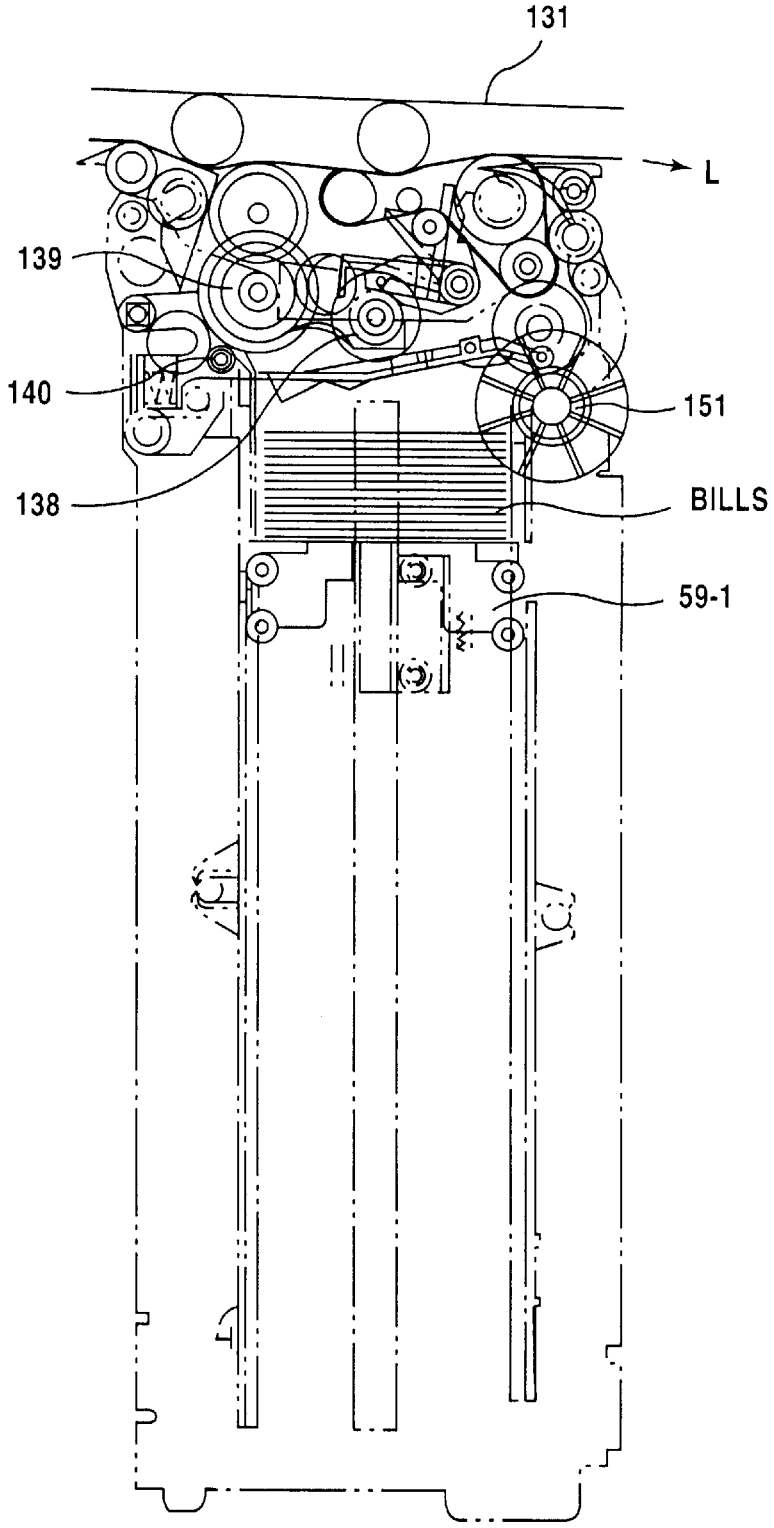
FIG. 26 is a diagram showing operation of a stage for feeding the bills from a stacker.

In view of feeding the bills from the stacker F 30-1, the stage 49-1 on which the bills are collected is further moved upward from the position shown in FIG. 26 by driving the stage moving motor 132 through the stage moving belt 142.

Moreover, the stage 59-1 is provided with a stage moving roller 157 fitted to a cabinet, etc. so that the stage 59-1 can stably run on the rail vertically. Four stage moving rollers 157 are respectively provided in one side to support the stage 59-1 with eight rollers provided in both sides.

Figure 27:
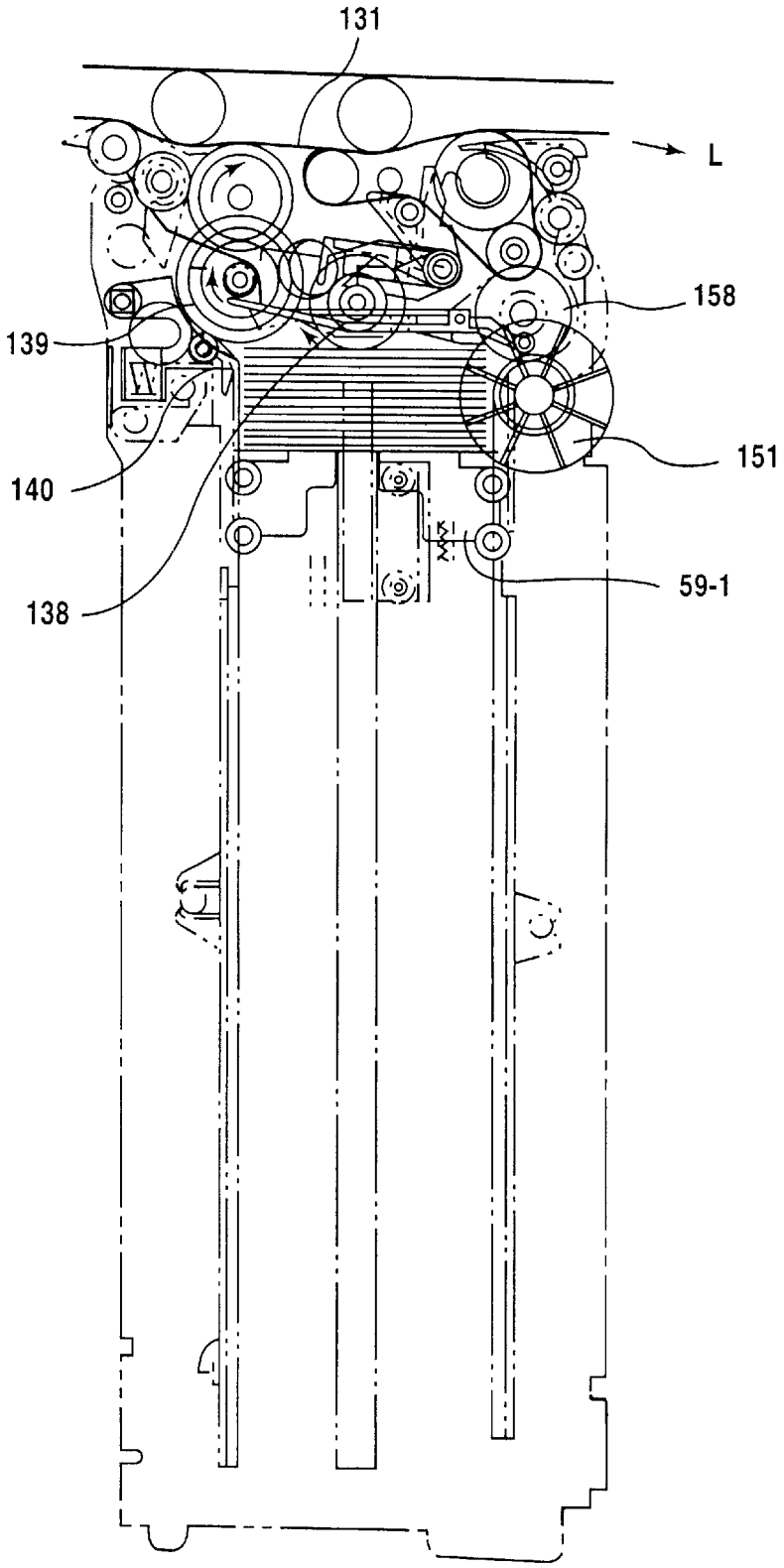
FIG. 27 is a diagram showing the feeding operation from a stacker.

When the stage 59-1 moves upward, the upper most bill stacked on the stage 59-1 is placed in contact with the pick roller 138 as shown in FIG. 27 and when the stage is further moved upward until the upper most bill is pressed to the pick roller 138 with the predetermined pressure, the stage moving motor 132 stops to rotate to stop upward movementof the stage 59-1.

Under this condition, the pick roller 138 and feed roller 139 are rotated in the feeding direction. That is, these elements are rotated in the direction indicated by the arrow in FIG. 27, that is, clockwise direction. This rotation feeds sheet by sheet the upper most bills stacked on the stage 59-1 to the transfer belt 131 through the feed roller 139. The bills fed to the transfer belt 131 are further transferred to the outlet port 91 through the discriminating transfer route 41 and returning transfer route 43 and collected therein.

This operation is continued for the amount of bills designated to be expensed. When the bills are fed as much as the amount of bills designated to be expensed, the pick roller 183 and feed roller 139 are stopped to rotate, stopping the feeding operation of the bills to dispense the bills accommodated in the outlet port 91 to the customer.

In this case, a separator 140 is pressed to the feed roller 139 in the predetermined pressure with a member.having an energizing force such as a helical spring or a plate spring, etc.

Therefore, even if the bills are immediately to be fed stacked in two sheets by the pick roller 138, only the bill in contact with the feed roller 139 is fed by the transferring force of the feed roller 139 and feeding of the bills in the side of the separator 40 is stopped with a friction force with respec to the separator 140. Therefore, the bills can be surely.fed sheet by sheet to the transfer belt 131. The separator 140 is formed of a material having a friction force such as urethane rubber, etc.

When the bill feeding operation is carried out, the takeup roller 158 and vane wheel 151 are not rotated because if the these rotate in such a direction as taking up the bills, a feeding force of the vane wheel 151 works in the direction opposite the feeding direction, resulting in an interference on the feeding operation.

Meanwhile the vane wheel 15 is composed of a material such as rubber material which is easily deformed and restored to the initial condition. Therefore, the stage 59-1 is moved upward for feeding the bills so that the vane wheel 151 deforms not to interfere the upward movement of the stage 59-1 at the position where the upper most bill on the stage 59-1 is in contact with the pick roller 138, that is, under the condition shown in FIG. 27.

The expensing transaction can be conducted as explained above.

[Accommodation Guide]

Figure 29:
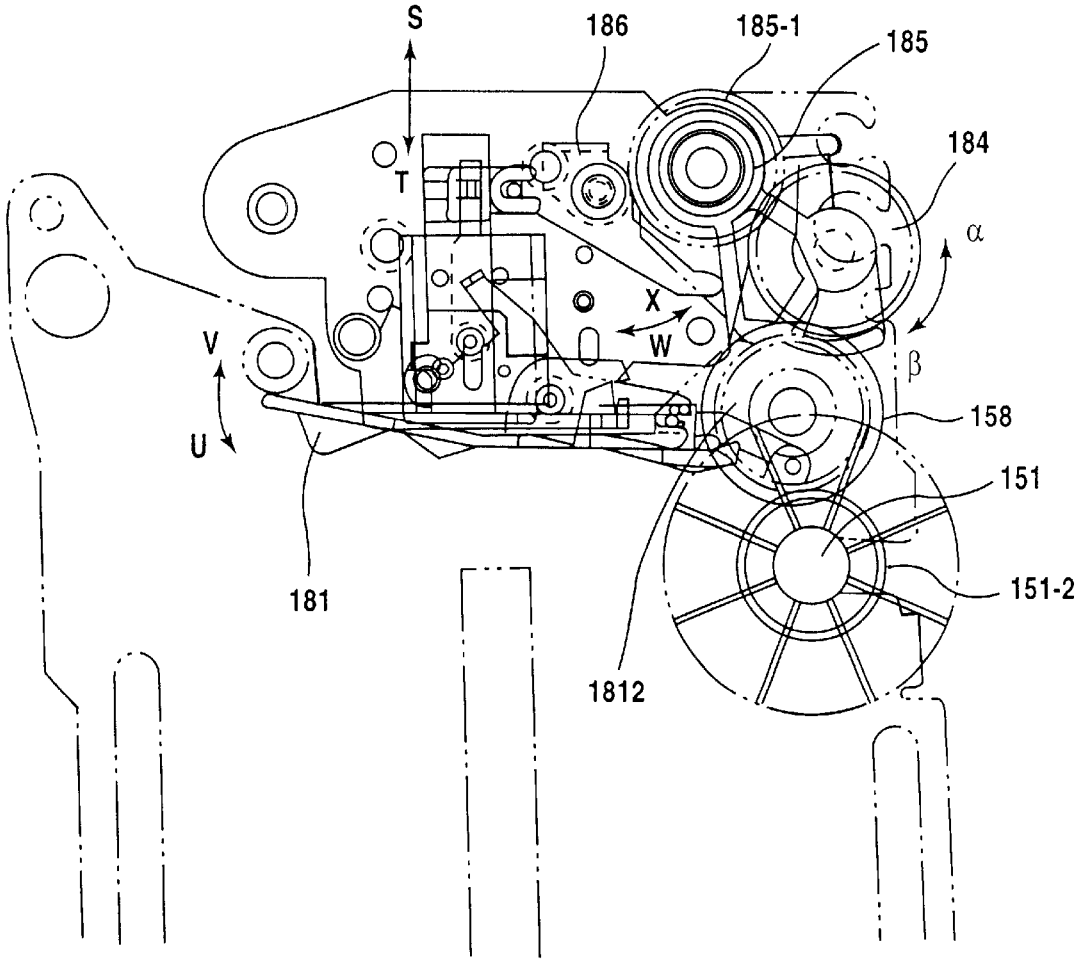
FIG. 29 is a diagram showing operation for feedingthe bills on a stacker.

FIG. 28 to FIG. 29 are drawings showing that the upper part of the stacker F 30-1 is enlarged for making clear the accommodation guide 181.

In the case of accommodating the bills in the stacker at the time of receiving transaction, the accommodation guide 181 is provided at the upper part of the stacker in order to orderly collect the bills accommodated.

This accommodation guide 181 is projected for accommodating the bills in the stacker or is drawn back for feeding the bills from the stacker.

Namely, as shown in FIG. 28, the accommodation guide 181 is formed rotatable, in the direction indicated by the arrows V–U, around the accommodation guide shaft 182 fixed to the frame in the side where the vane wheel 151 and takeup roller 158 are provided for taking up the bills to the stacker F 30-1.

In the case of taking up the bills into the stacker for the receiving transaction, a plunger magnet 183 is operated and meanwhile MPU 60 in FIG. 60 controls the plunger magnet 182 and moves a magnet lever 1810 in the direction indicated by the arrow S. Since a transmission lever 187 fixed to the magnet lever 1810 moves together in the direction indicated by the arrow S, a coupling lever shaft 188 rotatably fitted to a transmission shaft 189 also rotates around a coupling lever shaft 1811. With rotation of the coupling lever 188, the accommodation guide 181 moves in the direction indicated by the arrow U, namely in the projecting direction.

Moreover, this magnet lever 1810 is provided with a reset lever 186 which rotates in the direction indicated by the arrow W with movement of the magnet lever 1810 in the direction indicated by the arrow S in the figure.

As illustrated in the upper part of the stacker F 30-1 of 7 FIG. 20, the accommodation guide 181 projected in the stacker rotates around the accommodation guide shaft 182 fixed near the vane wheel 151 and the pick roller 138 moves downward up to the position where is it hidden by the accommodation guide 181 and then located to the position where the accommodation guid 181 is inclined with the end part thereof lowered.

Therefore, the bills taken up by the vane wheel 151 and takeup roller 158 are guided in separation from the pick roller 138 and moreover the end portion side of the bills is guided downward. Accordingly, the end part of the bills will never enter the space between the feed roller 139 and separator 140 in the feeding side.

Further, the rear end portion of the bills is forced to be pushed downward with the vane wheel 151 and thereby the bills taken up can be quickly collected on the collecting section 58-1.

As explained, in the case of taking up the bills into the stacker, sinc[e the accommodation guide 181 is projected into the stacker, the bills may be accommodated quickly, surely and orderly.

In addition, this accommodation guide 181 draws back at the time of feeding the bills. In order to have the accommodation guide 181 draw back, the plunger magnet 183 is operated to move the magnet lever 1810 in the direction indicated by the arrow mark T. With movement of this magnet lever 1810, the transmission lever 187 also moves in the direction indicated by the arrow T, causing the coupling lever 188 coupled with the transmission shaft 189 to rotate around the coupling lever shaft 1811.

With rotation of this coupling lever 188, the accommodation guide 181 rotates in the direction indicated by the arrow V.

Since such accommodation guide 181 is provided, the bills can not only be collected surely and orderly in the collecting section 58-1 but also fed surely and smoothly.

Since the accommodation guide 181 is located to the position not projected in the stacker, that is, to the position of the accommodation guide 181 in the side of the stacker R 30-2 in FIG. 20, the pick roller 138 is projected, causing the stage 59-1 to move upward to the position enabling the feeding of the bills. Thereby, the bills can be fed by means of the pick roller 138 and feed roller 139.

Moreover, the reset lever 186 connected to the magnet lever 1810 moves in the direction indicated by the arrow X.

With rotation of this reset lever 186, the end part of the reset lever 186 clollides with a gear supporting guide 185 and then rotates. Thereby, gear supporting guide 185 rotates in the direction indicated by the arrow $\alpha$ around the rotating shaft of the vane wheel drive gear 185-1 and a vane wheel coupling gear 184 fitted on the gear supporting guide 185 also rotates in the direction indicated by the arrow a.

Accordingly, the vane wheel coupling gear 184 rotates coaxially with the takeup roller 158, separating from a vane wheel transmission gear 1812 transmitting rotation to the vane wheel 151 and thereby rotation of the vane wheel 151, takeup roller 158 and vane wheel side roller 151-2 stops.

Therefore, when the bills are fed from the stacker, since the vane wheel 151 in the takeup side does not rotate, the vane wheel 151 does not interfere the feeding of the bills, ensuring smooth feeding of the bills.

This gear supporting guide 185 and vane wheel coupling gear 184 rotate in the direction indicated by the arrow β with rotation of the plunger magnet 183 in the direction indicated by the arrow S and rotation of the magnet lever 1810 in the direction indicated by the arrow W, transmitting the rotation of the vane wheel drive gear 185-1 to the vane wheel 151 through the vane wheel coupling gear 184 and vane wheel transmission gear 1812.

As explained above, since rotation of the vane wheel 151 for taking up the bills and stop of rotation thereof for feeding the bills are conducted utilizing a drive source for moving the accommodation guide 181, a drive source such as plunger magnet can be ruled out, realizing considerable cost-down.

The vane wheel drive gear 185-1 has a structure to transmit a driving force of the transfer belt 131, that is, the drive source of the vane wheel drive gear 185-1 is the same as that of the tranfer belt 131. Therefore, a power for rotating the vane wheel 151 can be ruled out, resulting in considerable cost-down.

[Detection of the Bills Remaining in the Stacker]

Figure 37:
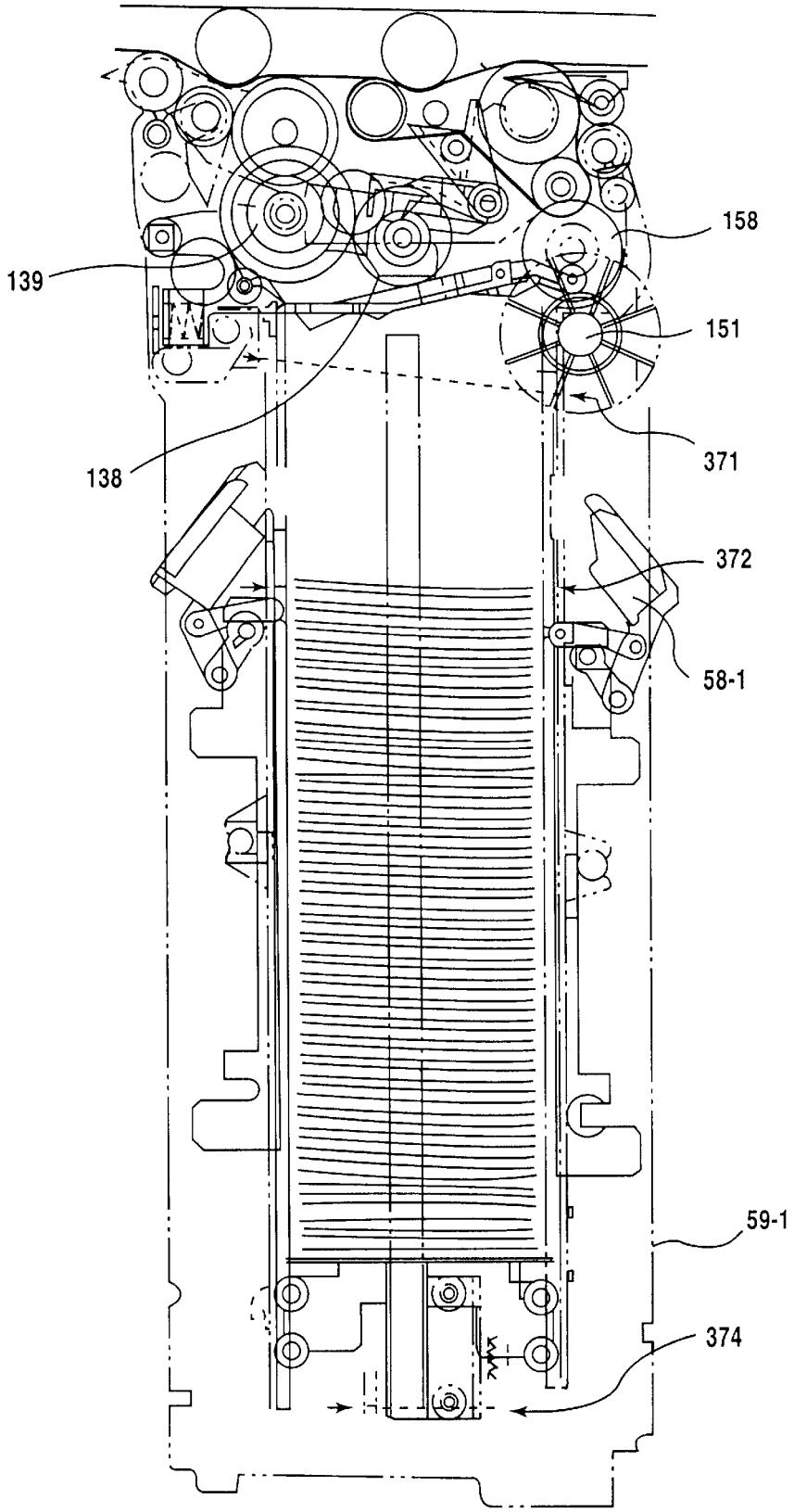
FIG. 37 is a diagram showing a primary full-detecting condition of a stacker.
Figure 38:
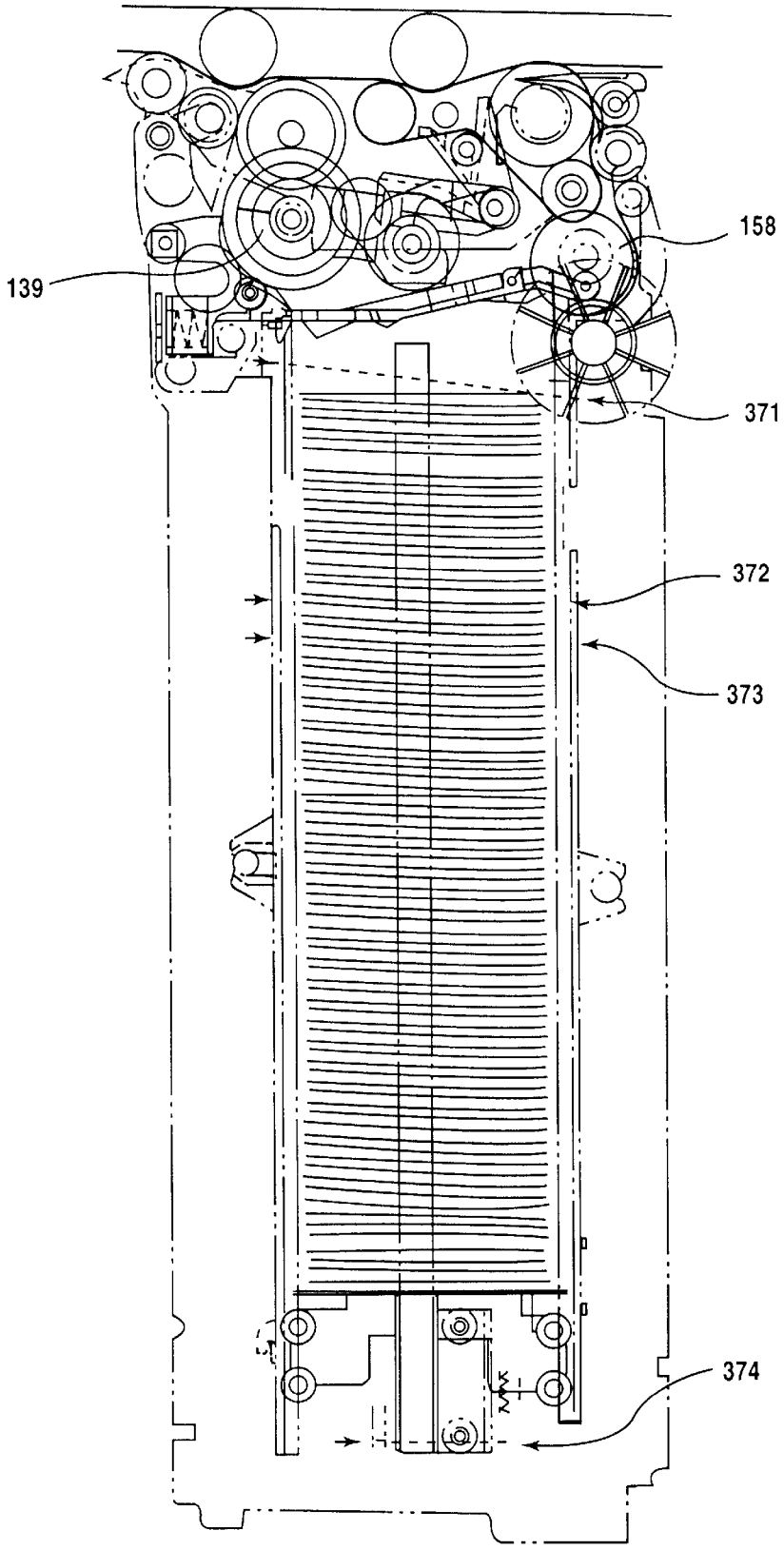
FIG. 38 is a diagram showing a secondary full-detecting condition of a stacker.

Detection of the bills remaining in the7 stacker will then bye explained by referring to FIG. 37 to FIG. 38.

The sensors for detecting the number of sheets of the bills in the stackers F, R 30-1, 30-2, particularly for detecting the full or vacant conditions of the stackers are provided in the respective stackers.

The bills are stacked on the stage 59-1 by conducting the receiving transaction or charging the bills from the bill cassette 30-3 as shown in FIG. 37.

As shown in FIG. 37, when the bills are stacked on the stage 59-1, the stage 59-1 moves downward. When the lowest position sensor 374 detects the stage 59-1 or when a primary sensor 372 detects the upper most position of the bills stacked on the stage 59-1, the cassette 30-1 is detected as being filled with the bills.

This position is located at the lower area of the position where the collecting section 58-1 used for the receiving transaction is projected into the cassette 30-1. When the bills are stacked on the stage 59-1 exceeding this position, the collecting section 58-1 cannot be projected. Therefore, when the primary sensor 374 has detected the upper most position of the bills, the operation such as the receiving transaction which requires accommodation of the bills into the cassette 30-1 is restricted. Thereby, this position is drawn back only for the transaction such as expensing transaction for feeding the bills.

However, the primary sensor 372 is provided at the position where the the cassette 30-1 is not perfectly full of the bills when the primary sensor 372 has detected the upper most position of the bills.

It is because if the receiving transaction is not yet completed under the condition that the primary sensor 372 has detected the upper most position of the bills, the bills are accepted until the end of transaction and are stacked further on the stage 59-1.

In this case, although the collecting section 58-1 cannot be projected to the stacker, the bills inputted to the outlet port 91 are discriminated and then once stacked in the buffer pool 50. Thereafter, the bills are fed from the buffer pool 50 and are collected in the stackers F, R 30-1, 30-2. Thereby, even when the collecting sections 58-1, 58-2 are not projected into the stackers F, R 30-1, 30-2, the bills may be returned when a custoer has suspended the transaction, enabling the ordinary receiving transaction for the customer.

The stackers 30-1, 30-2 are additionally provided with a secondary sensor 371 for detecting the full condition.

When the lowest position sensor 374 has detected the stage 59-1 and the secondary sensor 371 has detected the upper most position of the bills stacked on the stage 59-1, it indicates that the stacker F 30-1 is perfectly full of the bills and stacking of the bills into the stacker F 30-1 is forcibly stopped.

When the primary sensor 372 and the secondary sensor 371 have detected the upper most position of the bills, the bills are fed from the stackers F, R 30-1, 30-2 and are then accommodated in the bill cassette 30-3, thereby reducing the amount of the bills in the cassettes F, R 30-1, 30-2.

When operation is limited only to the expensing transactions without executing the receiving transaction, it is not required to reduce the bills in the stackers F, R 30-1, 30-2. That is, the collecting section 58-1 is opened, the bills are collected in the stages 59-1, 59-2 until the secondary sensor 371 detects the upper most position of the bills and these operations are repeated. Thereby, much more bills can be accommodated in the stackers F, R 30-1, 30-2 for the expensing transaction. Accordingly, many expensing transactions can be enabled, frequent charging of bills can be ruled out and the apparatus can be managed very easily.

The secondary sensor 371 is obliquely installed particularly to detect the upper most position of the bills in the side of the vane wheel 151 and thereby the bills can be fed up to upper limit in the stacker F 30-1.

In FIG. 37, although not described, an upper position detecting sensor 373 is provided in the stackers F, R 30-1, 30-2 as shown in FIG. 38 in order to detect that the bills in the stacker F 30-1 are all fed and this upper position detecting sensor 373 is used to detect the upper position of the stage when it is moved upward.

Since this upper position detecting sensor 373 is also provided in the stackers F, R 30-1, 30-2, only the stacker F 30-1 will be explained as an example.

When feeding of bills from the stacker 30-1 is executed continuously for the expensing transaction, the bills in the stacker 30-1 is reduced. Therefore, with reduction of bills, the stage 59-1 is moved upward to surely feed the bills even when these are reduced.

When the stage 59-1 moves upward and the upper position detecting sensor 373 has detected the stage 59-1, it is detected that the bills in the stacker 49-1 has become shortage.

When the upper position detecting sensor 373 has detected the stage 59-1, the transactions are restricted so that the transaction which is required to feed the bills such as the expensing transaction is no longer carried out.

However, in this case, the bills on the stage 59-1 are not perfectly fed and the upper position detecting sensor 373 is provided at the position where some bills are still left.

Therefore, even when the upper position detecting sensor 373 has detected the stage 59-1 in the course of the expensing transaction, the expensing transaction is carried out continuously to complete the current expensing transaction.

In this case, a detection sensor is additionally provided to detect that the bills in the stage 59-1 is perfectly fed and when the sensor has detected that the bills on the stage 59-1 are all fed in the course of the expensing transaction, the bills are fed from the bill cassette 30-3 and are then transferred to the outlet port 91 through the cassette transfer route 44, discriminating transfer route 41 and returning transfer route 43. Thereby, if the bills in the stacker F 30-1 are all fed, the expensing transaction can be completed.

When the upper position detecting sensor 373 has detected the stage 59-1, it means that the bills in the stacker 30-1 is shortage. In this case, the bills are fed from the bill cassette 30-3 and are then accommodated in the stacker F 30-1, increasing the amount of bills in the stage 59-1 and enabling the feeding of bills from the stacker F 30-1.

Bill Cassette]

The bill cassette 30-3 can be loaded and unloaded for the byll recycle unit.

Namely, an operator such as a teller accommodates the bills in this bill casssette 30-3 and loads it to the apparatus in order to supply the bills to each stacker 30-1, 30-2 and makes the apparatus ready for operation.

The bills in the bill recycle unit can be examined precisely, that is, denominations and the number of sheets of bills accommdoated in the bill recycle unit can be managed by collecting all bills in the stackers 30-1, 30-2 into the bill cassette 30-3.

The bill cassette 30-3 has a structure to be loaded in the plural numbers. From the view point of security, the bill cassette 30-3 must be surely loaded and locked with a key so that it can no longer be forgot to be unlockedked and anyone cannot easily load and unload the bill cassette 30-3.

The locking mechanism of the bill cassette will be explained with reference to FIG. 39 to FIG. 43.

Figure 39:
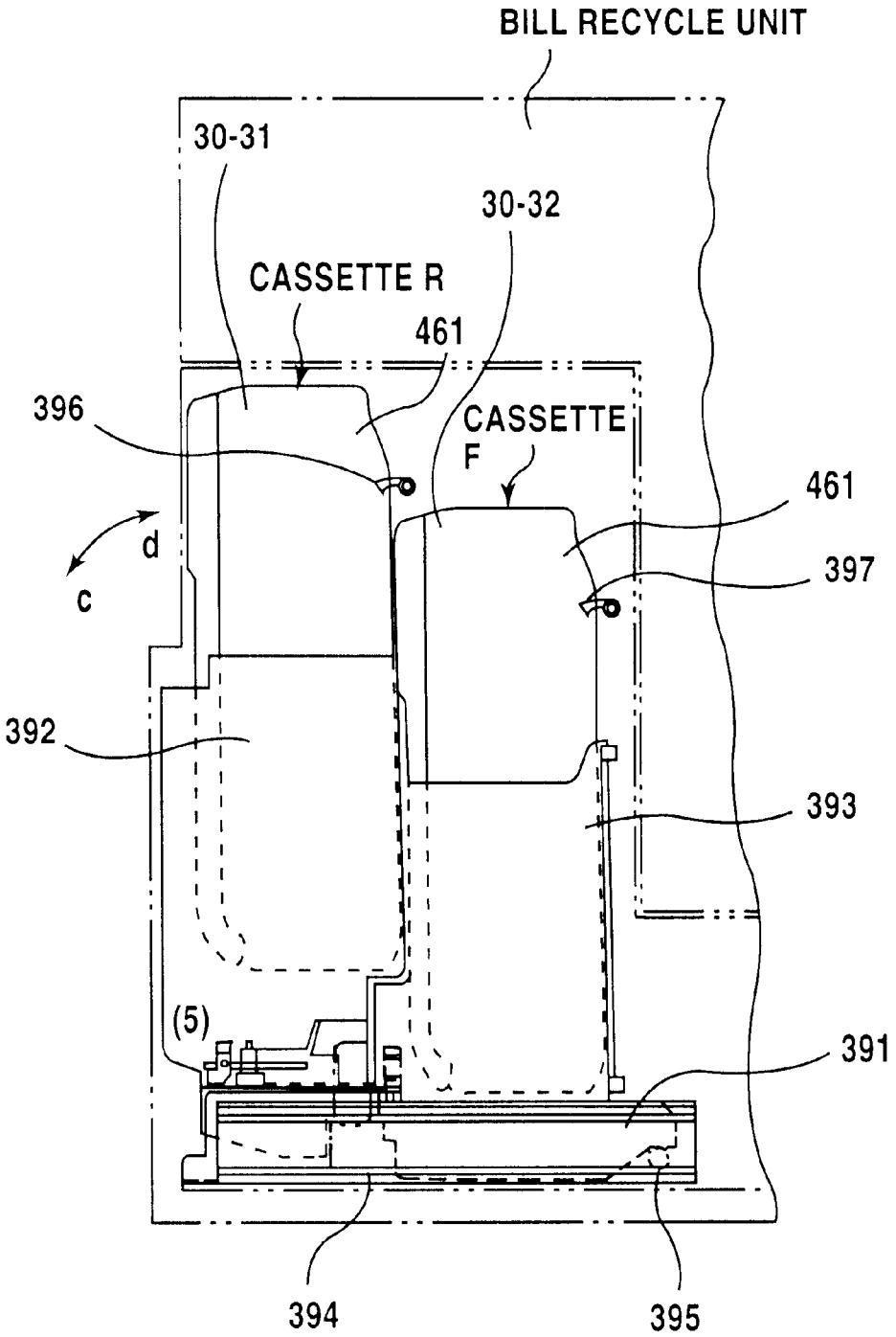
FIG. 39 to FIG. 43 are diagrams showing a bill cassette.
Figure 40:
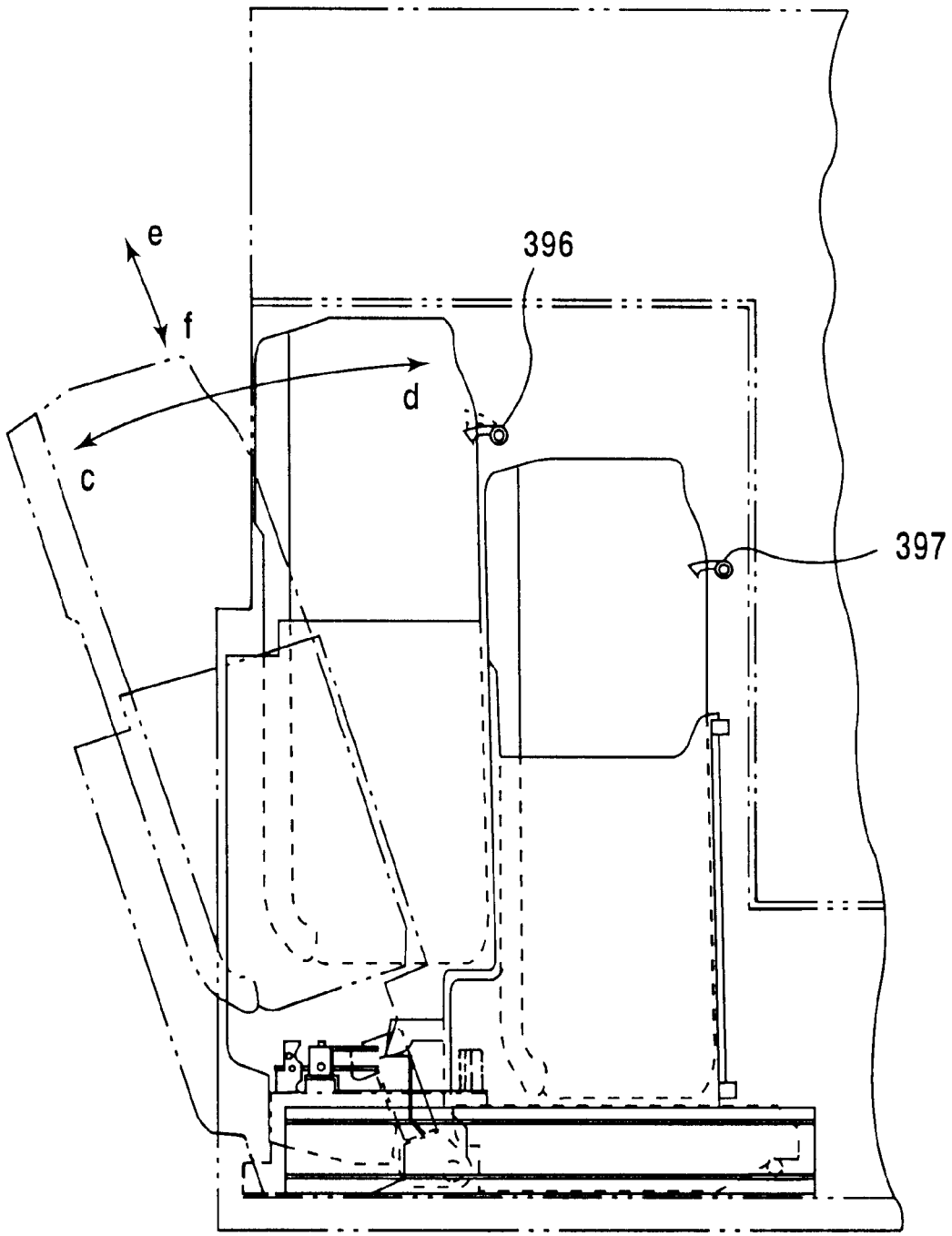
Figure 41:
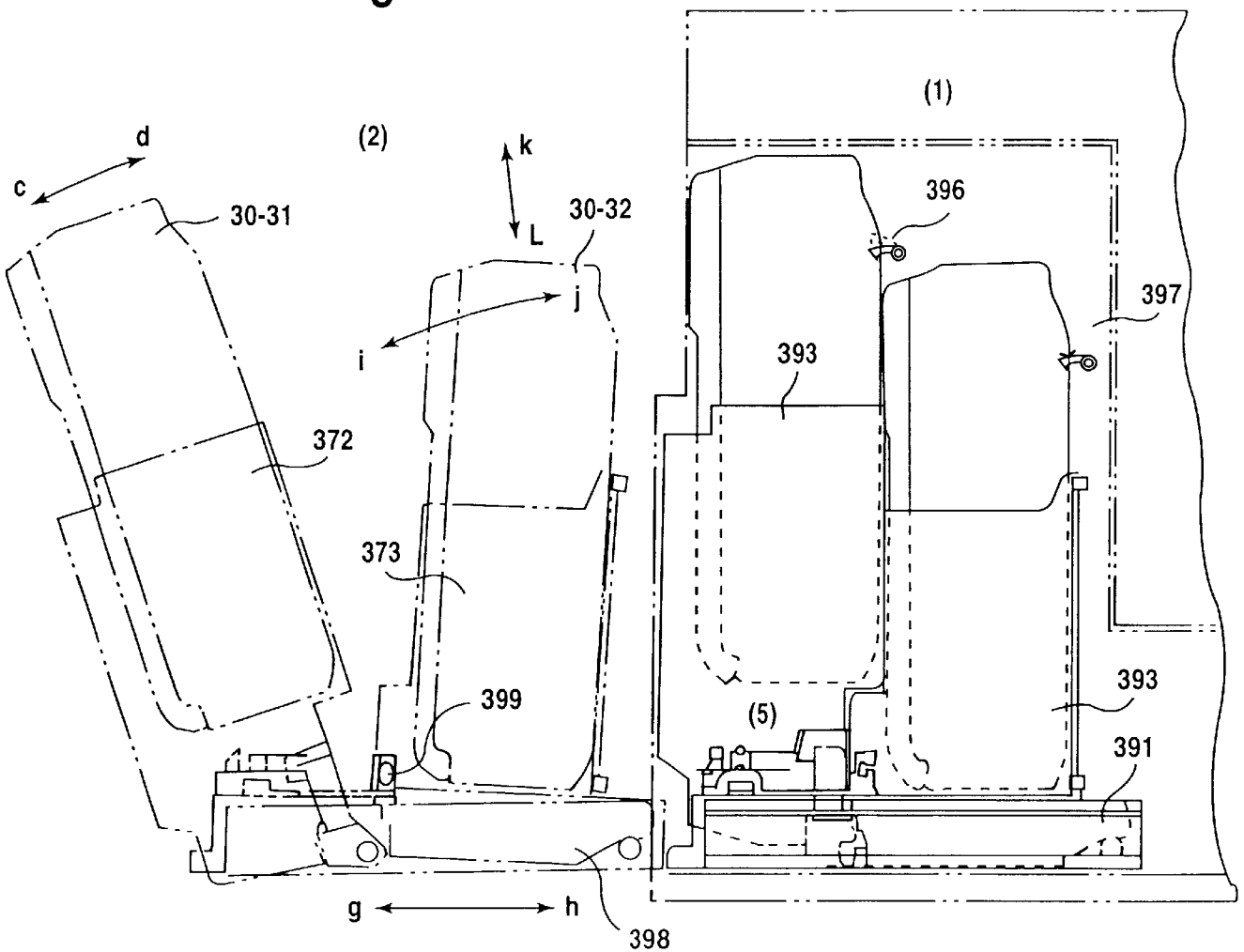
Figure 42:
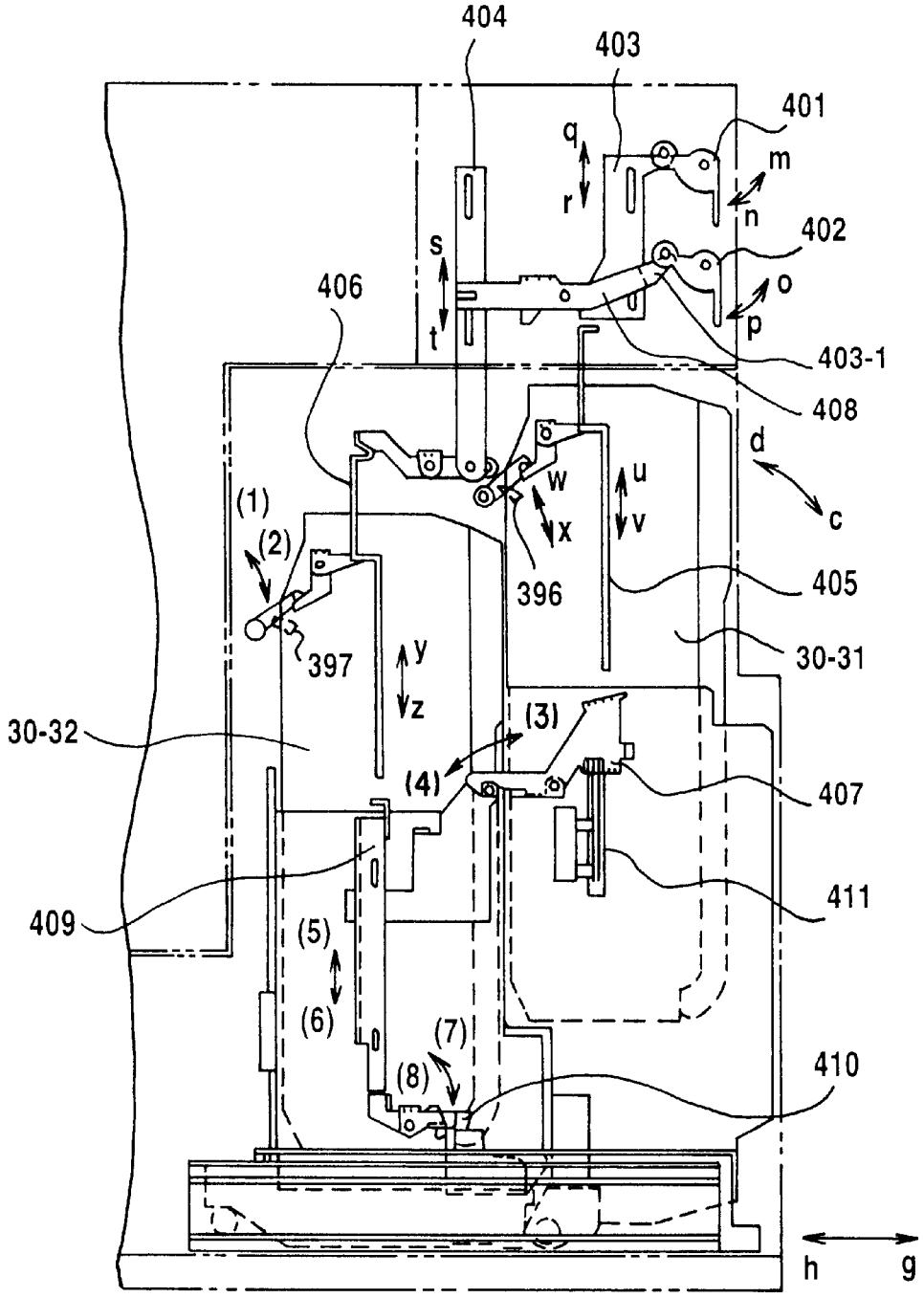
Figure 43:
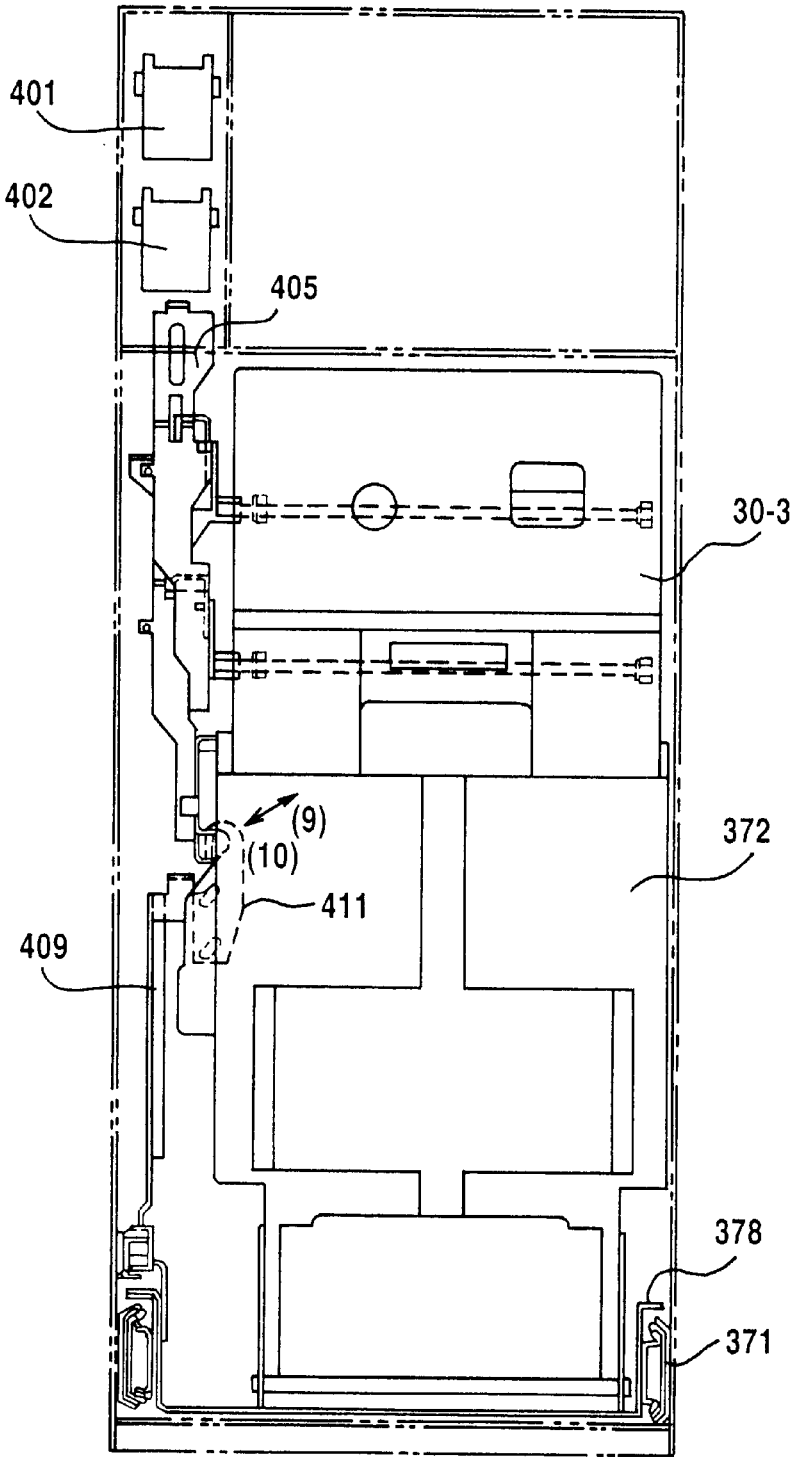

FIG. 39, FIG. 40 and FIG. 41 are side elevations showing a part of the bill cassette and bill recycle unit seen from the same direction as that in. FIG. 5 showing the apparatus. FIG. 42 is a side elevation showing layout and structure of each section of the locking mechanism seen from the direction opposed to that of FIG. 5 showing the apparatus. FIG. 43 is a rear view seen from the left side of FIG. 5 showing the apparatus.

As shown in FIG. 39, the bill cassette 30-3 is composed of the bill cassette R 30-3 and the bill cassette F 30-32.

These bill cassettes 30-3 are removably provided in two stages in the forward and backward stages from the rear surface of the bill recycle unit. Moreover, the R cassette accommodating section 392 and F cassette accommodating section 393 are respectively provided to accommodate respective bill cassettes 30-31, 3032 and these cassette accommodating sections 392, 393 are covering about the lower-half portions of the bill cassettes 30-31, 30-32.

Accordingly, the R bill cassette 30-31 can be removed by first unlocking the R cassette lock section 396, then rotating the R cassette lock section in the direction indicated by the arrow c around the R accommodating section rotating shaft 394 to set it in the condition shown in FIG. 40 and lifting the R bill cassette 30-31 in the direction indicated by the arrow e.

Meanwhile, the F bill cassette 30-32 can also be removed by drawing the cassette loading section 398 in the direction indicated by the arrow g along the cassette moving rail 391, then falling the R bill cassette 30-31 in the direction indicated by the arrow c to set it in the condition of FIG. 41(2) and thereafter lifting the F bill cassette 30-32 in the direction indicated by the arrow k.

The bill cassettes 30-31, 30-32 can be loaded by respectively loading the R bill cassette 30-31, F bill cassette 30-32 to the R cassette accommodating section 392 and F cassette accommodating section 393, thereafter pushing the cassette loading section 398 along the cassette moving rail 391 and locking the bill cassettes 30-31, 30-32 with the cassette lock sections 396, 397.

The R cassette lock section 396, F cassette lock section 397, R cassette reset lever 401, F cassette reset lever 402, R reset link 403, F reset link 404, R lock coupling link 405 and F lock coupling link 406 forming a structure for locking and unlocking the bill cassette shown in FIG. 42 are provided on a cabinet of the bill recycle unit and moreover the link is formed to be slidable in an elongated hole with a stud, while the lever is formed to be rotatable around the shaft. In addition, an accommodation lock coupling link 409, F accommodation lock section 410, R accommodation lock section 407 and R accommodation reset section 411 are provided in the R cassette accommoating section 392 and F cassette accommodating section 393.

First, when the R bill cassette 30-32 must be removed, an operator rotates first the R cassette reset lever 401 in the direction indicated by the arrow m.

This R cassette reset lever 401 is operated to move the R reset link 403 in the direction indicated by the arrow r and the R lock coupling link 405 in the direction indicated by the arrow v.

Movement of the R lock coupling link 405 rotates the R cassette lock section 396 in the direction indicated by the arrow w for unlocking.

The R accommodation lock section 407 is rotated, when the R bill cassette 30-31 is accommodated in the R cassette accommodation section 392, in the direction indicated by the arrow ③ by the R accommodation reset section 411, not receiving the influence of the R lock coupling link 405 which is in the unlocked condition.

When the R accommodation lock section 407 is unlocked, the bill cassette 30-31 can be rotated in the direction indicated by the arrow 4*c*, that is, rotated around the R accommodation rotating shaft 347 and can be fallen in the forward direction. When the bill cassette 30-31 is fallen forward at the position shown in FIG. 40, the bill cassette 30-31 can be removed.

Moreover, both R bill cassette 30-31 and F bill cassette 30-32 can be removed simultaneously as will be described below. The F lock coupling lever 408 is rotated by rotating the F cassette lever 402 in the direction indicated by the arrow o and the F lock coupling link 406 can be moved in the direction indicated by the arrow z by moving the F reset link 404 in the direction indicated by the arrow s. When the F lock coupling link 406 is moved, the F cassette lock section 397 can be unlocked. Simultaneously, the accommodation lock coupling link 409 also moves in the direction indicated by the arrow ⑥ and the F accommodation lock section 410 rotates in the direction indicated by the arrow ⑦ resulting in the unlocking condition.

Simultaneously, a part of the F cassette reset lever 402 engages with an engaging section 403-1 of the R reset link 403, moving the R reset link 403 in the direction indicated by the arrow r. With movement of the R reset link 403, the R cassette lock section 396 is unlocked, thereby the R bill cassette 30-31 and F bill cassette 30-3 can be moved together with the cassette loading section 378 in the direction indicated by the arrow g and therby both bill cassettes 30-31,30-32 can be removed.

When the R bill cassette 30-31 is removed from the R cassette accommodation section 392, the R accommodation reset section 411 moves in the direction indicated by the arrow ⑨, the R accommodation lock section 407 is unlocked and the R accommodation lock section 407 rotates in the direction indicated by the arrow ④ up to the locking position. In this case, the R accommodation lock section 407 is energized in the direction indicated by the arrow ④ and the R accommodation reset section 411 is also energized in the direction indicated by the arrow ⑨ respectively with elastic member such as a coil spring or a plate spring.

Therefore, when the R cassette accommodation section 392 is rotated in the direction indicated by the arrow d under the condition that the R bill cassette 30-31 is removed from the R cassette accommodation section 392, it is locked by the R accommodation lock section 407 and the R cassette accommodation section 392 is positioned in the standing condition as shown in FIG. 39.

When the R cassette accommodation section 39 is loaded to the bill recycle unit under this condition, if the R cassette reset lever 401 and F cassette reset lever 402 are operated, the R accommodation lock section 407 is unlocked by the R lock coupling link 405 and is then fallen in the direction indicated by the arrow c, enabling the loading and unloading of the R bill cassette 30-31.

When the R bill cassette 30-31 is loaded, the R accommodation reset section 411 moves in the direction indicated by the arrow ⑩ and thereby the R accommodation lock section 407 rotates in the direction indicated by the arrow ③, resulting in the unlocking condition. Therefore, the R bill cassette 30-31 and R cassette accommodation section 392 can be initially locked by setting the cassette loading section 398 to the bill recycle unit through the movement thereof in the direction indicated by the arrow h.

Accordingly, it is now possible to visually check that the F bill cassette 30-32 can actually and surely be locked.

Meanwhile, in order to eliminate unconvenience that only the R bill cassette 30-31 is locked and the F bill cassette 30-32 is unlocked in such a case that the cassette loading section 398 is drawn in the direction indicated by the arrow g and two bill cassettes 30-31, 30-32 are loaded again to the bill recycle unit as shown in FIG. 41, the F cassette accommodation section 393 is provided in the direction indicated by the arrow j, namely a little inclined in the side of the bill recycle unit with respect to the cassette loading section 398. In view of inclining the bill cassette 30-32, it is energized in the direction indicated by the arrow J in FIG. 41 with a spring. As the spring 399, a coil spring, plate spring or elastic member such as rubber may be used.

When the F bill cassette 30-32 is inclined toward the bill recycle unit, the F bill cassette 30-32 is locked with the F cassette lock section 393, preceding the R bill cassette 30-31. Subsequently, the R bill cassette 30-31 is locked by the R cassette lock section 396.

Thereby, both R bill cassette 30-31 and F bill cassette 30-32 can be locked surely.

The cassette reset levers 401, 402 are provided with a key and the R cassette reset lever 401 is rotated in the direction indicated by the arrow m, while the F cassette reset lever 402 in the direction indicated by the arrow o corresponding to the unlocking operation of the key. Therefore, loading or unloading of the billcassette 30-3 can be restricted by careful management of the key.

In the locking mechanism explained above, the R cassette lock section 396 is energized in the direction indicated by the arrow x, while the F cassette lock section 396 in the direction indicated by the arrow ② and the F accommodation lock section 410 in the direction indicated by the arrow ⑧ with an elastic member such as a coil spring or plate spring, etc.

[Structure of Bill Cassette]

A bill cassette 30-3 has a structure described in the official gazettes of the Japanese Patents Laid-Open Nos. 62-209694 and 4-89772 which have already been filed by the applicant and laid opened.

Particularly, a bill cassette is explained in detail in the official gazette of Japanese Patent Laid-Open No. 4-89772 and this official gazette will be cited here.

As is explained in FIG. 1 of the official gazette of Japanese Patent Laid-Open No. 4-89772, the bill cassette is provided with a separating plate, a pushing plate and driving means 9, 10 for driving these plates.

Figure 46:
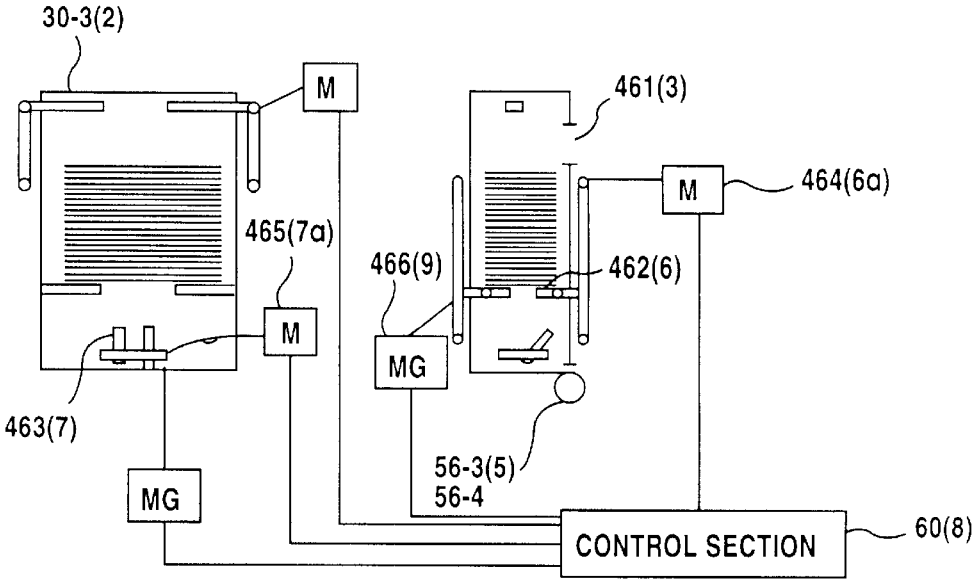
FIG. 46 is a structural diagram of a bill stacker.

FIG. 1 is designated as FIG. 46 in this specification and reference numerals are newly given for explanation. For making clear the correspondence between these figures, the reference numerals of FIG. 1 in the Japanese Patent Laid-open No. 4-89772 are designated with parentheses in FIG. 46.

This bill cassette 30-3 (2) is stuructured to be removably loaded to the bill recycle unit and moreover has a lock mechanism as explained above.

The separating plate 462 (6) provided in this bill cassette 30-3 is used for stacking the bills collected from the collecting port 461 (3) and it is vertically moved by the separating plate driving section 464 (6*a*) to always keep the equal sapce in view of orderly stacking the collected bills. With such structure, when the bill cassette 30-3 is loaded to the bill recycle unit, the bills can be accommodated in separation from the bills accommodated in the bill cassette 30-3. Moreover, by drawing back the separating plate 462 (6), it can stack the bills provided thereon above the bills placed thereunder.

The pushing plate 463 (7) is structured to move vertically within the bill cassette 30-3 with the pushing plate driving means 464 (6*a*) and it presses, in the case of feeding the bills from the bill cassette 30-3 with cassette feeding sections 56-3, 56-4 (5), the bills to the rollers of these sections with the predetermined pressure. Moreover, the pushing plate 463 can be positioned to the bill pushing position and to the draw-back position where it can freely be moved in vertical without any influence of the stacked bills. In the case of mixing the bills stacked on the separating plate with the bills provided thereunder, the pushing plate 463 is in the draw-back position, not interfering the stacking.

Although not described in regard to FIG. 46, stacker reject sections 55-2, 55-3 are provided at the upper part of the bill cassette 30-3 as shown in FIG. 5 to reserve the space for accommodating the bills to be rejected.

The collecting port 461 (3) is provided at a side surface of the cassette to feed the bills, when the bill cassette 30-3 (2) is loaded to the bill recycle unit, to the collecting port 461 (3) with the roller and vane wheel provided on the bill recycle unit and stack the bills fed to the collecting port 461 (3) on the separating plate 462 (6).

As shown in FIG. 39, when the R bill cassette 30-31 and the F bill cassette 30-32 are loaded in the bill recycle unit, the R bill cassette 30-31 is loaded at the higher position than the F bill cassette 30-32, namely in such a manner that the collecting port 461 of the R bill cassette 30-31 is not covered with the F bill cassette 30-32.

Therefore, since the R bill cassette 30-31 and the F bill cassette 30-32 can be formed in the same shape, cost-down can be realized. Moreover, even when the R bill cassette 30-31 and F bill cassette 30-32 are loaded interchangeably, since these are formed in the same shape, the apparatus can operate normally in above condition.

[Application of the Bill Cassette]

The bill cassette 30-3 is used in the following cases.

(1) Bills are charged when the bills at least in one stacker becomes shortage.

(2) Bill are collected when at least one stacker is full of bills.

(3) Bills are deposited in direct when a fault occurs in the stackers 30-1, 30-2 at the time of receiving transaction.

(4) Bills are dispensed in direct from the bill cassette when a fault occurs in the stackers 30-1, 30-2 at the time of expensing transaction.

[(1) Charging Manipulation]

As shown in FIG. 32, when the upper position detecting sensor 373 has detected the stage, it means that the bills in the stacker 30-1 are all fed and the bills must be charged thereto.

Figure 44:
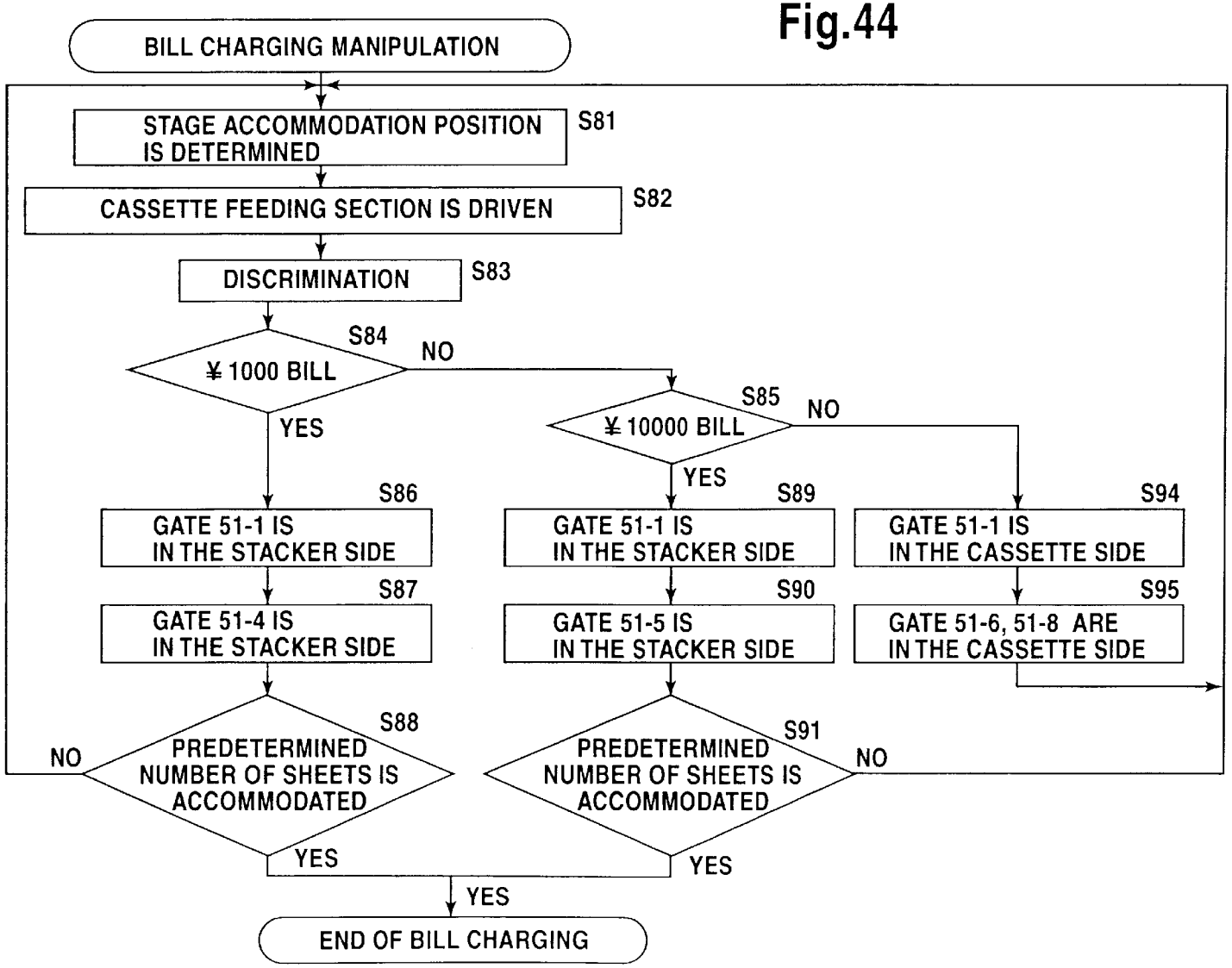
FIG. 44 is a manipulation flow showing the charging manipulation to a stacker from a bill cassette.
Figure 45:
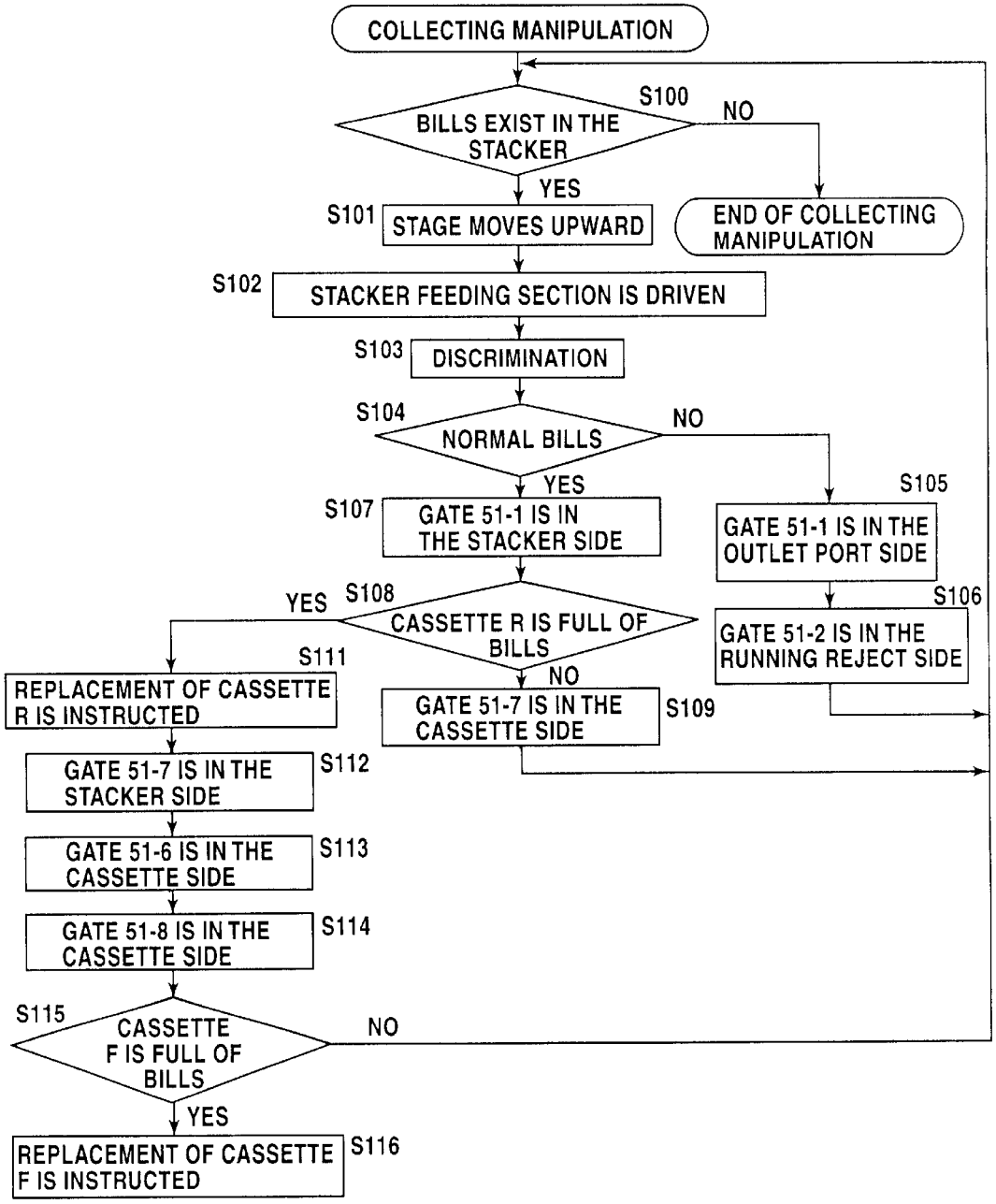
FIG. 45 is a manipulation flow showing the collecting manipuilation to a bill cassette from a stacker.

Operations of the bill recycle unit in such a case will be explained with reference to FIG. 44.

In order to take up the bills in the stacker F 30-1, the stage 59-1 is lifted to reserve the space for taking up the bills (S81).

Next, the bills are pushed to the F cassette feeding section 56-3 or R cassette feeding section 56-4 with the pushing plate 463 in the bill cassette 30-3 to drive the F cassette feeding section 56-3 and R cassette feeding section 56-4 to feed the bills sheet by sheet (S82).

The bills are then transferred to the discriminating section 57 through the cassette transfer route 44 and the discriminating transfer route 41 to discriminate the denominations of bills and transfer of bills stacked in two or more sheets (S83).

When the bills are discriminated as the ¥10000 bills in the discriminating section 57 (S85), the gate 51-1 is located in the stacker side (S89) and the gate 51-5 is located in the side of stacker F 30-1 (S90) through the accommodating transfer route 43. Thereby, the bills discriminated as the ¥10000 bills among those fed from the bill cassette 30-3 are accommodated in the stacker F 30-1 for charging it with the bills.

This operation is continuously carried out until the specified number of sheets are accommodated in the stacker F 30-1 (S91).

In addition, at the time of feeding the bills into the stacker F 30-1, the stage 59-1 is controlled to move downward in every accommodation of the predetermined number of sheets to reserve adequate space for accommodation of the bills.

Moreover, when the number of bills in the stacker R 30-2 accommodating the ¥1000 bills is reduced in number requesting the charging thereof, the bills discriminated (S83) as the ¥1000 bills by the discriminating section 57 among those fed from the bill cassette 30-3 are accommodated in the stacker R 30-2 through the cassette tansfer route 44, discriminating transfer route 41 and the accommodating transfer route 42 by positioning the gate 51-1 in the side of stacker (S86) and the gate 51-4 in the side of stacker R 30-2 (S87). This operation is carried out continuously until the predetermined number of sheets are fed to the stacker R 30-2 (S88).

When only one stacker requires charging, for example, of the ¥1000 bills, charging of the ¥1000 bills is unnecessary. Thereofre, if the discriminating section 57 discriminates the ¥1000 bills, such ¥1000 bills are returned on the separating plate 462 of the bill cassette 30-3 and then collected. Thereby, the bills may be charged to the stacker which requires charging of bills, without charging the bills to the stacker which does not require the charging of bills. Accordingly, a fault of charging the bills to the stacker which does not required the charging of bills can be avoided, that is, the stacker which does not require the charging of the bills will never become full of the bills. In other words, the apparatus realizes smoothly the charging of the bills and results in less number of times of fault and pause of operations.

If bills are not discriminated as the ¥10000 bills or ¥1000 bills by the discriminating section 57, it means that the bills fed are transferred stacked in two or more sheets or obliquely or that the bills discriminated are ¥5000 bills. Therefore, if the bills are not discriminated as the ¥10000 bills or ¥5000 bills, such bills fed from the bill cassette 30-3 are accommodated in the cassette reject sections 55-2, 55-3 within the bill cassette 30-3 by locating the gate 51-1 in the side of the bill cassette 30-3 (S94) and locating the gates 51-6, 51-8 in the side of the cassette (S95).

In this case, when two bill cassettes 30-3 are assigned to respective denominations, the bills can be fed from the assigned bill cassettes 30-3 respectively. Therefore, the bills can also be charged quickly to the cassette where the number of sheets of the bills is reduced.

In the case where such charging manipulation is not carried out only when reduction of bills in the cassette is detected by the sensor and can be done with an instruction issued as required by a remote control apparatus or by an operating panel operated by an operator at the rear surface, the bills can be charged while the apparatus is not executing the transaction and running with less pause of operation can also be realized.

[(2) Collecting Manipulation]

Operations of the bill recycle unit for the bill collecting manipulation will be explained with reference to FIG. 44.

When the primary sensor 373 or the secondary sensor 371 shown in FIG. 37 has detected the upper most position of the bills (S100), the bills must be collected from the stackers 30-1, 30-2.

Since the stackers F 30-1, R 30-2 operate in the same manner, the stacker F 30-1 will be explained as an example.

When it is detected that the stacker F 30-1 is fll of the bills (S100), the stage 59-1 of the stacker F 30-1 is moved upward (S101) and the pick roller 138 and feed roller 139 are driven (S102) to feed the bills from the stacker F 30-1 and then transfer the bills with the transfer belt 131.

The bills transferred by the transfer belt 131 are sent to the discriminating section 57 through the discriminating transfer route 41 for discrimination of denominations and transfer of stacked bills of two or more sheets (S103). The bills fed from the stacker F 30-1 and discriminated as the true bills are accommodated in the R bill cassette 30-31 (S109) through the accommodation transfer route by positioning the gate 51-1 to the side of stacker F 30-1 (S107), then verifying (S108) whether the R bill cassette 30-31 is full of bills or not and then changing over the gate 51-7, when the cassette 30-31 is not full of bills, to the side of R bill cassette 30-31.

In this case, the R bill cassette 30-31 moves the separating plate 462 in vertical to provide a space for accommodating the bills on the bills stacked on the separating plate 462 so that the bills can be orderly stacked.

This operation is continued until the predetermined number of sheets are fed from the stacker F 30-1 and are then accommodated in the bill cassette 30-3.

If a bill is not discriminated as the true bill by the discriminating section 57, the gate 51-1 is located to the side of the inlet/outlet port 91 (S105) and moreover the gate 2 is located to the side of reject section 55-1 (S106). Thereby, the bills which are not discriminated as the true bills are accommodated in the reject section 55-1.

These bills have been once discriminated as the true bills by the discriminating section 57 but are now not discriminated as the true bills due to double-feeding or oblique feeding at the time of collection.

Moreover, when it is detected after further accommodation that the R bill cassette 30-31 becomes full of the bills (S108), a signal instructing replacement of the R bill cassette 30-31 is issued to a teller (S111) to clearly specify the replacement time of the bill cassette 30-3 and realize quick and sure management of the cassette.

In this case, the gate 51-7 is located in the stacker side (S112) and the gates 51-6, 51-8 in the side of F bill cassette 300-32 (S113, S114) to accommodate the bills in the F bill cassette 30-32.

When the F bill cassette 30-32 becomes full of the bills (S115), the collecting operation is suspended and a signal instructing replacement of the F bill cassette 30-32 is issued to a teller (S116) to specify the replacement time as in the case of the R bill cassette 30-31.

[(3) Receiving Operation to Bill Cassette when the Stacker Fails]

The receiving transaction is carried out as indicated in FIG. 7 to FIG. 9. An apparatus checks by itself, before starting the receiving transaction, whether the apparatus operates normally or not. When the apparatus verifies its normal operation, it starts the receiving transaction as shown in FIG. 7 to FIG. 9.

If a fault occurs in the stacker F 30-1 or stacker R 30-2, the bills cannot be accommodated in the stacker F 30-1 or stacker R 30-2.

Figure 47:
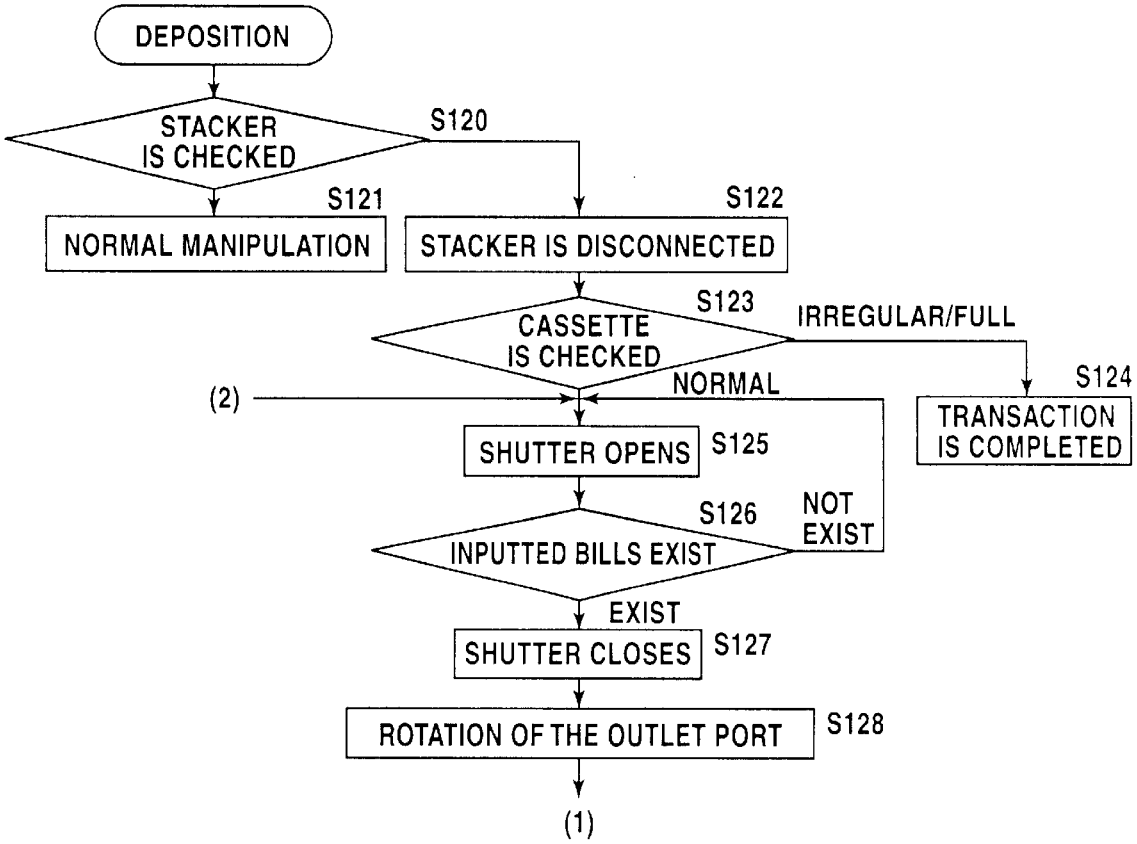
FIG. 47 and FIG. 48 are manipulation flows showing the receiving manipuilation to a bill cassette.

When the receiving transaction must be continued even in such a condition, a bill cassette 30-3 is used as shown in FIG. 46 to FIG. 47.

Here, a fault of stackers F, R 30-1, 30-2 can be detected when the sensor cannot detect feeding of the bills even after feeding is retried because the sensor cannot detect the bills even after the predetermined time has passed from the time when the feeding of bills in the stacker has started, or when the sensor has detected that the stage and feeding section of the stacker are.not located in the correct positions.

Therefore, the operation result of the preceding transaction can be utilized and a fault can be quickly recovered by storing such fault into a memory connected to MPU 60 and making access to such memory at the time of the next transaction in order to detect whether the information about generation of a fault in the stacker is stored or not.

Moreover, when it is possible to check detection of such a fault at the time of starting the transaction, a fault can surely be detected before the transaction is started and timely measures can be taken for the fault generated.

Figure 48:
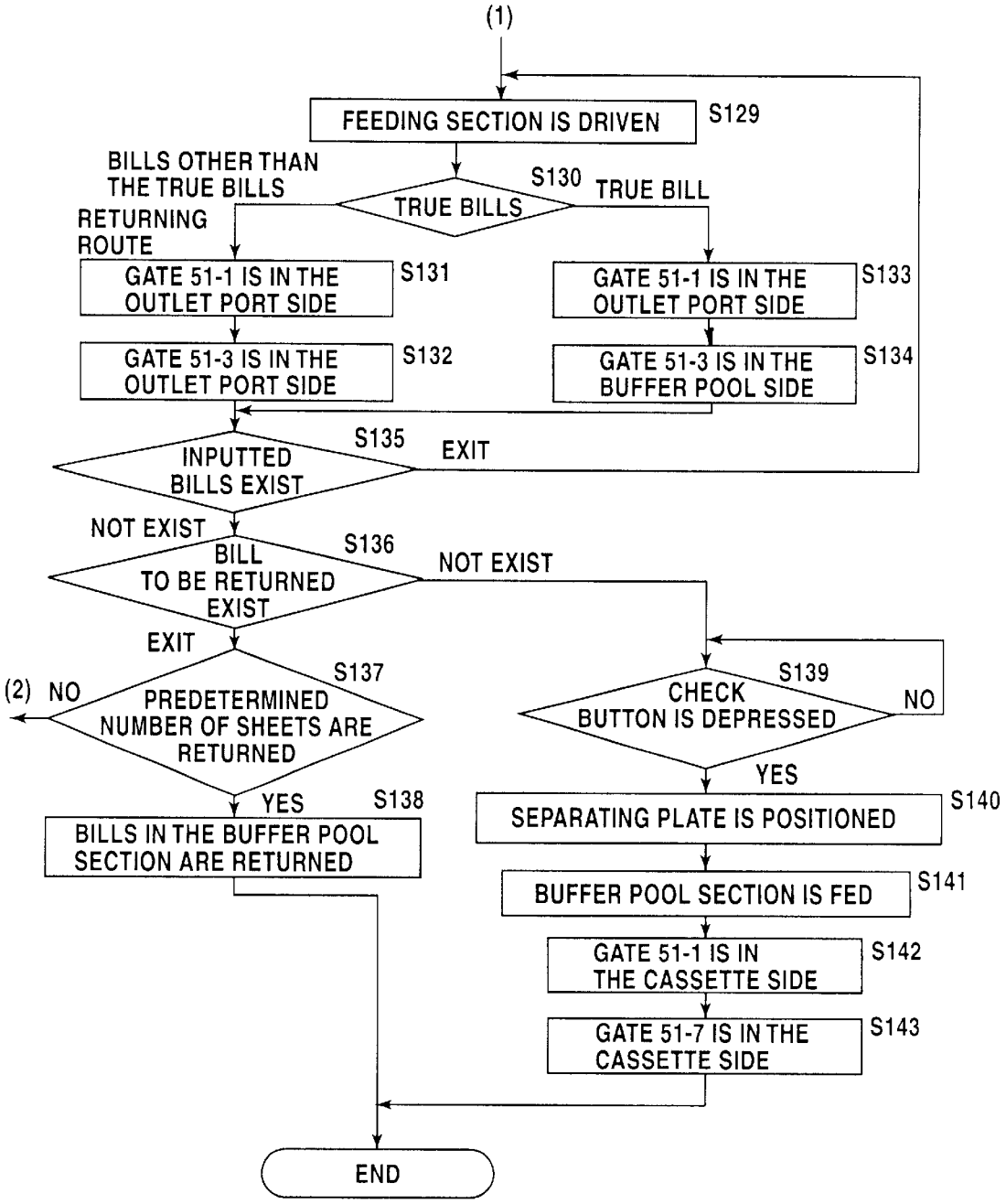

The receiving manipulation for stacker fault generated during the receiving transaction will be explained hereunder with reference to FIG. 47 to FIG. 48.

When a customer selects a receiving transaction and the receiving transaction is to be started in the apparatus, it is checked whether the stacker operates normally or not (S120).

If the stacker is normal (S121), the normal operations as shown in FIG. 7 to FIG. 9 are carried out to execute the transaction manipulations.

However, if the stacker geneates a fault and can no longer be used, a driving power of the stacker is here disconnected (S122). This consideration is taken to avoid the condition that when a bill is jammed, if the stacker feeding sections 56-1, 56-2 are further driven in order to feed the bills in the stacker, the jammed bill is further transferred, making worse the fault. Moreover, such consideration is necessary to prevent the condition that a fault is further expanded up to the normal section because the jammed bill is fed to the normal transfer route.

This disconnection of the driving force is realized by isolating the clutch 143 shown in FIG. 20. Namely, a driving force of the transfer motor 61 is tranmitted to the shaft provided with the clutch 143 through a pulley (not illustrated) and is further transmitted to the transfer route as a whole in the bill recycle unit including the transfer belt 131. This clutch 143 transmits or does not transmit the driving force of the transfer motor 61 to the transfer belt 131 with an external instruction.

Therefore, since the total transfer route can be driven or partly disconnected only with one motor, the driving mechanism including transfer route can be provided at a low cost.

Meanwhile, the driving force of the transfer motor 61 to be transmitted to the transfer belt 131, takeup roller 158, vane wheel 151, pick roller 138 and feed roller 139 can be disconnected by the clutch 143. This clutch 143 can be changed over to rotate idly with respect to the shaft or to rotate in synchroniztion with the shaft with the instruction issued.

Next, whether the bill cassette 30-3 is normal or not, that is, whether the separting plate 462 and pushing plate 463 operate normally or not is checked and moreover whether the bills can further be accommodated in the bill cassette 30-3 or not is also checked (S123).

As a result of above verification, if a fault is found in the bill cassette 30-3 or there is no more space for accommodating the bills, the receiving transaction cannot naturally be executed. Therefore, the transaction is terminated. In this case, if a card or a bank note to be used for for transaction is received from a customer, it is exhausted with display on the operation panel 22 through MPU 60 indicating that the transaction is disabled (S124).

Moreover, when the bill cassette 30-3 operates normally and there is more space for accommodating the bills, the shutter 54 is opened (S125), setting up the condition allowing input of the bills for the receiving transaction.

The shutter 54 is being opened until the bills are inputted or the predetermined time has passed, and when input of bills is detected (S126), the shutter is closed (S127) and it is confirmexd that the bills in the inlet/outlet port 91 is not yet taken up. When the bills are not yet inputted to the inlet port 91 even after the predetermined time has passed, the shutter is closed to terminate the transaction as explained with reference to FIG. 7 to FIG. 9.

When there are bills in the outlet port 91, the outlet port 91 is rotated (S128) and the pick roller 53-1 and feed roller 53-2 of FIG. 12 are driven to feed the bills (S129) as explained with reference to FIG. 12 to FIG. 19.

The bills fed from the outlet port 91 are transferred by the transfer belt 131 and discriminating transfer route 41 and are then discriminated in the discriminating section 57 whether the bills are true or false bills (S130).

When the bills are discriminated as the true bills, the gate 51-1 is located in the side of the outlet port 91 (S133) and the gate 51-3 is located in the side of the buffer pool section 50 (S134) to transfer and collect the bills in the buffer pool section 50 through the returning transfer route 43.

The bills other than the true bills, namely the false bills, those not discriminated as the true bills because these are transferred obliquely or stacked in two or more sheets are transferred to the upper part of the presser 92 of the outlet port 91 through the returning transfer route 43 by locating the gate 51-1 (S131) and also locating the gate 51-3 (S132) to the side of outlet port.

This operation is continued until the bills inputted to the inlet port 91 for the receiving transaction are all transferred (S135).

When the bills inputted to the inlet port 91 for the receiving transaction are all transferred, whether there are bills to be returned or not is checked (S136). Where there are such bills, the outlet port 91 is rotated up to the position where a customer can take out the bills (position indicated in FIG. 15), and the shutter 54 is opened to display a message on the operation panel 22, urging the customer to take up the bills.

After the predetermined time, the shutter 54 is closed (S127) and the bills are discriminated again.

Thereby, the bills which have been once transferred obliquely or transferred stacked in two or more sheets and are therefore returned to the outlet port 91 are discriminated as the true bills by this repeated discrimination and are then collected in the buffer pool section 50 together with the true bills discriminated previously.

If the bills are not discriminated as the true bills even after the predetermined number of times of disceriminations, the bills in the buffer pool section 50 are fed, transferred to the outlet port 91 (S138) and the received bills are returned to the customer, terminating the transaction.

When the bills inputted to the inlet port 91 for the receiving transaction and the bills returned to the outlet port 91 as a result of discrimination are taken up, the amount of bills received is displayed on the operation panel 22, urging the customer to check the amount and operate the check button to confirm accuracy of the amount (in this case, it is possible to input the check result with a color display 22-1 and a touch keyboard 22-2 as shown in FIG. 3). When depression of this check button is detected (S139), the separating plate 462 in the bill cassette 30-3 is moved vertically to locate the space of the separating plate 462 to the position suitable for accommodation of the bills (S140).

Moreover, the bills are fed from the buffer pool section 501 (S141) and are collected on the separating plate 462 of the bill cassette 30-3 through the discriminating transfer route 41, gates 51-1 (S142), gate 51-7 (S143), accommodation transfer route 42.

When the bills in the buffer pool section 50 are all fed to the bill cassette 30-3, the receiving transaction is completed.

As explained above, if a fault occurs in the stackers F, R 30-1, 30-2, the receiving transaction can be continued using the buffer pool section 50 and bill cassette 30-3, enabling continuation of operations of the apparatus. Therefore, the apparatus provided ensures a lower rate of pause.

[(4) Expensing Operation from Bill Cassette During Stacker Fault]

Figure 10:
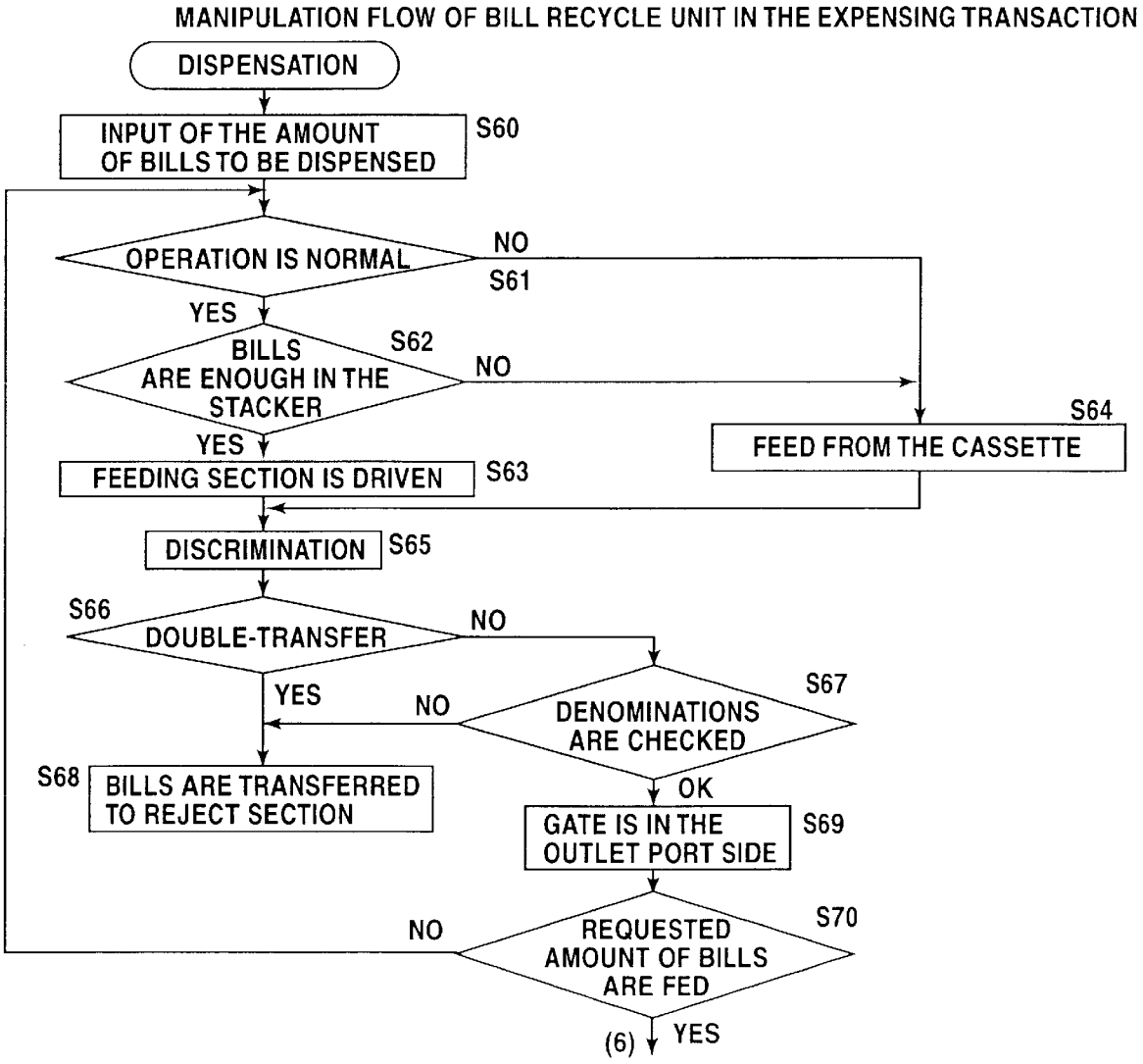
FIG. 10 to FIG. 11 are manipulation flows of a bill recycle unit at the time of the expensing transaction.
Figure 11:
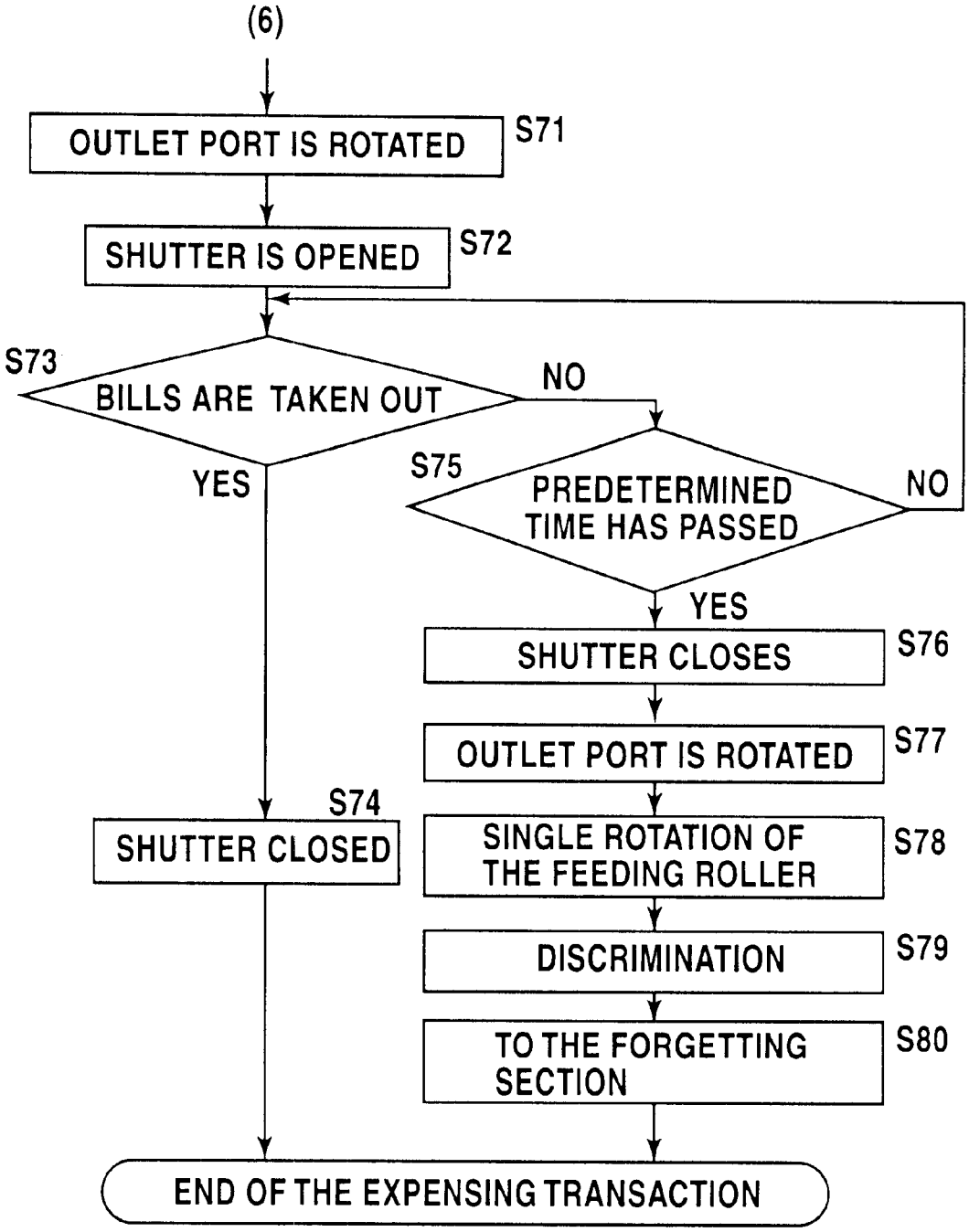

The expensing transaction is carried out as shown in FIG. 10 to FIG. 11.

The apparatus checks, before starting the expensing transactioin, whether the apparatus itself operates normally or not. When it is checked that the apparatus operates normally, the expensing transaction is started as shown in FIG. 10 to FIG. 11.

However, if a fault occurs in the stacker F 30-1 or stacker R 30-2, the bills can no longer be fed from the stackers F, R 30-1, 30-2.

Figure 49:
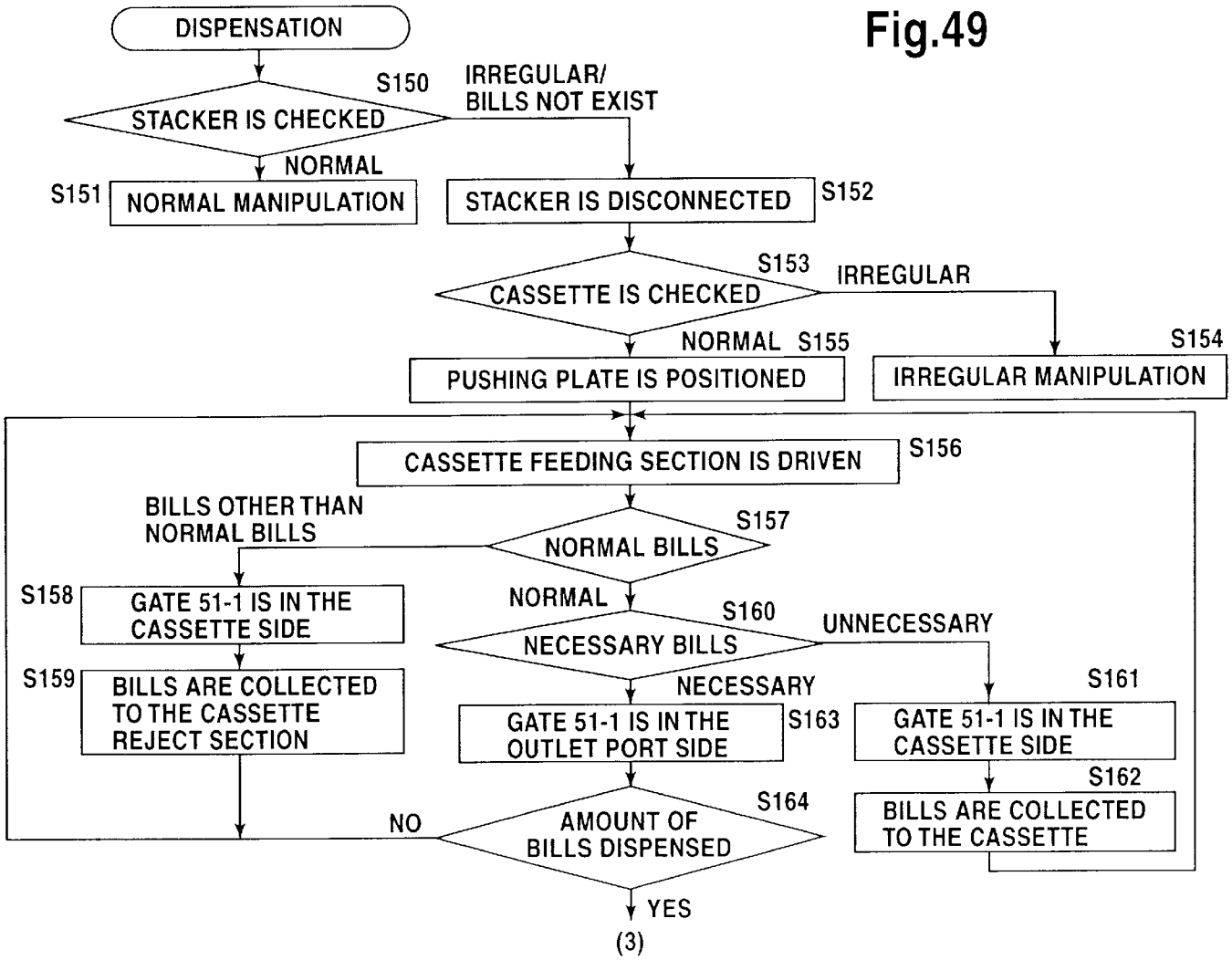
Figure 50:
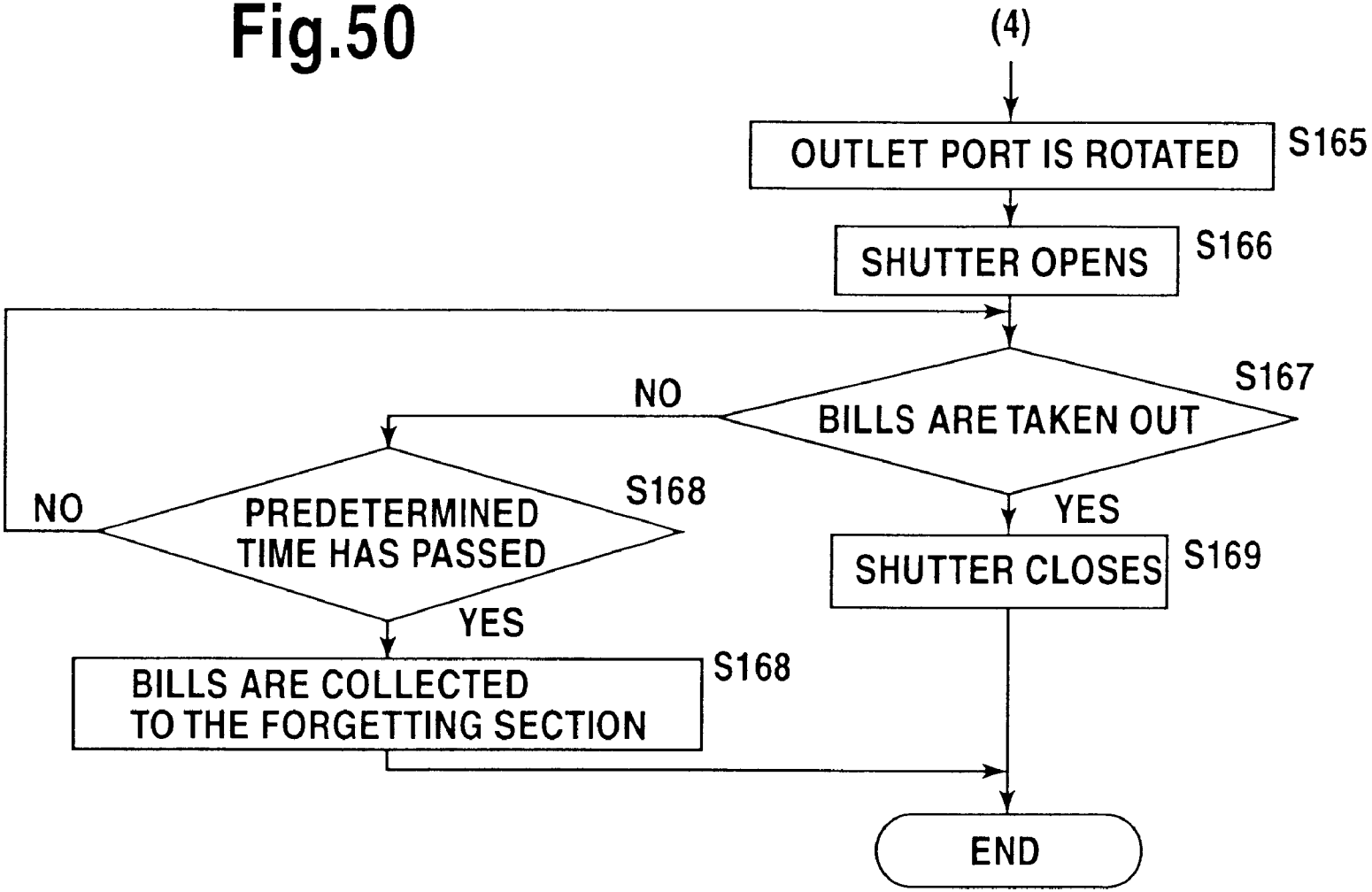

Even in this case, the apparatus can continuously execute the expensing transaction, wihtout pausing the operation due to occurrence of a fault, by using the bill cassette 30-3 as shown in FIG. 49 to FIG. 50.

The expensing manipulation for covering the fault of stacker generated during the expensing tansaction will be explained hereunder with reference to FIG. 49 to FIG. 50.

First, a customer selects the expensing transaction to start the expensing transaction, whether the stacker operates normally or not is verified (S150).

When the stacker is normal (S151), the normal operation as shown in FIG. 10 to FIG. 11 is executed for transaction manipulation.

However, if the stacker cannot be used for occurrence of a fault, the driving force of the stacker is disconnected (S152). The reason for disconnecting the stacker is the same as that explained previously in regard to the receiving transaction.

Next, whether the bill cassette 30-3 is normal or not, that is, whether the separating plate 462 and pushing plate 463 are normally operated or not is checked and moreover whether the bills to be dispensed exist in the bill cassette or not is also checked (S153).

As a result of the above check operation, if a fault occurs in the bill cassette 30-3 or there is no bill to be dispensed, the expensing transaction cannot naturally be executed. Therefore, the transaction is terminated and in this case, if a card or a bank note is inputed from a customer, these are returned, displaying a message indicating that the transaction is disabled on the operation panel through MPU 60 (S154).

When the bill cassette 30-3 is normal, it drives the F cassette feeding section and R cassette feeding section to feed the bills.

As the operations for dispensation, the pushing plate 463 is positioned in the bill cassette 30-3 (S155), in view of pushing the bills to the F cassette feeding section or R cassette feeding section which is a roller for feeding the bills using the pushing plate 463 with the predetermined pressure to surely feed the bills.

When the pushing plate 463 is positioned, the F cassette feeding section or R cassette feeding section is driven to feed the bills to the bill cassette 30-3 (S156) and then transfer through the cassette transfer route 44 and discriminating transfer route 41.

The transferred bills are discriminated by the discriminating section 57 whether these are true bills or not (S157). In this discrimination, the bills transferred stacked in two or more sheets and the bills other than the dispensation object such as the ¥5000 bills can also be discriminated.

The bills discriminated by the discriminating section 57 as those other than the true bills are collected (S159) in the reject sections 53-2, 53-3 in the cassette through the gate 51-1 and accommodation transfer route 42 (S158).

The bills discriminated by the discriminating section 57 as the true bills are further discriminated whether these are consisting of the necessary denominations or not (S160). When the bills use the denominations not required, the bills are transferred in the side of bill cassette 30-3 and are then collected in the bill cassette 30-3 (S162) through the gate 51-1 and accommodation transfer route (S161). In this case, the separting plate 462 is located to the position suitable for accommodation of the bills to stack thereon the collected bills.

The bills discriminated as the necessary bills (S160) are transferred to the outlet port 91 through the gate 51-1 and returning transer route 43 (S163).

This operation is continued until the bills tranfserred to the outlet port 91 reaches the amount of bills designated by the customer for the expensing transaction.

When the bills in the bill cassette 30-3 are fed by the F cassette feeding section or R cassette feeding section the bills existing between the pushing plate 463 and the F cassette feeding section or R cassette feeding section are reduced.

However, the pushing plate 463 is moved by the pushing plate drive section 465 to the F cassette feeding section 50-3 or R cassette feeding section 50-4 to push the bills with an adequate pressure so that if the bills existing between the pushing plate 463 and the F cassette feeding section 50-3 or R cassette feeding section 50-4 are reduced, the pushing plate 463 can push the bills with an adeequate pressure.

When the bills of the amount specified by the customer are accommodated in the outlet port 91, the outlet port 91 is rotated as shown in FIG. 12 to FIG. 19 (S165) and the shutter opens (S166) so that the customer can take up the bills in the outlet port 91.

After the shutter 54 opens, whether the bills are taken up within the predetermined time or not is watched (S167, S168).

When the bills are not taken up after the predetermined time has passed, it is determined as the condition that the customer has forgot to take up the bills from the outlet port 91. Therefore, the shutter 54 is closed, thereafter the bills are fed from the outlet port 91 and are then collected in the forgetting section 57 (S168), terminating the expensing transaction.

When the takeup of bills is detected within the pedetermined period, the shutter 54 closes (S169), terminating the transaction.

Thereby, if a stacker fault is generated, dispensation can be realized.

If a bill is jammed in the feed roller 139, generating a fault of the stacker, dispensation can also be executed by suspending the operations of the stacker feeding sections 56-1, 56-2 so that a fulat does not become worse.

The bills of the denomications not required among those fed from the cassette are obviously different from the bills accommodated in the stacker in which a fault occurs. Therefore, if a defective stacker is separated not to operate while the normal stacker can operate and the bills of the denominations not required are stacked in the operable stacker, the bills may be charged when the bills in the stacker are reduced in number, making less the pause of operation.

Moreover, when respective denominations are assigned to a couple of bill cassettes 30-3 even for the receiving transaction and expensing transaction, for example, when the ¥1000 bills are accommodated in the R bill cassette 30-31 while the ¥10000 bills in the F bill cassette 30-32, the ¥1000 bills among the bills inputted to the inlet port 91 and are discriminated at the time of receiving transaction are accommodated in the R bill cassette 30-1 and the ¥10000 bills in the F bill cassette 30-32. On the other hand, in the expensing transaction, the ¥1000 bills are dispensed from the R bill cassette 30-31 and the ¥10000 bills from the F bill cassette 30-32 as the bills corresponding to the amount designated by the customer. Thereby, at the time of accommodation and dispensation of bills, particularly at the time of expensing transaction, high speed manipulation can be realised because the bills of the denominations required can be fed from the corresponding bill cassette 30-3.

Moreover, at the time of expensing transaction, the ¥10000 bills are often fed and this bill can be reduced faster than the ¥1000 bills. As a result, charging is also required faster. Therefore when the ¥10000 bills are stacked in the R bill cassette 30-31 considering such condition, the bill cassette 30-3 can be replaced easily only by unlocking the R bill cassette 30-31.

[Structure and Operations of Buffer Pool]

A buffer pool section 50 is used in the following cases.

(1) In the receiving transaction which is executed using the stacker, the broken bills and the ¥5000 bills which are not used for the dispensation among those discriminated as the true bills are accommodated.

Therefore, until the receiving transaction is set up, the broken bills and ¥5000 bills are not accommodated in the reject section 55-1 and are set ready for returning. Moreover, these bills are separated from the bills accommodated in the stacker and the large number of bills to be accommodated in the stackers can be accommodated in the stackers immediately after the transaction is set up. Meanwhile, a small number of broken bills and ¥5000 bills are fed from the buffer pool section 50 and are then accommodated in the reject section 55-1, enabling high speed manipulations for transaction.

(2) At the time of receiving transaction to be carried out when a fault occurs in the stackers, the bills inputted for the receiving transaction are temporarily accommodated under the condition that these may be returned. Therefore, even if a fault occurs in the stackers, the transaction can be carried out continuously without pausing operations of the apparatus.

(3) When stacking of the bills of which front and rear surfaces are orderly arranged is necessary during the receiving transaction using the stackers, the bills of which front and rear surfaces are inverted from the other bills accommodated in the collecting section of the stackers are temporarily stored. Therefore, the front and rear surfaces of the bills can be orderly uniformed. Moreover, when not only the bills of which surfaces are inverted but also the broken bills and ¥5000 bills are stored together in the buffer pool section 50, this section can be used in common to uniform the surface of bills and temporarily accommodate the broken bills and ¥5000 bills, enabling reduction in size of the apparatus and cost-down.

(4) During the receiving transaction, if the bills inputted to the inlet port 91 for the receiving transaction cannot be accommodated completely in the stacker, remaining bills are accommodated in the buffer pool section 50. Therefore, a large number of bills can be inputted at a time for the receiving transaction and if these cannot be accommodated completely in the stacker, the receiving transaction can be continued without pause of operations for the receiving transaction.

(5) During the expensing transaction, the bills which are not discriminated as the true bills when the bills are charged to the stacker can be temporarily stored in the buffer pool section 50.

The bills stored in the bill cassette and stacker are almost true bills and those not discriminated as the true bills during manipulations for the expensing transaction have been discriminated because these have been transferred obliquely or stacked in two or more sheets. But these bills may also be discriminated as the true bills to the considerably higher degree by the repeated discriminations.

Therefore, if the bills which have been once discriminated as the false ones are accommodated in the redject section 55-1 or 55-2, 55-3, these can no longer be fed and cannot be used any more as the true bills. In view of minimize the bills to be accommodated in the reject section, the bills which have not been discriminated as the true bills are once stored in the buffer pool section 50 for the repeated discrimination. Thereby, the number of bills to be accommodated in the reject section can be reduced.

For the use explained above, the buffer pool section 50 is structured to take up, accommodate and feed sheet by sheet the bills.

How to use the buffer pool 50 should be determined before shipment of the apparatus.

Moreover, when the facilities are provided so that use of the buffer pool section 50 can be selected depending on an input from the maintenance and operation panel 31 shown in FIG. 3 and a teller can select the method of use of the buffer pool section 30, the apparatus can be operated depending on a variety of financial institution's needs.

The buffer pool section 50 will be explained with reference to FIG. 5 and FIG. 51.

The buffer pool section 50 has a structure similar to the stacker described in the official gazette of the Japanese Patent Laid-open No. 63-154537 which has been filed and laid opened by the applicant of the present invention.

Figure 51:
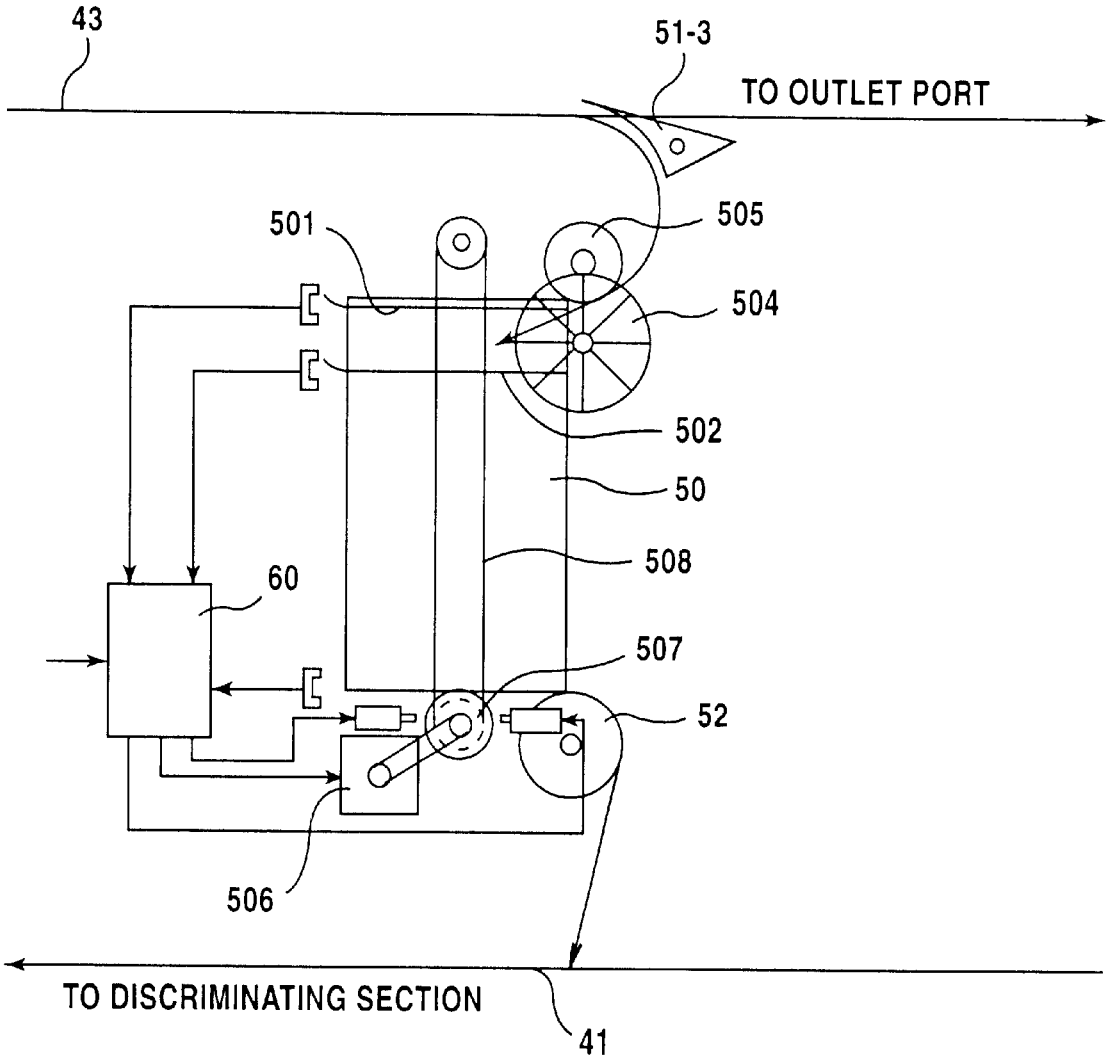
FIG. 51 is a structural diagram of a buffer pool.

FIG. 3 of this laid-open patent is used as FIG. 51 in the present invention and moreover this figure has been added to FIG. 3 of the laid-open patent in oder to make more clear the relationship between the buffer pool section 50 and the transfer route and gate.

The buffer pool section 50 is provided with a buffer upper guide 501 and a buffer lower guide 502 and collects the bills beteen these buffer upper and lower guides.

These buffer upper guide 501 and buffer lower guide 502 are structured to independently move vertically and a guide moving motor 506, a guide moving pulley 507 and a guice moving belt 508 aure provided to vertically move these buffer upper guide 501 and buffer lower guide 502. Details for independently moving the buffer upper guide 501 and buffer lower guide 502 are described in the official gazette of above laid-open patent. Namely, the buffer upper guide 501 and buffer lower guide 502 are individually provided with a guide moving pulley 507 and a guide moving belt 508. Moreover, as shown in FIG. 4 of the official gazette, a driving power of the guide moving motor 506 drives a guide moving belt 508 as a wrapping transmission mechanism through a driving shaft, an inverted bevel gear, an intermediate bevel gear and a guide moving pulley 507. Further, the buffer upper guide 501 and the buffer lower guide 502 are driven separately to move vertically by determining the guide moving belt 508 to be driven using a lock mechanism.

The buffer pool section 50 has the structure as explained above and is additionally provided with a buffer vane wheel 504 and a buffer takeup roller 505 to take up the bills.

The bills can be taken up into the buffer pool section 50 through the buffer vane wheel 504 and buffer takeup roller 505 by driving the gate 51-3 to locate the bills to be transferred through the returning transfer route 43 to the side of the buffer pool section 50.

Moreover, the buffer pool section 50 is also provided with a buffer feeding section 52 which feeds sheet by sheet the bills to transfer to the discriminating section 57 through the transfer route.

Drive of theguide moving motor 506, movement of the buffer upper guide 501 and buffer lower guide 502 and rotations of the buffer vane wheel 504, buffer takeup roller 505 and buffer feeding section 52 are all controlled by MPU60 shown in FIG. 6.

In addition, in the case of taking up the bills with the buffer vane wheel 504 and buffer takeup roller 505, the guide moving motor 506 is driven to move the buffer upper guide 501 to the upper most position not interfering the takeup of the bills. In this case, the buffer lower guide 502 is located at the lower most position. That is, tekeup of bills is possible even when the buffer lower guide 502 is not used, but when the buffer lower guide 502 is located at the lower most position, a distance is kept between the takeup position and the buffer lower guide 502 and thereby the bills naturally fall until these have reached the buffer lower guide 50. If the bills naturally fall for a longer distance, attitude of the bills becomes unstable and the bills are unpreferably stacked roughly. For this reason, the buffer lower guide 502 is designed movable and it can be located to the predetermined position in the case of taking up the bills using the buffer vane wheel 504 and buffer takeuo roller 505. Accordingly, even when a larger number of bills are accommodated in the buffer pool section 50, namely even when the buffer pool section 50 is enlarged, the bills can be collected and stacked orderly on the buffer lower guide 502. The predetermined position is sufficiently covered, for example, with a space to accommodate the bills of about 200 sheets.

In the case of feeding the bills from the buffer pool section 50, the buffer upper guide 501 and the buffer lower guide 502 are moved toward the buffer feeding section 52, that is, in the lower direction. This buffer lower guide 502 is formed as a comb type. A roller as the buffer feeding section 52 enters the comb-shaped recessed. Therefore, even when the buffer lower guide 502 is located to the lower most position, it never collides with the buffer feeding section 52, not impeding the feeding of bills from the buffer feeding section 52. Meanwhile, the buffer pool section 50 is structured to rotate a roller with a motor and therefore when a plurality of this roller are arranged in the width direction, the bills can be fed more reliably.

When the buffer upper guide 501 and buffer lower guide 502 are moved downward, the bill in the lower most position among those stacked on the buffer lower guide 502 is placed in contact with the buffer feeding section 52. Therefore, the bill can be pressed to the buffer feeding section 52 with a pressure suitable for feeding by further moving only a little downward the buffer upper guide 501.

When the buffer feeding section 52 is driven under the condition explained above, the bills can be fed from the buffer pool section 50.

As shown in FIG. 51, the buffer pool section 50 takes up the bills from the right side of the drawing and feeds them in the right side so that the front end part of a bill is located in the left side at the takeup time and the rear end part of a bill is located in the left side at the feeding time. Moreover, the stackers R, F 30-1, 30-2 shown in FIG. 20 takes up the bills from the right side of the drawing and feeds them from the left side. Namely, in the takeup time, the front end part of a bill is located in the left side and is also located in the left side in the feeding time.

Therefore, in the buffer pool section 50, the takeup direction is inverted from the feeding direction, that is, the bills are transferred by the switch-back method. However, since the takeup direction is the same as the feeding direction in the F, R stackers 30-1, 30-2, the bills which are once accommodated in the buffer pool section 50 and thereafter fed therefrom are inverted in the front and rear surfaces from such surfaces of the bills collected and stacked in the F, R stackers 30-1,30-2 and the bills are stacked in the bill recycle unit in such a manner that the bills are stacked upside down.

INDUSTRIAL APPLICABILITY

As explained above, a paper sheet manipulating/transaction apparatus of the present invention in an automatic transaction apparatus for executing the receiving and expensing transactions depending on the operations by an operator is just suitable for execution of high speed transaction manipulations and realizing an apparatus which results in less number of times of stoppage of operations and generation of faults.

What is claimed is:

1. A paper sheet manipulating apparatus comprising:

an inlet port to which paper sheets are inputted;

a sending means for feeding the paper sheets inputted to the inlet port to a discriminating section;

the discriminating section for discriminating the paper sheet;

a transfer route for transferring the paper sheets to an accommodation section depending on the result of discrimination; and a temporary storing section directly following the discrimination section for temporarily storing the paper sheets discriminated in the discriminating section as those which should not be accommodated in the accommodation section so that the paper sheets can be rediscriminated independently of the sheets in the accommodation section.

2. A paper sheet manipulating apparatus according to the claim 1, further comprising a control section which is structured to control several different kinds of the paper sheets to be accommodated in the temporary storing section and to control the temporary storing section to store the paper sheets depending on the result by the discriminating section.

3. A paper sheet transaction apparatus comprising:

an accommodation section for accommodating paper sheets;

a sending means for feeding the paper sheets inputted to an inlet port to a discriminating means;

the discriminating means for discriminating the paper sheets and identifying a front and a rear surface of each of the paper sheets;

a transfer route for transferring the paper sheets depending on the discrimination results; and a temporary storing section for storing some paper sheets with the front or rear surface inverted from that of other paper sheets discriminated as those to be accommodated in the accommodation section and said temporary storing section capable of being accessed and the paper sheets therein can be fed back to the discrimination section whereby some paper sheets with the front or rear surface inverted, from that of the paper sheets to be accommodated in the accommodating section, can be inverted in the same orientation as the paper sheets in the accommodation section so the previously inverted paper sheets can be stored in the accommodation section.

4. A paper sheet transaction apparatus comprising:

a plurality of accommodation sections for accommodating a plurality different kinds of paper sheets in the apparatus;

an inlet port to which the paper sheets are inputted;

a sending means for feeding the paper sheets inputted to the inlet port to a discrimination section;

the discriminating section for discriminating the paper sheets and identifying kinds of the paper sheets;

a transfer route for transferring the paper sheets to the accommodation section depending on the result of discrimination; and a temporary storing section directly following the discrimination section for storing the paper sheets discriminated as the kinds of paper sheets which should not be accommodated in the accommodation section so that the paper sheets can be manipulated independently of the sheets in the accommodation section and said temporary storing section is capable of being accessed and the paper sheets therein can be fed to another section of the apparatus.

5. A paper sheet manipulating apparatus comprising:

an accommodation section for accommodating paper sheets in the apparatus;

an inlet port to which the paper sheets are inputted;

a sending means for sending the paper sheets inputted to the inlet port to a discriminating section;

the discriminating section for discriminating the paper sheets;

a transfer route for transferring the paper sheets which have been discriminated to the accommodation section;

a change-over means for changing over the route to a returning transfer route from the transfer route depending on the result of discrimination in the discriminating section, said change-over means effectuates a single transfer operation for the paper sheets which should not be accommodated in the accommodation section, transferring the paper sheets directly back to the inlet port via a returning transfer route thereby reducing the usage of the transfer route;

a temporary storing section for temporarily storing paper sheets changed over by the change-over means; and the returning transfer route for returning the paper sheets from the change-over means to the inlet port.

6. A paper sheet transaction apparatus comprising:

a plurality of accommodation sections for accommodating a plurality kinds of paper sheets in the apparatus;

an inlet port to which the paper sheets are inputted;

a sending means for feeding the paper sheets inputted to the inlet port to a discriminating section;

the discriminating means for discriminating the paper sheets and identifying kinds and front and rear surfaces of the paper sheets;

a transfer route for transferring the paper sheets to the accommodation section depending on the result of discrimination;

a temporary storing section for storing the paper sheets and feeding them in the same front or rear surface orientation as that of the paper sheets accommodated in the accommodation section; and a control section for controlling accommodating the paper sheets discriminated as those which can be accommodated in the accommodation section into the accommodation section, accommodating, into the temporary storing section, the paper sheets of the kinds which should not be accommodated in the accommodation section and the paper sheets with the front or rear surface different from that of the paper sheets to be accommodated in the accommodation section, and feeding the paper sheets accommodated in the temporary storing section and transferring to the accommodation section, the paper sheets, of the same kind as those to be accommodated in the accommodation section, said paper sheets being among those fed from the temporary storing section.

7. A paper sheet transaction apparatus according to the claim 6, further comprising:

a running reject section for storing the paper sheets which should not be accommodated in the accommodation section, and a control section for controlling accommodating, to the accommodation section, the paper sheets which are found, as a result of discrimination, as those to be accommodated in the accommodation section and accommodating, the paper sheets of the kinds which should not be accommodated in the accommodation section, and the paper sheets with the front or rear surface different from that of the paper sheets to be accommodated in the accommodation section, feeding the paper sheets accommodated in the temporary storing section, transferring the paper sheets of the same kinds, as those accommodated in the accommodation section among the paper sheets fed, and transferring the paper sheets of the kinds which should not be accommodated in the accommodation section among those fed from the temporary storing section to the running reject section.

8. A paper sheet transaction apparatus comprising:

a plurality of accommodation sections for accommodating a plurality of different kinds of paper sheets in the apparatus;

an inlet port to which the paper sheets are inputted;

a sending means for sending the paper sheets inputted to the inlet port to a discriminating section;

the discriminating section for discriminating the paper sheets;

a transfer route for transferring the paper sheets to the accommodation section depending on the result of discrimination;

a temporary storing section for accommodating the paper sheets and feeding the paper sheets, at the time of feeding operation, in the same front or rear surface direction as those accommodated in the accommodation section;

a cassette which is removably loaded for separately accommodating the paper sheets; and a control section for controlling accommodating, in the accommodation section, the paper sheets which are found as those to be accommodated in the accommodation section as a result of discrimination, accommodating the paper sheets which cannot be accommodated in the accommodation section into the temporary storing section, feeding the paper sheets accommodated in the temporary storing section designated to be accommodated in the accommodation section and accommodating, in the cassette, the paper sheets to be accommodated in the accommodation section, the paper sheets being among those fed above from the temporary storing section.

9. A paper sheet transaction apparatus according to the claim 8, further comprising:

a running reject section for storing paper sheets which should not be accommodated in the accommodation section; and a control section for controlling accommodating, to the accommodation section, the paper sheets which are found, as a result of discrimination, as those to be accommodated in the accommodation section and accommodating the paper sheets which cannot be accommodated in the accommodation section in the temporary storing section, feeding the paper sheets in the temporary storing section, accommodating the paper sheets to be accommodated in the accommodation section among those fed above into the cassette and accommodating the paper sheets of the kinds which should not be accommodated in the accommodation section among those fed from the temporary storing section in the running reject section.

10. A paper sheet transaction apparatus comprising:

an accommodation section for accommodating paper sheets in the apparatus;

an inlet port to which the paper sheets are inputted;

a sending means for sending the paper sheets in the inlet port to a discriminating section;

the discriminating section for discriminating the paper sheets transmitted by the sending means;

a transfer route for transferring the paper sheets to be accommodated in the accommodation section depending on the discrimination result of the discriminating section;

a collecting section provided in the accommodation section for temporarily accommodating the paper sheets to be accommodated in the accommodation section;

a takeup means for accommodating the paper sheets in the collecting section;

a feeding means for feeding the paper sheets from the accommodation section;

a temporary storing section directly following the discrimination section for temporarily storing the paper sheets which are found as those to be accepted but should not be stored in the accommodation section as a result of discrimination by the discriminating section; and a control section for controlling the feeding of the paper sheets in the collecting section into the accommodation section depending on setup of a transaction.

11. A paper sheet transaction apparatus according to claim 10, further comprising a running reject section for storing paper sheets to be accepted but should not be stored in the accommodation section, wherein said control section controls the feeding of the paper sheets in the collecting section into the accommodation section and the feeding of the paper sheets in the temporary storing section into the running reject section depending on setup of the transaction.

12. A paper sheet transaction apparatus comprising:

an accommodation section for accommodating paper sheets in the apparatus;

an inlet port to which the paper sheets are inputted;

a sending means for sending the paper sheets in the inlet port to a discrimination section;

the discriminating section for discriminating the paper sheets transferred by the sending means;

a transfer route for transferring the paper sheets to be accommodated in the accommodation section depending on the discrimination result of the discriminating section;

a collecting section provided in the accommodation section for temporarily storing the paper sheets to be accommodated in the accommodation section;

a takeup means for accommodating the paper sheets in the collecting section;

a feeding means for feeding the paper sheets from the accommodation section or the collecting section; and a control section for controlling the feeding of the paper sheets in the collecting section into the outlet port by means of the feeding means when a transaction is disabled.

13. A paper sheet transaction apparatus according to claim 12, further comprising a temporary storing section for temporarily storing the paper sheets discriminated as the paper sheets to be accepted but should not be accommodated in the accommodation section as the result of the discriminating section, wherein said control section controls the feeding of the paper sheet in the collecting section and the transferring of the paper sheets in the temporary storing section by means of the feeding means when the transaction is disabled.

14. A paper sheet transaction apparatus comprising:

an accommodation section for accommodating paper sheets in the apparatus;

an inlet port to which the paper sheets are inputted;

a sending means for sending the paper sheets of the inlet port to a discriminating section;

the discriminating section for discriminating the paper sheets transmitted by the sending means;

a transfer route for transferring the paper sheets to be accommodated in the accommodation section depending on the result of the discriminating section;

a collecting section provided in the accommodation section for temporarily storing the paper sheets to be accommodated in the accommodation section;

a takeup means for taking up the paper sheets in the collecting section;

a feeding means for feeding the paper sheets from the accommodation section or the collecting section; and a control section for controlling to control the feeding means to feed the paper sheets of the collecting section to the outlet port and stopping the operation of the takeup means when the transaction is disabled.

15. A paper sheet manipulating apparatus comprising:

a plurality of accommodation sections for accommodating different kinds of paper sheets in the apparatus;

an inlet port to which the paper sheets are inputted;

a sending means for sending the paper sheets of the inlet port to a discriminating section;

the discriminating section for discriminating the paper sheets;

a transfer route for transferring the paper sheets to the plurality of accommodation sections depending on the result of the discriminating section;

a cassette removably loaded to accommodate the paper sheets and feed at least the paper sheets being accommodated;

a cassette reject section provided in the cassette to accommodate the paper sheets other than those accommodated in the cassette; and a control section for controlling transfer, to the cassette rejection section, the paper sheets which have been fed from the cassette and discriminated in the discriminating section as those which should not be transferred to an outlet port.

16. A paper sheet manipulating apparatus comprising:

an accommodation section for accommodating paper sheets in the apparatus;

an inlet port to which the paper sheets are inputted;

a sending means for sending the paper sheets of the inlet port to a discriminating section;

the discriminating section for discriminating the paper sheets;

a transfer route for transferring the paper sheets to be accommodated in the accommodation section depending on the result of the discriminating section;

a cassette removably loaded to accommodate the paper sheet and feed at least the paper sheets being accommodated;

a cassette reject section provided in the cassette to accommodate the paper sheets other than those accommodated in the cassette; and a control section for controlling transfer, to the cassette reject section, the paper sheets which have been fed from the cassette and discriminated in the discriminating section as those which should not be accommodated in the accommodation section.

17. A paper sheet manipulating apparatus comprising:

an accommodation section for accommodating paper sheets in the apparatus;

an inlet port to which the paper sheets are inputted;

a sending means for sending the paper sheets of the inlet port to a discriminating section;

the discriminating section for discriminating the paper sheets;

a running reject section for accommodating the paper sheets depending on the result of the discriminating section;

a cassette removably loaded to accommodate the paper sheets and feed at least the paper sheets being accommodated;

a cassette reject section provided in the cassette to accommodate the paper sheets other than those accommodated in the cassette; and a control section for controlling transfer, to the cassette reject section, the paper sheets fed from the cassette and discriminated by the discriminating section as those which should not be accommodated in the accommodation section and to transfer, to the running reject section, the paper sheets discriminated as those which should not be accommodated in an outlet port.

18. A paper sheet manipulating apparatus comprising:

an accommodation section for accommodating paper sheets in the apparatus;

an inlet port to which the paper sheets are inputted;

a sending means for sending the paper sheets of the inlet port to a discriminating section;

the discriminating section for discriminating the paper sheets;

a running reject section for accommodating the paper sheets depending on the discrimination result of the discriminating section;

a cassette to be removably loaded to accommodate the paper sheets and feed at least the paper sheets being accommodated;

a cassette reject section provided in the cassette to accommodate the paper sheets other than those accommodated in the cassette; and a control section for controlling transfer, to the cassette reject section, the paper sheets fed from the cassette and discriminated in the discriminating section as those which should not be accommodated in the accommodation section and for controlling the transfer, to the running reject section, the paper sheets fed from the accommodation section and discriminated in the discriminating section as those which should not be accommodated in the cassette.

19. A paper sheet manipulating apparatus comprising:

an accommodation section for accommodating paper sheets in the apparatus;

an inlet port to which the paper sheets are inputted;

a sending means for sending the paper sheets of the inlet port to a discriminating section;

the discriminating section for discriminating the paper sheets;

a transfer route for transferring the paper sheets to be accommodated in the accommodation section depending on the result of the discriminating section;

a reject means for accommodating the paper sheets separately from the accommodating section and for storing the paper sheets discriminated in the discriminating section as those which should not be accommodated into the accommodation section;

a temporary storing section directly following the discrimination section for once storing the paper sheets discriminated as those which should not be accommodated into the accommodation section; and a control section for controlling storing, to the temporary storing section, the paper sheets discriminated as those which should not be accommodated into the accommodation section, accommodating, into the reject means, the paper sheets which are stored in the temporary storing section and discriminated again as those which should not be accommodated into the accommodation section and accommodating, to the accommodation section, the paper sheets discriminated as those which can be accommodated into the accommodation section.

20. A paper sheet manipulating apparatus according to the claim 19, further comprising a cassette removably loaded to accommodate paper sheets therein, wherein said control section controls storing, into the temporary storing section, the paper sheets fed from the cassette and discriminated as those which should not be accommodated into the accommodation section, accommodating, into the reject means, the paper sheets stored in the temporary storing section and discriminated again as those which should not be accommodated into the accommodation section, and accommodating the paper sheets discriminated as those which can be accommodated into the accommodation section.

21. A paper sheet manipulating apparatus according to the claim 20, wherein reject means is a cassette reject section provided in the cassette to accommodate the paper sheets separately from those being accommodated in the cassette and to take up the paper sheets.

22. A paper sheet manipulating apparatus comprising:

an inlet port to which the paper sheets are inputted;

a sending means for sending the paper sheets of the inlet port to a discriminating section;

the discriminating section for discriminating the paper sheets;

a transfer route for transferring the paper sheets to a cassette depending on the result of the discriminating section;

the cassette removably loaded to accommodate the paper sheets and feed or take up the paper sheets;

a reject means for accommodating the paper sheets separately from the cassette and accommodating the paper sheets discriminated in the discriminating section as those which should not be accommodated into the cassette;

a temporary storing section directly following the discrimination section for temporarily storing the paper sheets discriminated as those which should not be accommodated into the cassette; and a control section for controlling storing, into the temporary storing section, the paper sheets discriminated as those which should not be accommodated into the cassette, accommodating, into the reject means, the paper sheets stored in the temporary storing section and discriminated again as those which should not be accommodated into the cassette, and accommodating, into the cassette, the paper sheets discriminated as those which can be accommodated into the cassette.

23. A paper sheet manipulating apparatus according to the claim 22, wherein said reject means is a running reject section for accommodating the paper sheets separately from those in the accommodation section.

24. A paper sheet manipulating apparatus according to any one among the claims 3, 4, 5, 6, 7, 8, 9, 10, 11, 12, 13, 15, 16, 17, 18, 19 and 20, wherein said accommodation section further comprises:

a collecting section for collecting paper sheets;

a collecting section moving means for moving the collecting section to the paper sheet collecting position and for moving the collecting section to the draw-back position where the paper sheets cannot be collected; and a collecting section drive means movable in vertical direction for driving the collection section moving means with the vertical movement.

25. A paper sheet manipulating apparatus according to the claim 24, wherein said collecting section moving means further comprises:

a collecting section rotating shaft for rotating the collecting section between the paper sheets collecting position and the draw-back position where the paper sheets cannot be collected;

a collecting section rotating pulley to rotate together with the collecting section rotating shaft;

a collecting section drive belt for rotating the collecting section rotating pulley;

a connecting section drive pulley for driving the collecting section drive belt; and a rotating cam provided on the same shaft as the collecting section drive pulley to rotate in conjunction with the collecting section drive pulley; and said collecting section drive means further comprising:

a rotating plate can which engages with the drive pulley and moves vertically;

a collecting section drive gear for vertically moving the rotating plate cam; and a collecting section moving motor for rotating the collecting section drive gear.

* * * * *